United States Patent [19]

Warner

[11] 4,092,727

[45] May 30, 1978

[54] BOWLING SCORER

[75] Inventor: Roger Kenneth Warner, Dayton, Ohio

[73] Assignee: AMF Incorporated, White Plains, N.Y.

[21] Appl. No.: 711,217

[22] Filed: Aug. 3, 1976

Related U.S. Application Data

[63] Continuation of Ser. No. 319,353, Dec. 29, 1972, abandoned.

[51] Int. Cl.[2] ..... A63D 5/00

[52] U.S. Cl. ..... 364/900; 273/54 C; 235/92 GA; 340/323 B

[58] Field of Search ..... 340/172.5, 323 B; 235/92 GA; 273/54 C; 364/200, 900

[56] References Cited

U.S. PATENT DOCUMENTS

| | | | |
|---|---|---|---|
| 3,531,117 | 9/1970 | Preston et al. | 273/54 C |
| 3,589,725 | 6/1971 | Townsend | 235/92 GA X |
| 3,700,236 | 10/1972 | Walker | 273/54 C |
| 3,705,722 | 12/1972 | Bolger, Jr. et al. | 235/92 GA X |
| 3,718,812 | 2/1973 | Tillman et al. | 235/92 GA X |

*Primary Examiner*—Raulfe B. Zache

*Attorney, Agent, or Firm*—George W. Price; John H. Gallagher

[57] ABSTRACT

Scorekeeping means for computing bowling scores is provided having positionable input switches, one for each possible ball to be rolled, for recording ball-by-ball pinfall, strikes and spares; a computing device selectively energized to calculate individual player and team scores from information present in the input switches; a device for displaying ball and mark information and a running frame score total for each player as well as a running team score total all updated substantially concurrently with the selective energization of the computing device through the last frame completed by each player; and a printer selectively energizable and coordinated with the computing device to print out a history of the player and team games from the information present in the input switches at the completion of a game; wherein for each and every selective energization of the computing device the entire game history up to the point of the last completed frame for each and every player is completely recomputed, thereby providing automatic corrections of scoring errors once such errors have been corrected at random in the positionable input switches.

18 Claims, 46 Drawing Figures

FLOW CHART SYMBOL DEFINITIONS
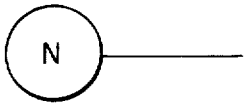
REENTRY POINT IN THE PROGRAM WHERE N IS THE REENTRY STEP NUMBER
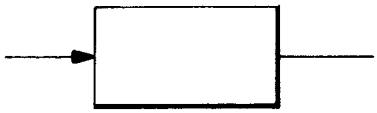
DESCRIPTION OF PROGRAM EXECUTION
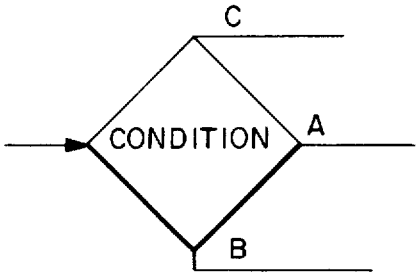
CONDITIONAL BRANCHING TO A IF A IS TRUE OR B IF B IS TRUE OR C IF C IS TRUE
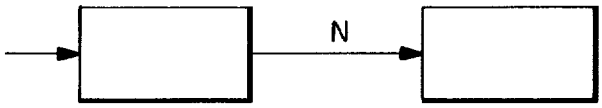
UNCIRCLED NUMBERS N ARE POSITIVE STEP NUMBERS IN FLOW CHART
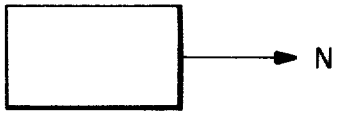
EXIT FROM SECTION OF PROGRAM TO A REENTRY POINT N
FIG. 11B
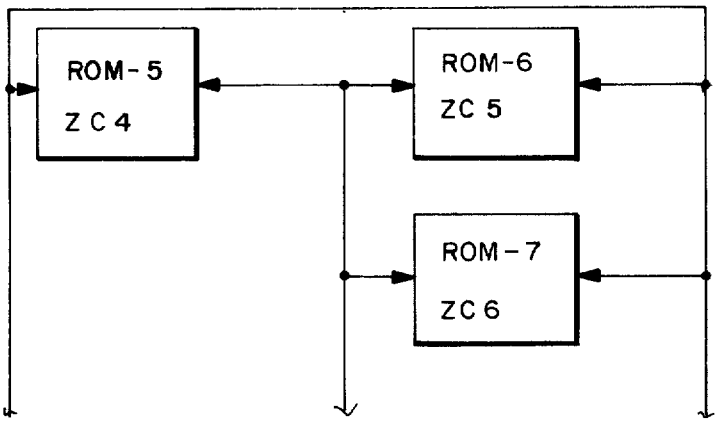
FIG. 2B

ZY5 THRU ZY7 SWITCH DRIVER
FOR PLAYER-LA

SWITCH SA-1 BALL-1 PLAYER-LA
SWITCH SA-2 BALL-2 PLAYER-LA
SWITCH SA-22 HANDICAP UNITS DECADE PLAYER-LA
SWITCH SA-23 HANDICAP TENS DECADE PLAYER-LA

SWITCHES SA-1 THRU SA-21 WIRED THE SAME

SWITCHES SA-22 AND SA-23 WIRED THE SAME

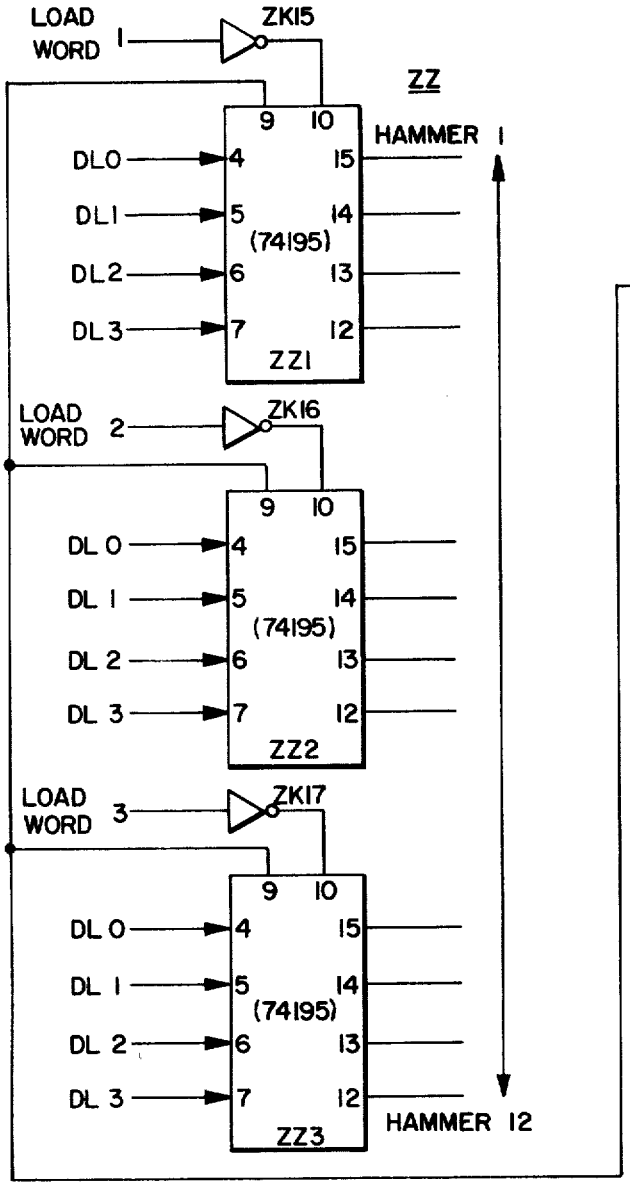
FIG. 8
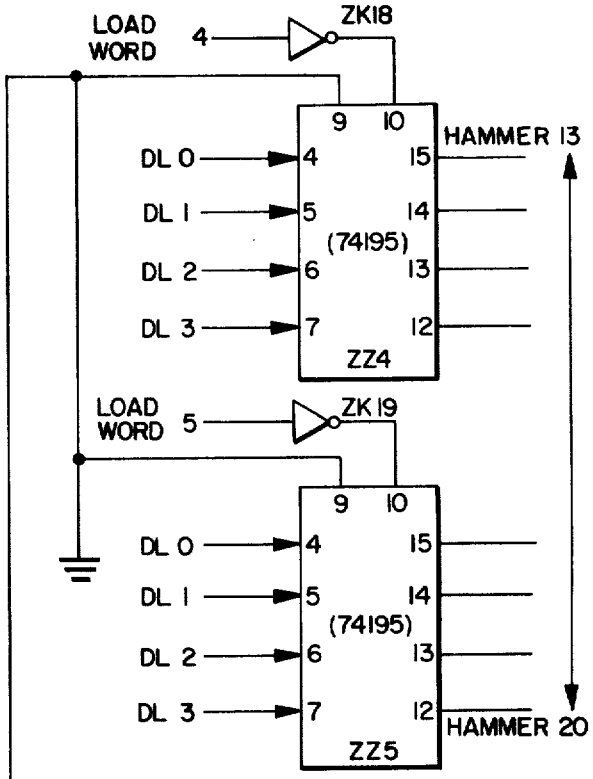
FIG. 7
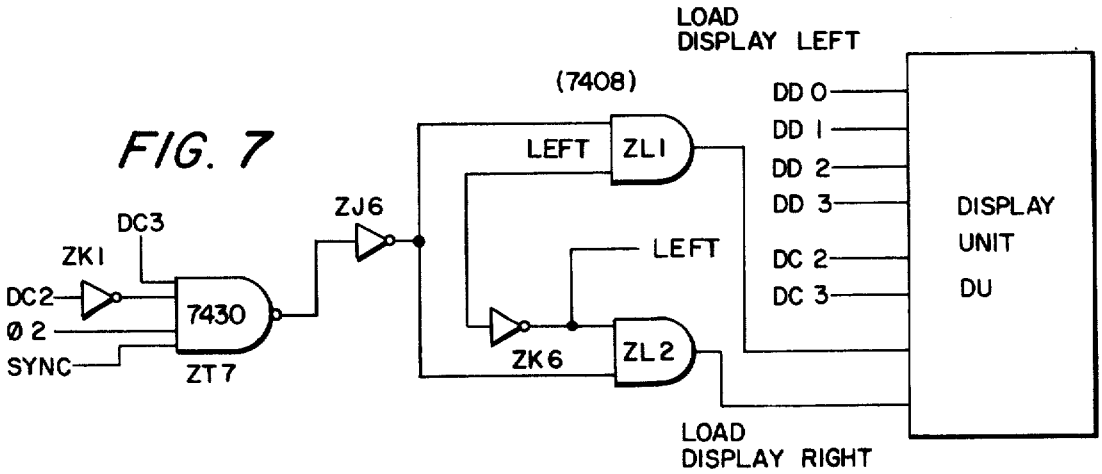

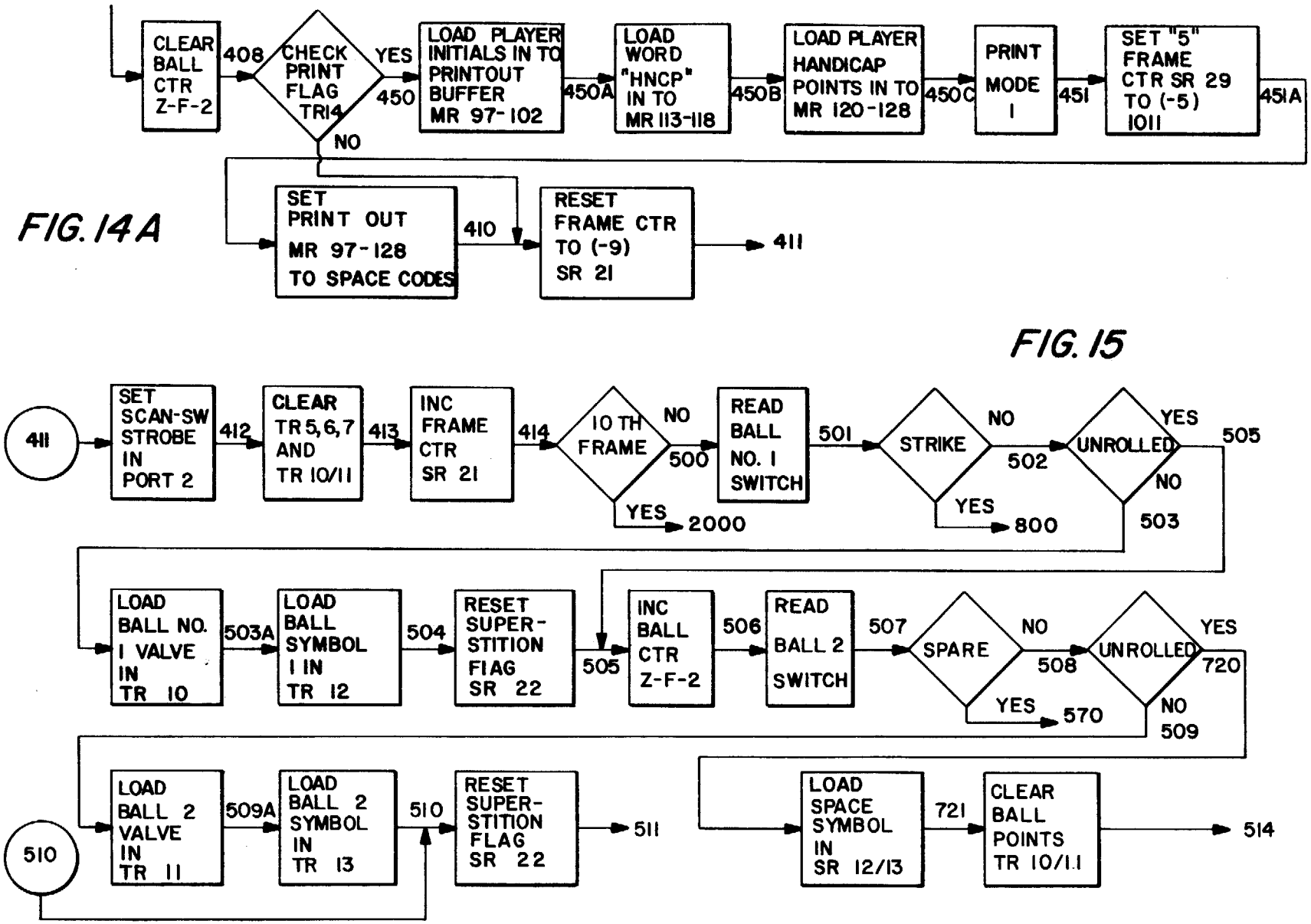
CLEAR BALL CTR Z-F-2
408
CHECK PRINT FLAG TR14
YES
NO
450
LOAD PLAYER INITIALS IN TO PRINTOUT BUFFER MR 97-102
450A
LOAD WORD "HNCP" IN TO MR 113-118
450B
LOAD PLAYER HANDICAP POINTS IN TO MR 120-128
450C
PRINT MODE 1
451
SET "5" FRAME CTR SR 29 TO (-5) 1011
451A
SET PRINT OUT MR 97-128 TO SPACE CODES
410
RESET FRAME CTR TO (-9) SR 21
411
FIG. 14A
SET SCAN-SW STROBE IN PORT 2
412
CLEAR TR 5,6,7 AND TR 10/11
413
INC FRAME CTR SR 21
414
10 TH FRAME
NO
YES
500
2000
READ BALL NO. 1 SWITCH
501
STRIKE
NO
YES
502
800
UNROLLED
YES
NO
503
505
LOAD BALL NO. 1 VALVE IN TR 10
503A
LOAD BALL SYMBOL 1 IN TR 12
504
RESET SUPER-STITION FIAG SR 22
505
INC BALL CTR CTR Z-F-2
506
READ BALL 2 SWITCH
507
SPARE
NO
YES
508
570
UNROLLED
YES
NO
509
720
LOAD BALL 2 VALVE IN TR 11
509A
LOAD BALL 2 SYMBOL IN TR 13
510
RESET SUPER-STITION FLAG SR 22
511
LOAD SPACE SYMBOL IN SR 12/13
721
CLEAR BALL POINTS TR 10/11
514
411
510
FIG. 15

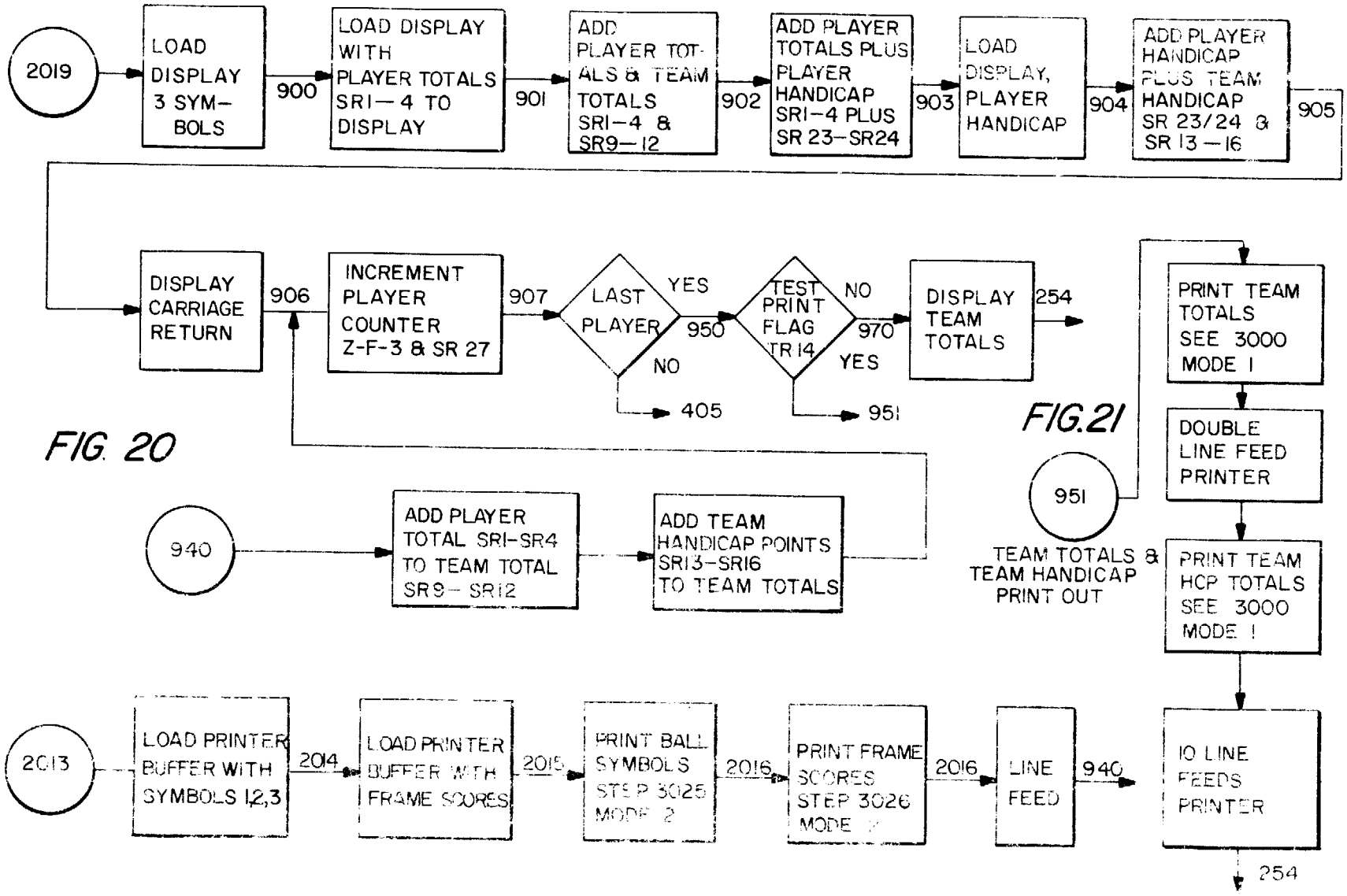
2019
LOAD DISPLAY 3 SYMBOLS
900
LOAD DISPLAY WITH PLAYER TOTALS SRI—4 TO DISPLAY
901
ADD PLAYER TOTALS & TEAM TOTALS SRI—4 & SR9—12
902
ADD PLAYER TOTALS PLUS PLAYER HANDICAP SRI—4 PLUS SR 23—SR24
903
LOAD DISPLAY, PLAYER HANDICAP
904
ADD PLAYER HANDICAP PLUS TEAM HANDICAP SR 23/24 & SR 13—16
905
DISPLAY CARRIAGE RETURN
906
INCREMENT PLAYER COUNTER Z-F-3 & SR 27
907
LAST PLAYER
YES
NO
405
950
TEST PRINT FLAG TR14
NO
YES
951
970
DISPLAY TEAM TOTALS
254
FIG. 20
940
ADD PLAYER TOTAL SRI-SR4 TO TEAM TOTAL SR9—SR12
ADD TEAM HANDICAP POINTS SR13-SR16 TO TEAM TOTALS
951
TEAM TOTALS & TEAM HANDICAP PRINT OUT
PRINT TEAM TOTALS SEE 3000 MODE 1
DOUBLE LINE FEED PRINTER
PRINT TEAM HCP TOTALS SEE 3000 MODE 1
10 LINE FEEDS PRINTER
254
FIG. 21
2013
LOAD PRINTER BUFFER WITH SYMBOLS 1,2,3
204
LOAD PRINTER BUFFER WITH FRAME SCORES
2015
PRINT BALL SYMBOLS STEP 3025 MODE 2
2015
PRINT FRAME SCORES STEP 3026 MODE 2
2016
LINE FEED
940

BOWLING SCORER

This is a continuation of application Ser. No. 319,353, filed Dec. 29, 1972, and now abandoned.

Table of Contents

1. Abstract
2. Specification — Introduction, Prior Art, Object of Invention and General Description of Drawings
3. The Basic Bowling Scorekeeping Means
4. The Display Format Of The Scorekeeping Means
5. The General System Of The Present Invention
6. The Player Ball Point Score Input Switches
7. The Input Switch Selector ZY
8. The Compute-Display And Print Command Circuits
9. The Computing Unit
10. The Display Unit Driver
11. The Printer Driver Circuit
12. Players Initials (Alpha Inputs)
13. The Print-Out Unit
14. Printer Hammer Operation
15. The Print-Out Format
16. Program Initiation and Completion
17. Representative Operating Program Listing of integrated circuit components in preferred embodiment

18. APPENDIX I

This invention relates to bowling score computing means and more particularly to such means in which pinfall information is manually entered into electronic calculating means for computing and displaying bowling score information and which score computing means has the capability to create a complete post game printed record of the bowling game or games being scored thereby.

The prior art is substantially replete with various bowling score computing and displaying devices of which U.S. Pat. No. 2,590,444 to Millman et al of Mar. 25, 1952 is apparently a pioneer. This patent is assigned to the assignee of the present application.

The disclosure of this patent, now expired, is incorporated by reference herein, at least to the extent that it explains the various considerations involved in coordinating ball-by-ball pinfall values, strikes, spares and attendant bonus points for properly calculating individual player and team scores throughout the course of a bowling game.

As further brought out by the Millman patent and recognized by all serious participants in the development of suitable bowling score computing devices, the rules of the American Bowling Congress must be met in order to gain market acceptance for any such device.

Accordingly, it is a primary object of the present invention to provide a new and novel bowling score computing means which satisfies all of the requirements of the American Bowling Congress for such bowling score computers.

It is another object of the present invention to provide a new and novel bowling score computing means combined with a visual display means providing all participants in the game being scored with a selectively updated visual record of ball-by-ball pinfall, spares, strikes, running individual totals through the last frame score completed and running team totals through the last frame scores completed by the respective players on each team being scored by the computing means.

It is another object of the present invention to provide a new and novel bowling score computing and display means having a new and novel superstition constraint on the display means for situations in which a player has an unbroken string of strikes in successive bowling frames during a bowling game.

Still another object of the present invention is to provide a new and novel bowling score computing and display means in which all data entry is manual.

Still another object of the present invention is to provide a new and novel bowling score computing and display means in which all data entry is manual and which is capable of computing and displaying the individual and team game scores of two teams of bowlers.

Still another object of the present invention is to provide a new and novel bowling score computing and display means in which all data entry is manual and which includes one positionable input switch means for each ball that can possibly be rolled by each player on a team of bowlers and which is capable of displaying the individual and team game scores of two teams of bowlers.

Still another object of the present invention is to provide a new and novel bowling score computing means which will display, on a visual display means, first and second ball pinfall and mark information for each frame of a bowling game together with an updated frame score total to the last fully scored frame for any given bowler upon selective actuation of the said score computing means with the exception of the updated total for any player coming within the superstition constraint by way of a string of successive strikes.

Yet another object of the present invention is to provide a new and novel bowling score computing means of the electronic digital type which obviates the need for electronic memory devices for storing past history information of player and team scores and which is nonetheless capable of a complete post game printout history of said individual player and team scores including ball-by-ball pinfall and mark information and frame subtotals for each and every frame bowled in previously completed individual and team games.

These and other objects of the present invention will become more fully apparent with reference to the following specification and drawings which relate to a preferred embodiment of the invention.

Figure 2A:
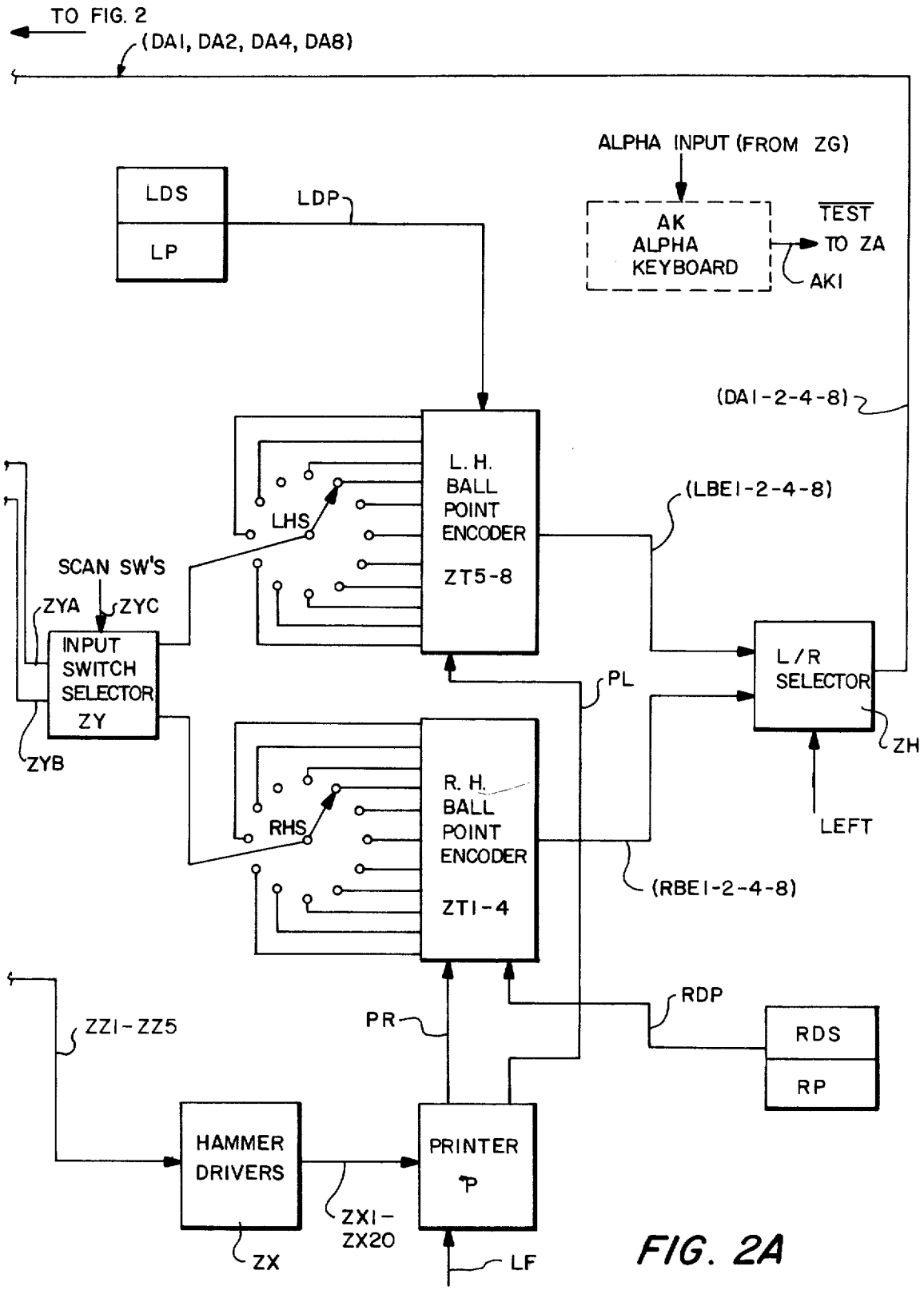
Figure 2:
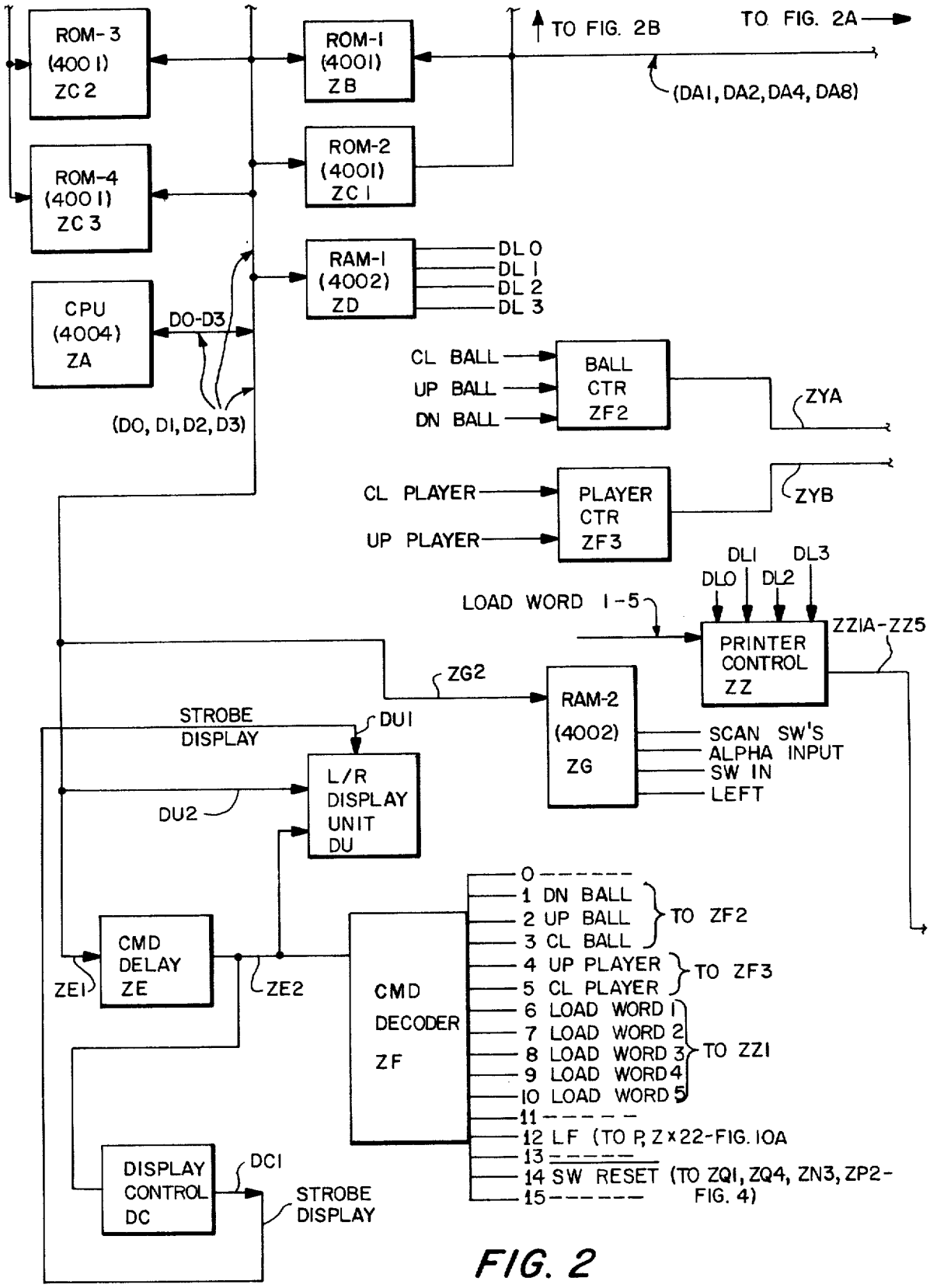
Figure 3:
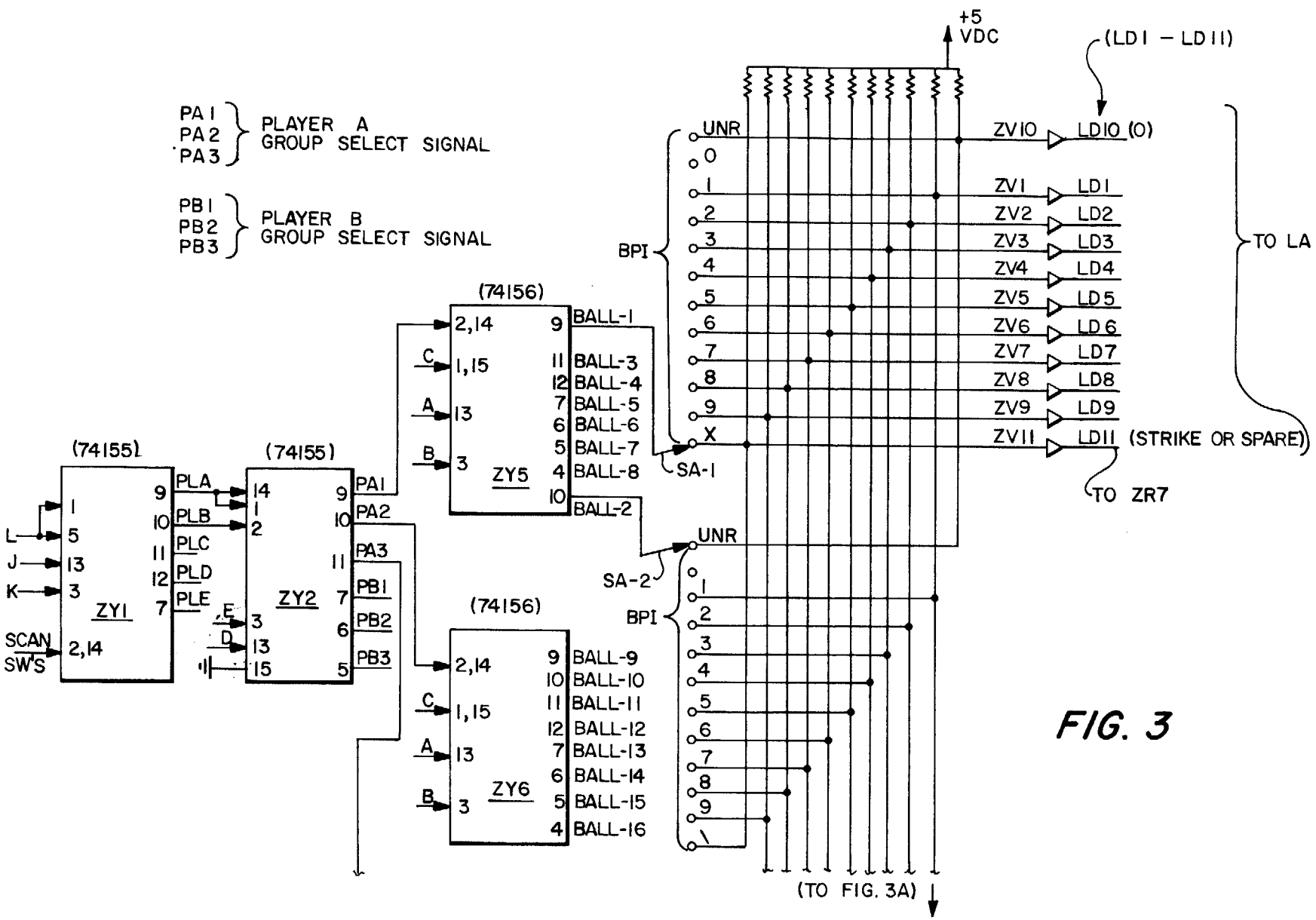
Figure 3A:
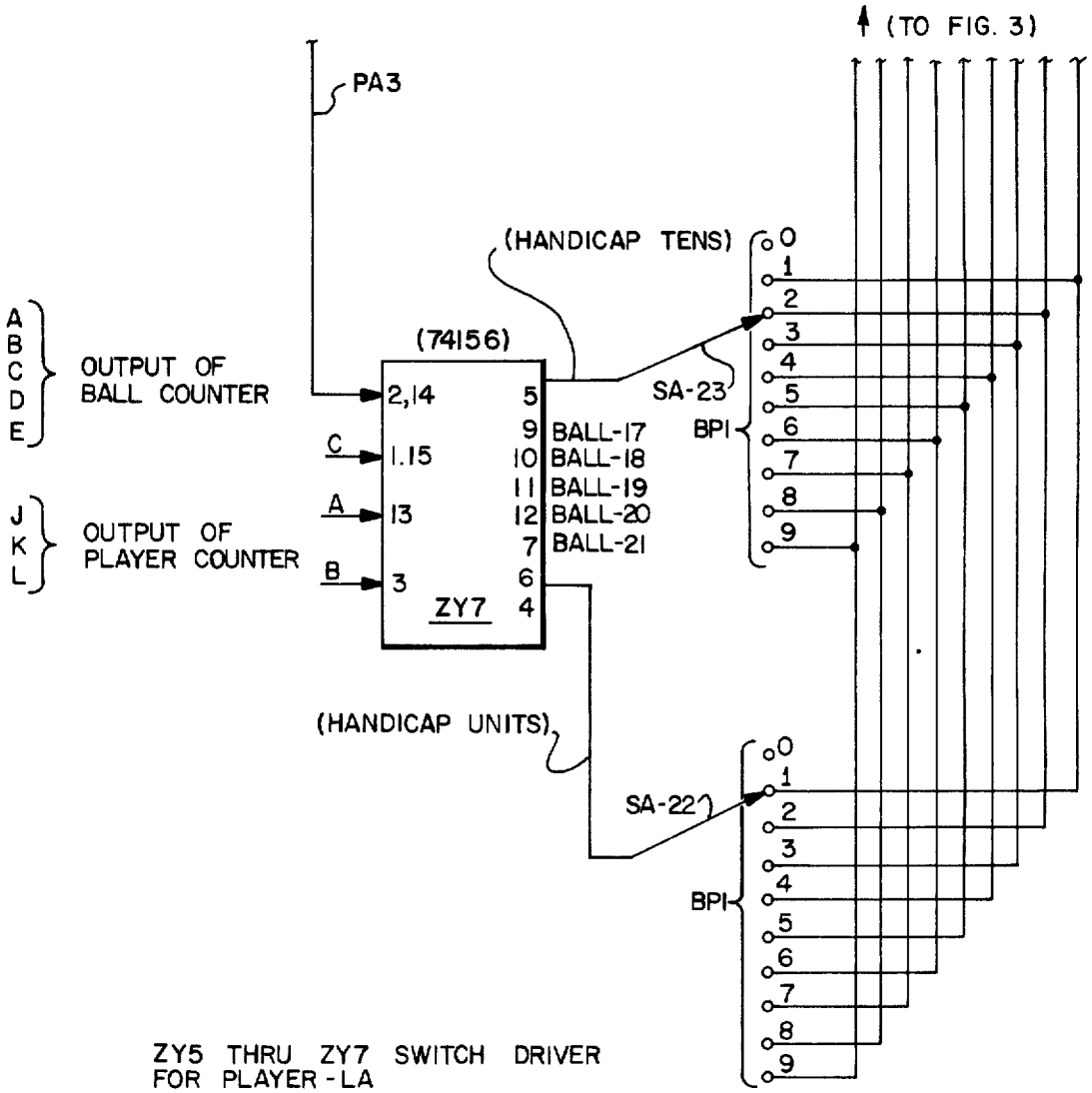
Figure 6:
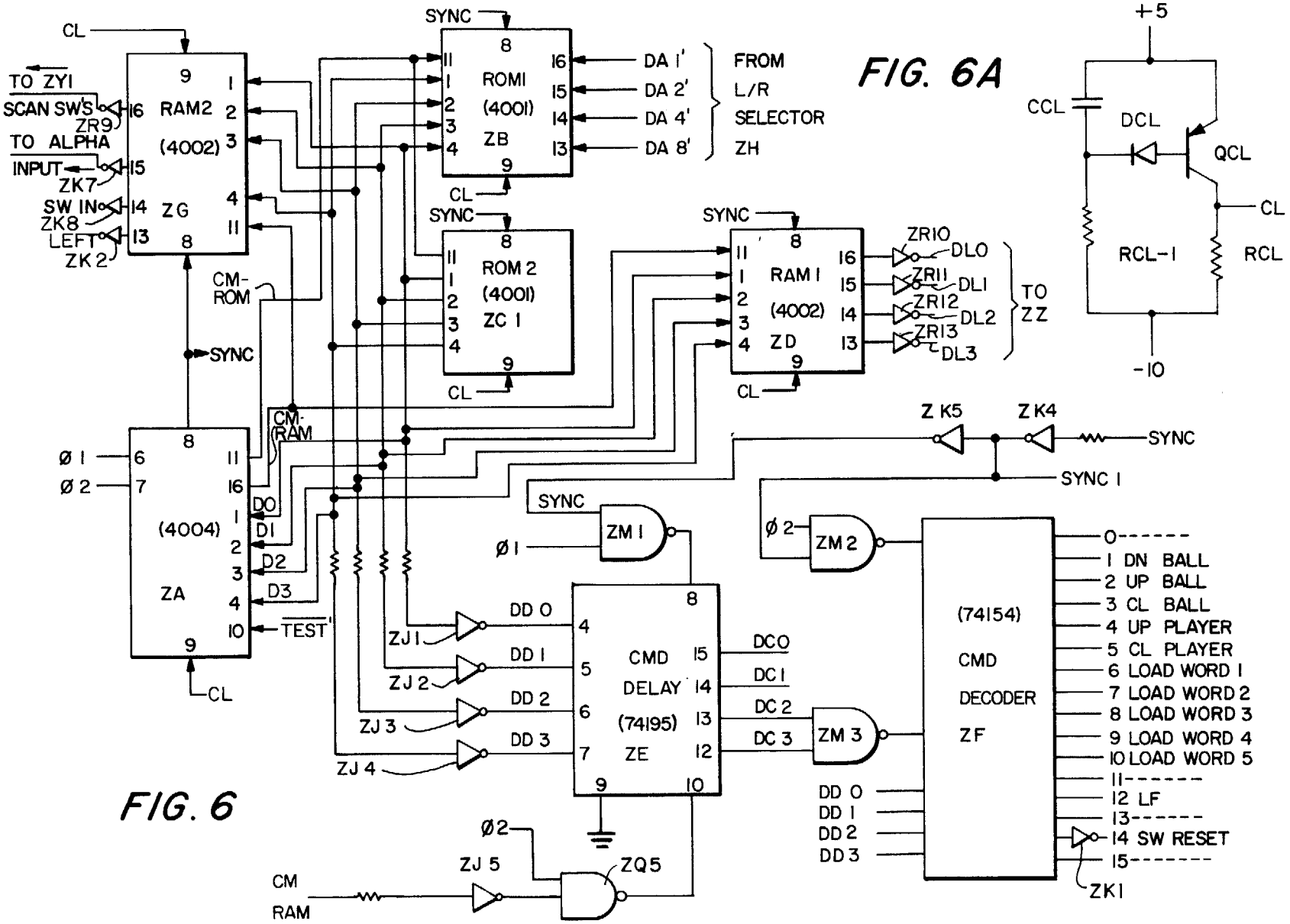
Figure 6B:
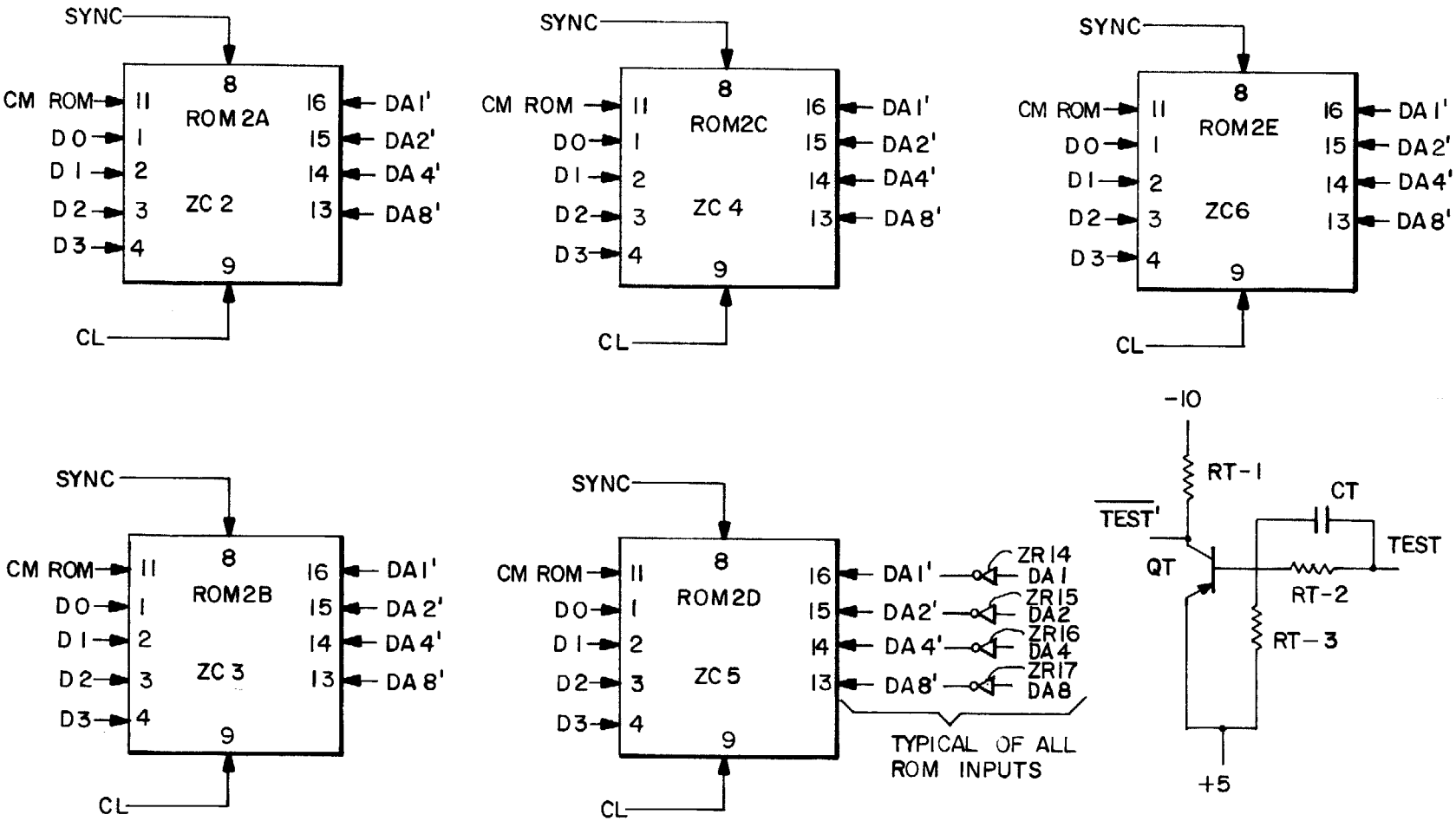
Figure 9:
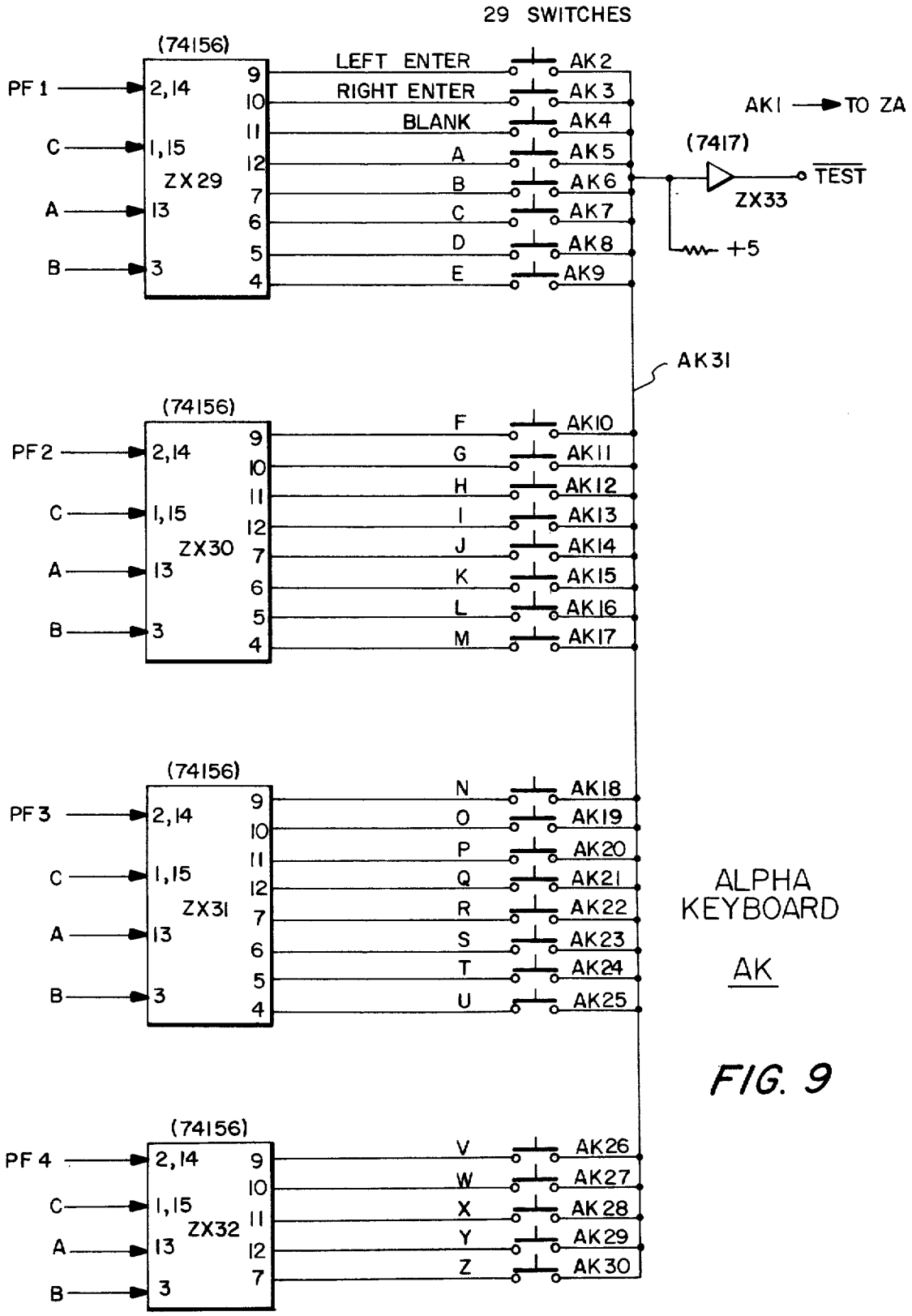
Figure 10:
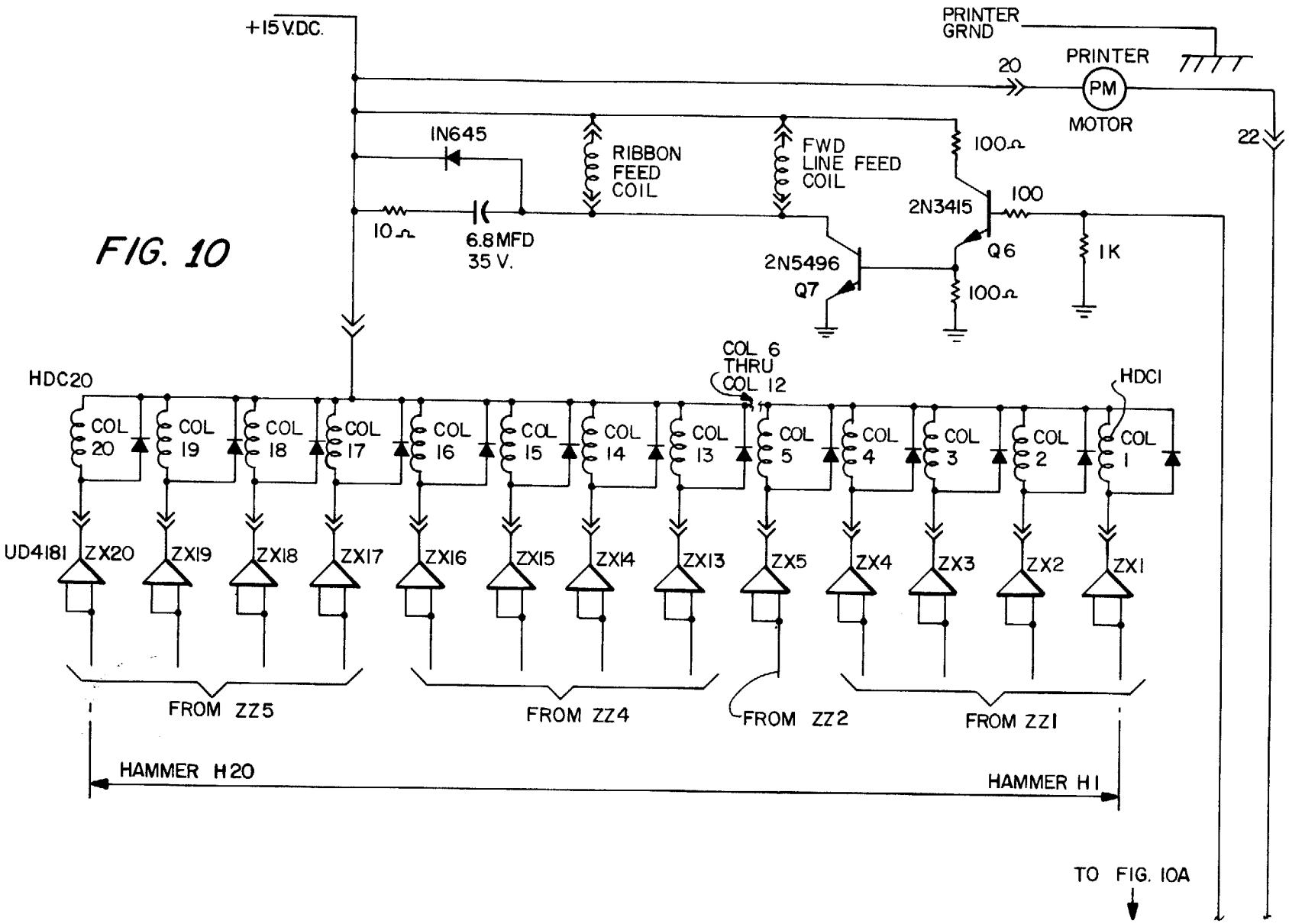
Figure 10A:
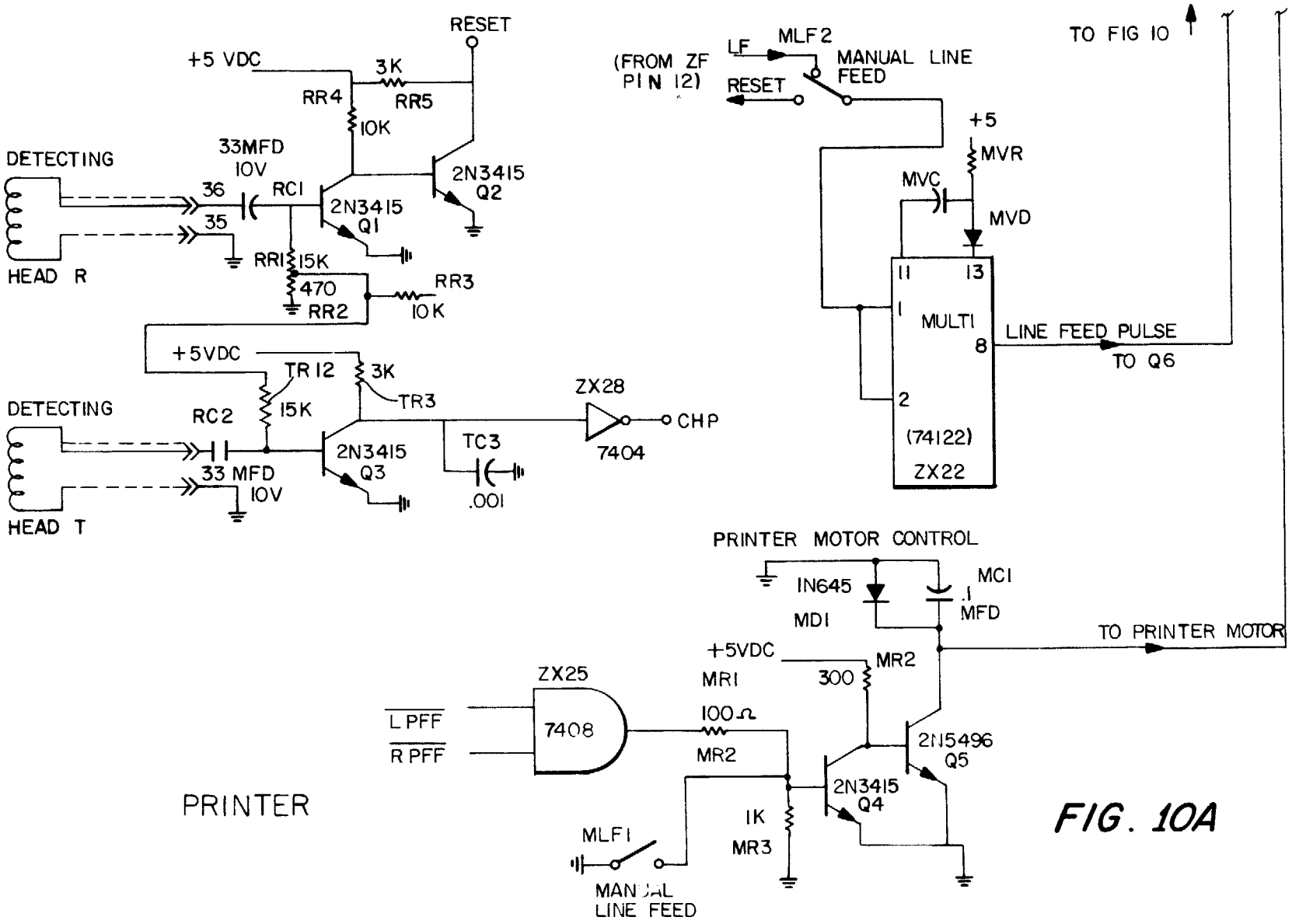

FIGS. 2, 2A and 2B, taken together, are a general schematic of the scoring system of the present invention;

FIGS. 3 and 3A, taken together, are a schematic of the ball point and handicap switches and associated strobe logic circuits of the present invention for a single bowler;

FIGS. 4, 4A, 4B and 4C, taken together, show the interconnections of the various ball point and handicap switches of two teams of bowlers into the system of the present invention together with the calculator display and print control circuits for the same;

FIGS. 5, 5A and 5B and 5C, taken together, are a schematic of the strobe logic circuitry for scanning each and every ball point and handicap switch of the system of the present invention and its interconnection with said system;

FIGS. 6 and 6B taken together are a schematic of the computing and command generating circuitry of the present invention;

FIG. 6A is a schematic of clear signal generating circuit of the present invention;

FIG. 7 is a schematic of a load left or right display unit control circuit of the present invention including a select right signal generating means;

FIG. 8 is a schematic of a printer hammer buffer register of the present invention;

FIG. 9 is a schematic of an alpha character input keyboard for the present invention;

FIGS. 10 and 10A, taken together, are a schematic of the printer control circuit of the present invention.

Figure 11:
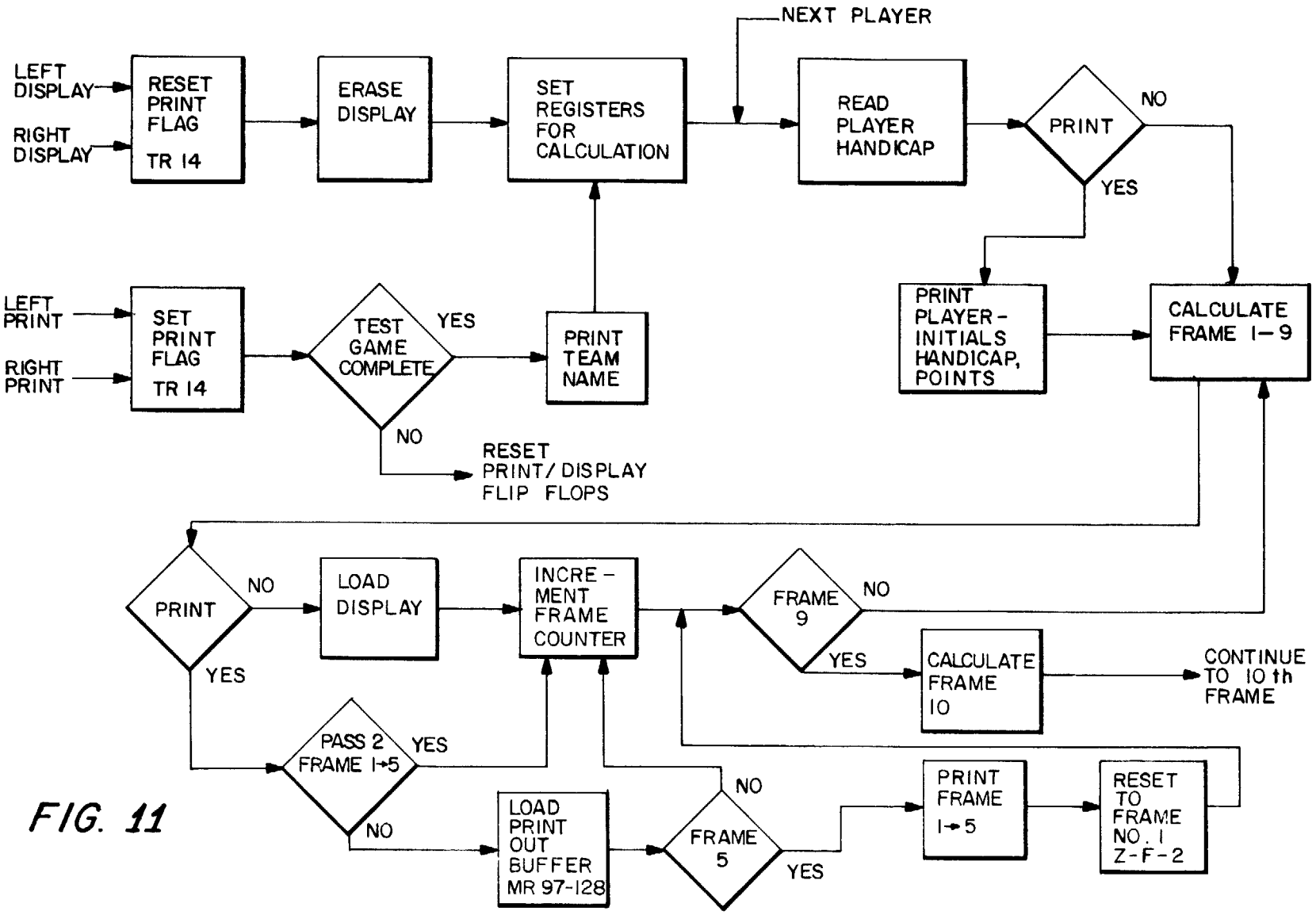
Figure 11A:
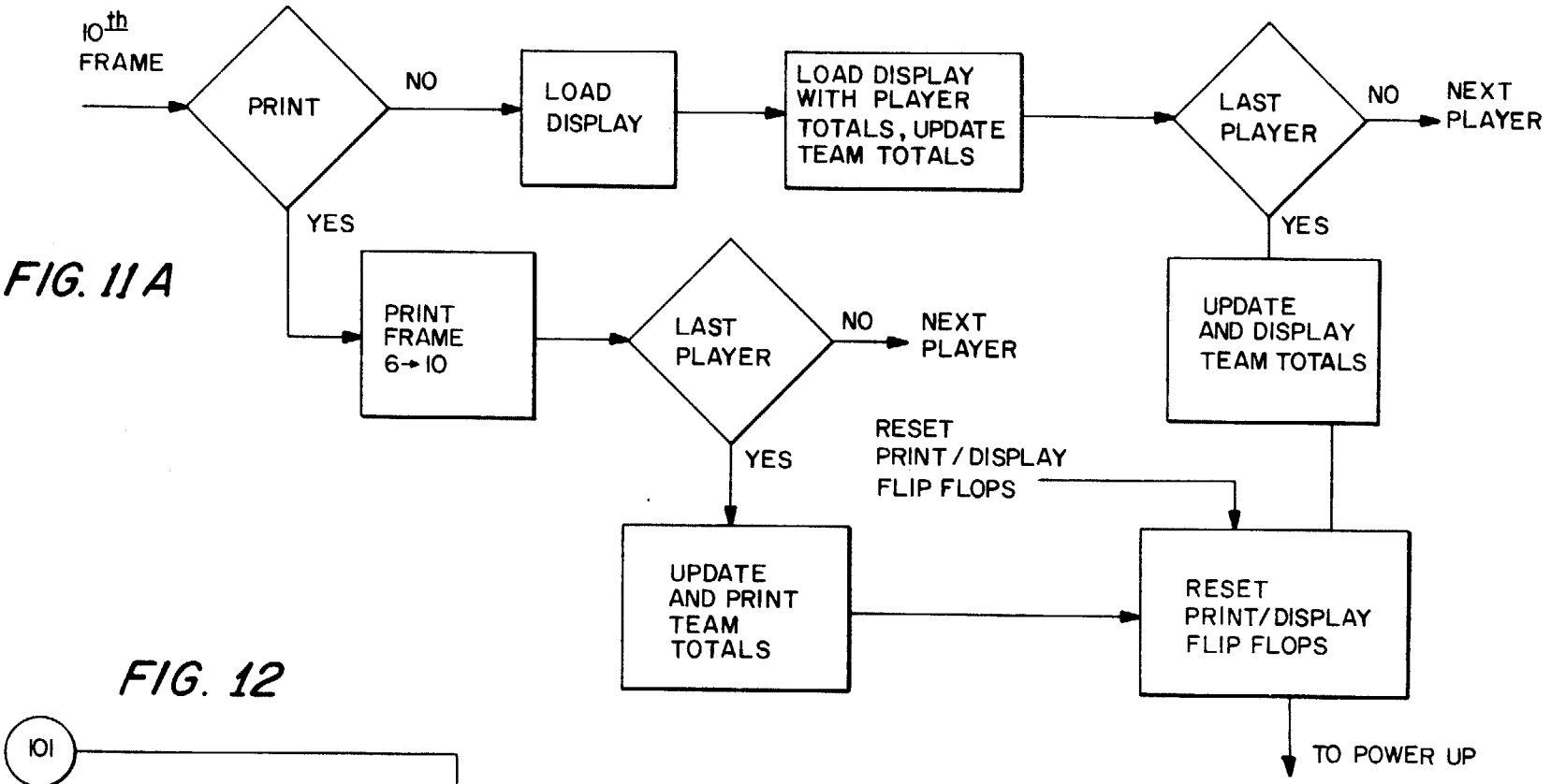
Figure 12:
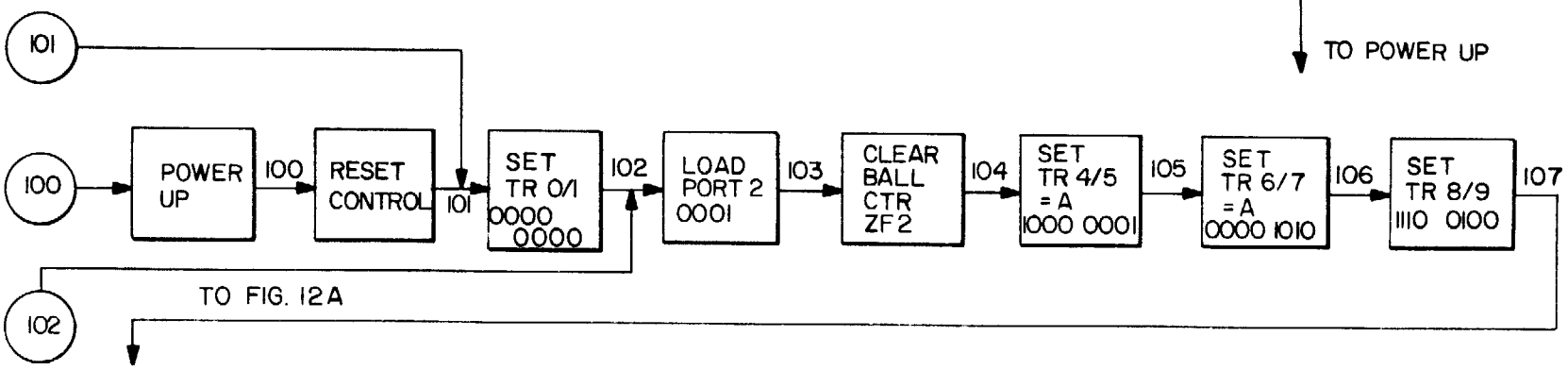
Figure 12A:
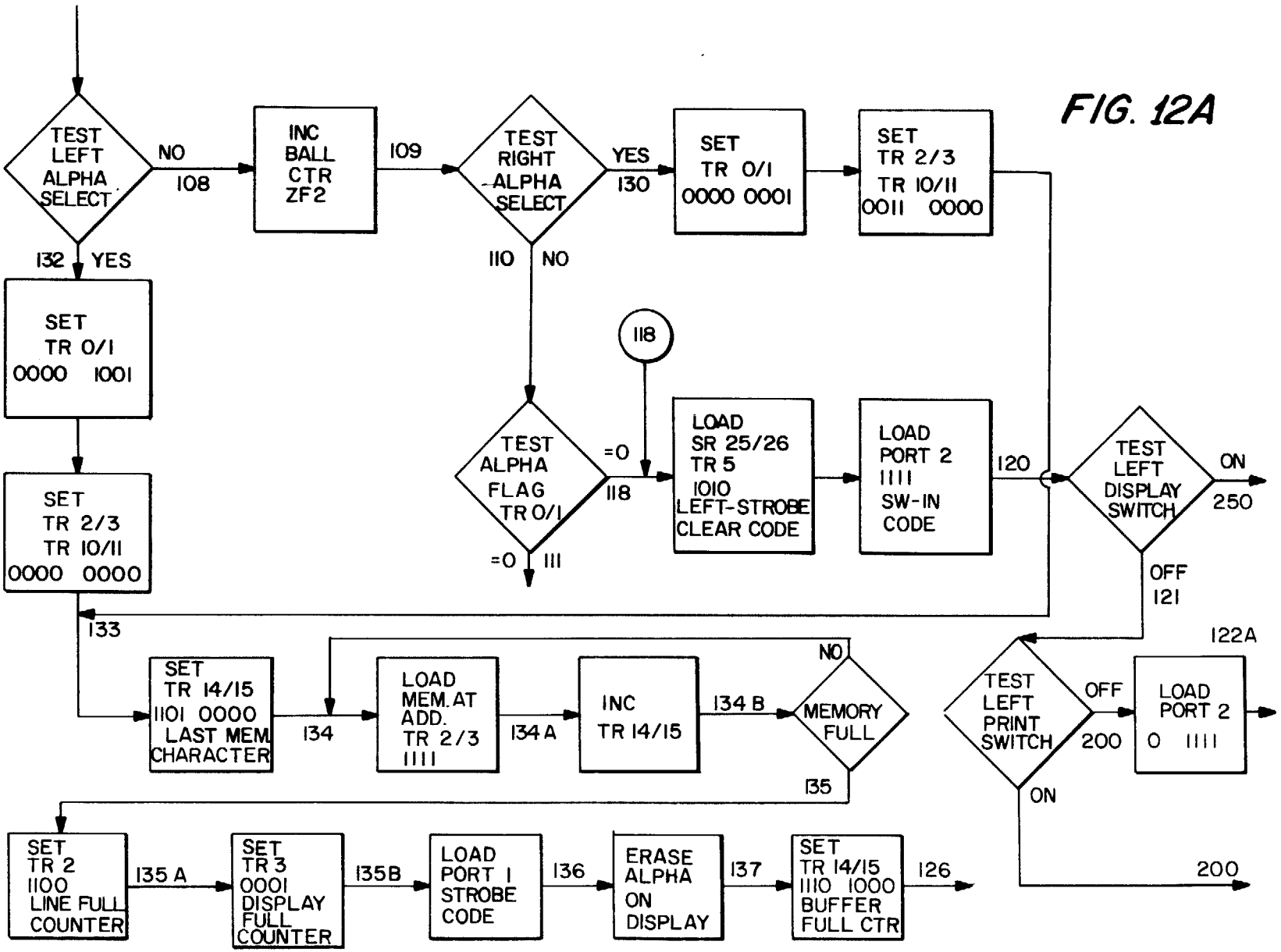
Figure 13:
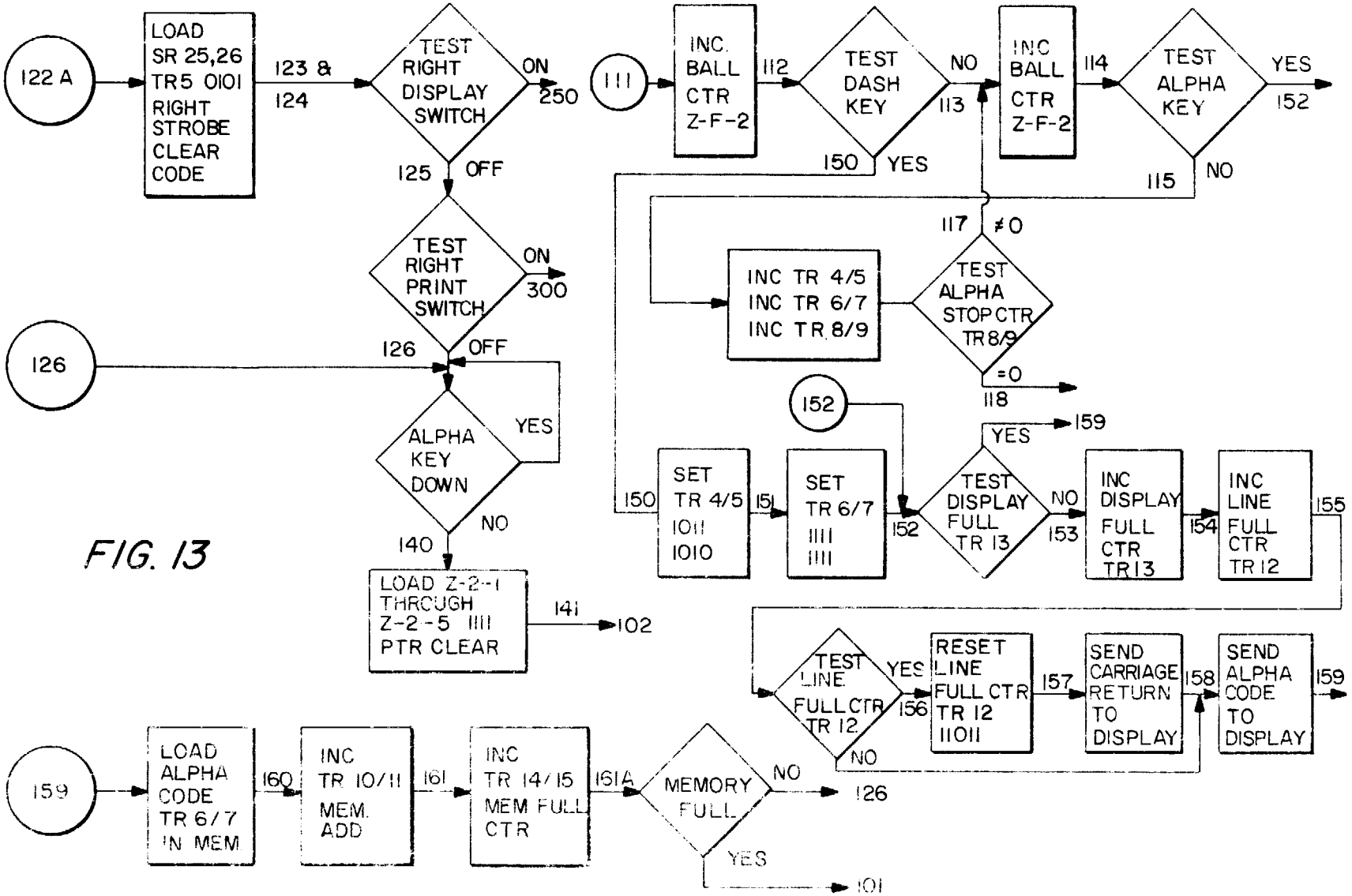
Figure 14:
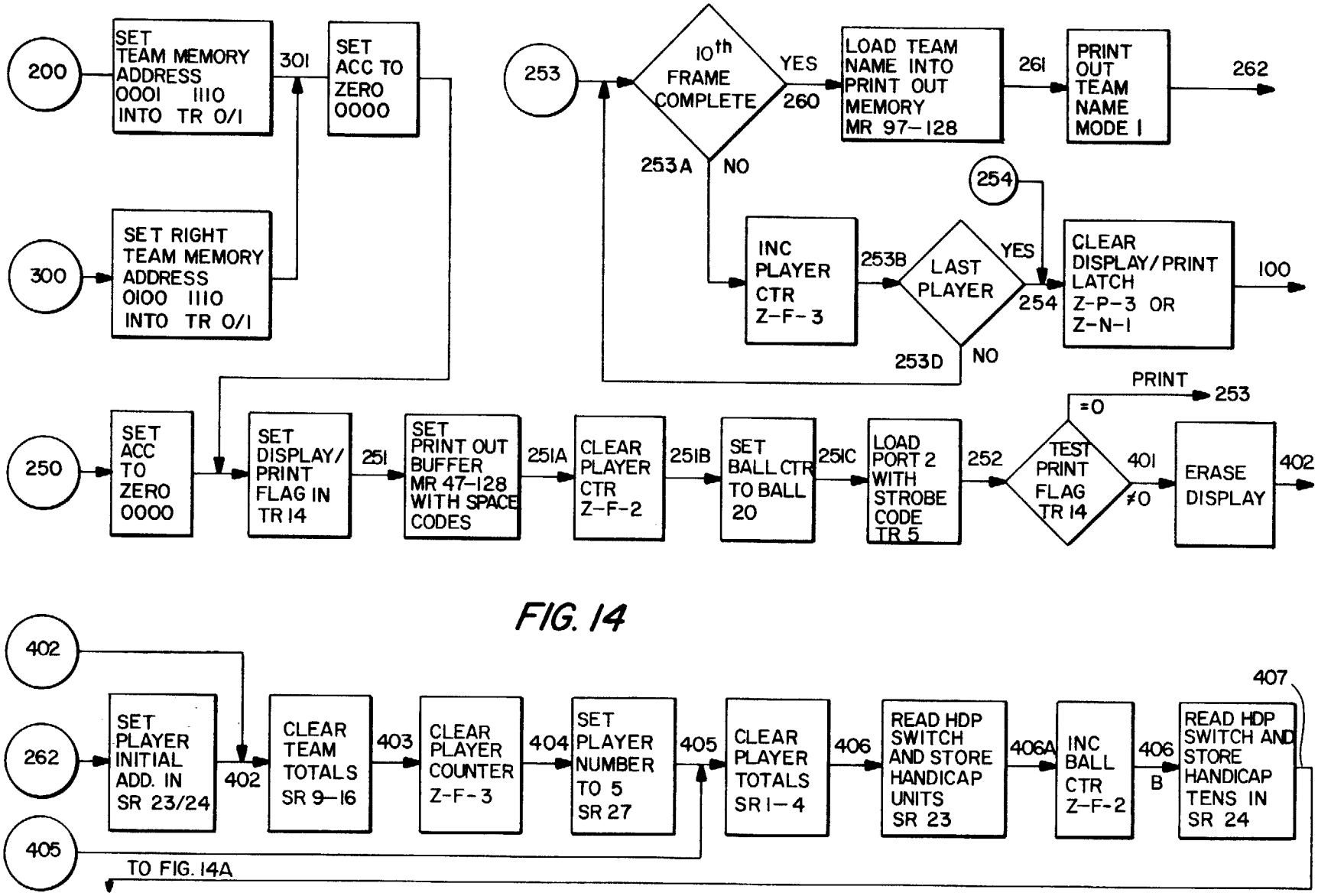
Figure 15A:
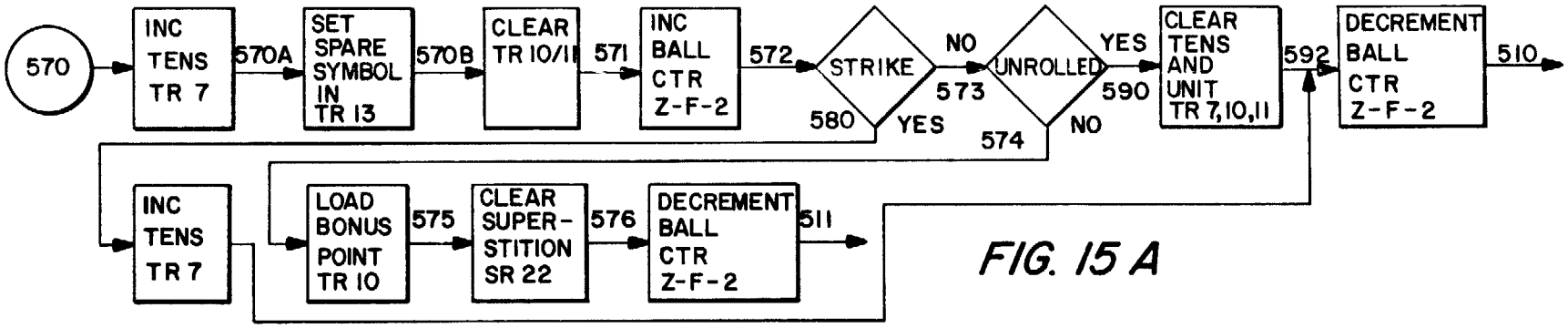
Figure 16:
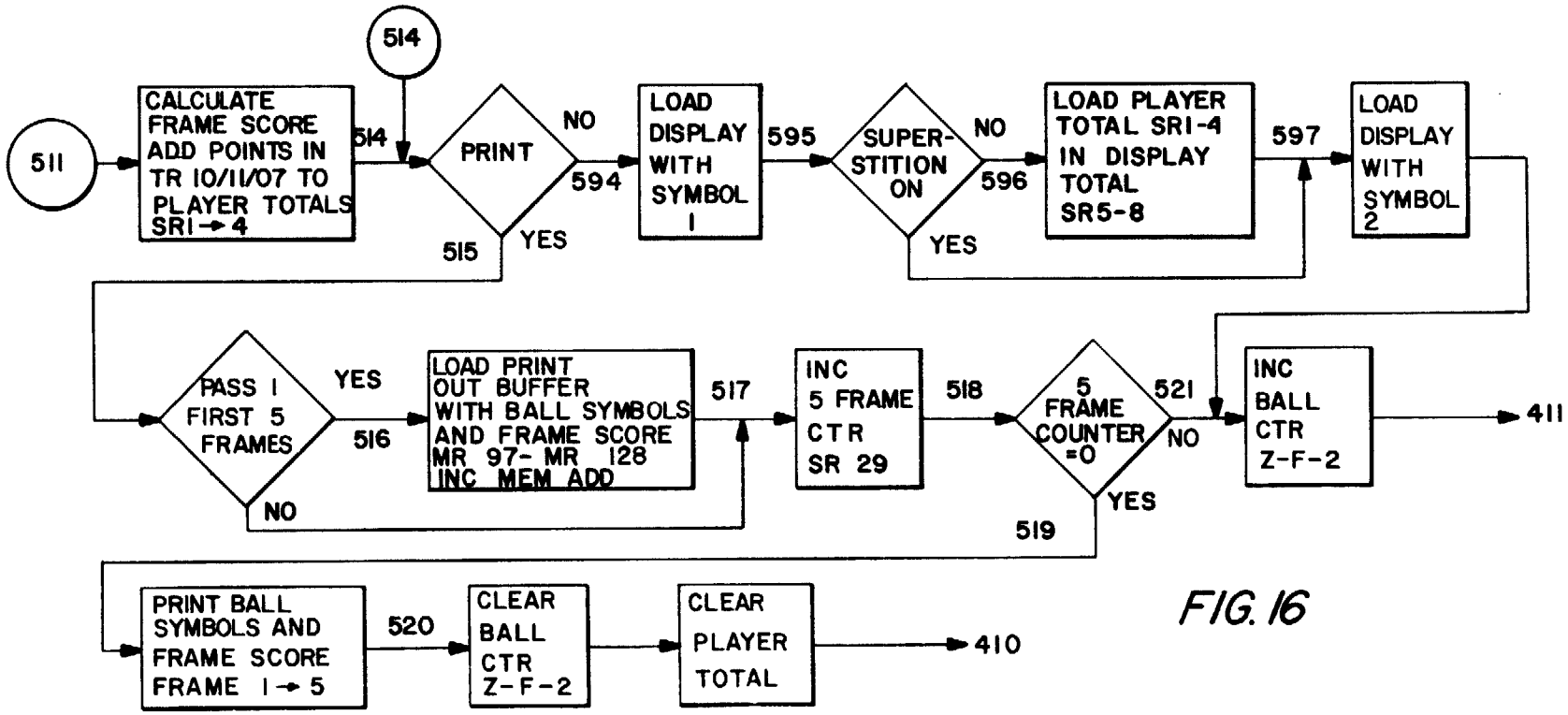
Figure 17:
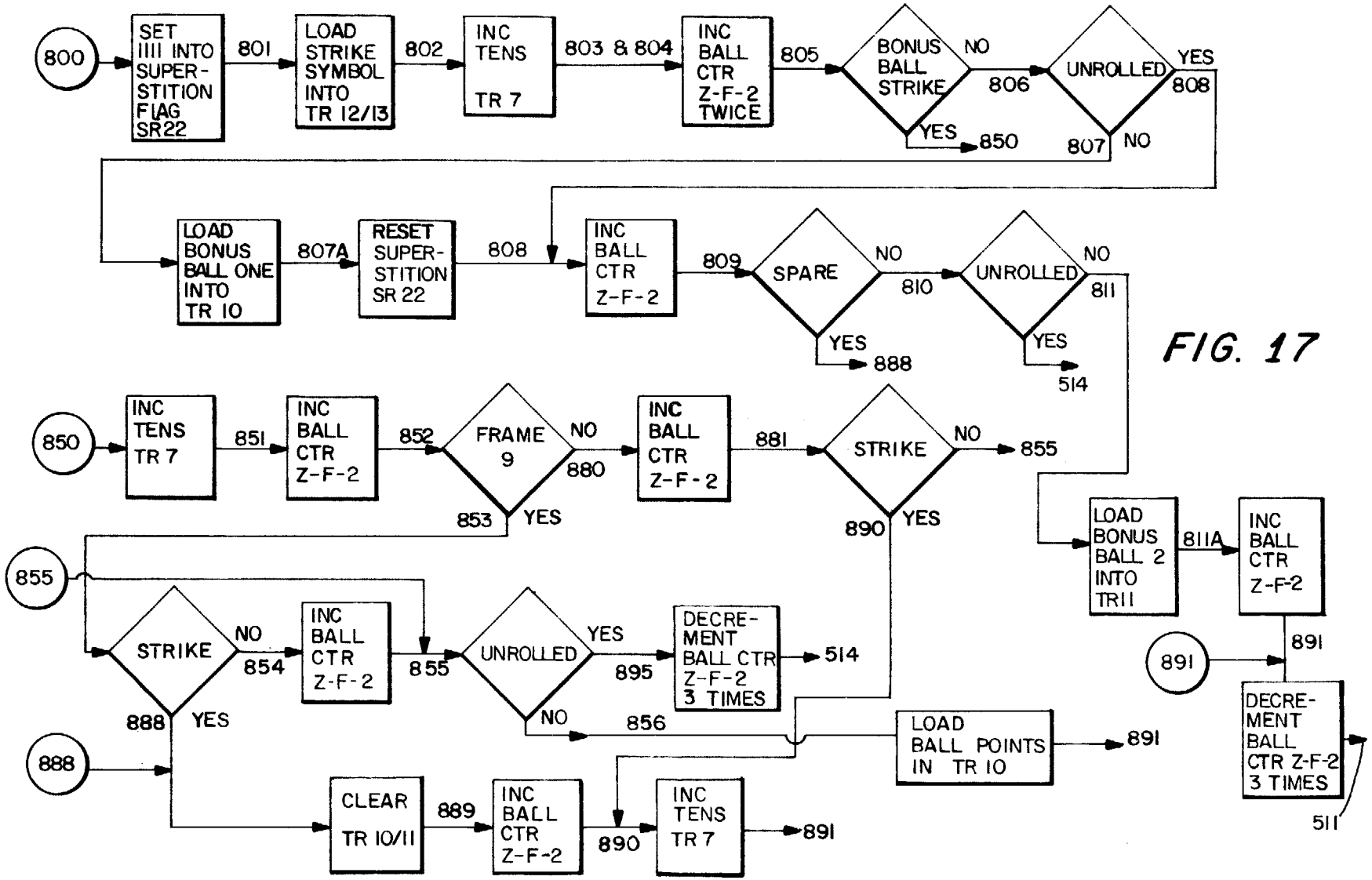
Figure 18:
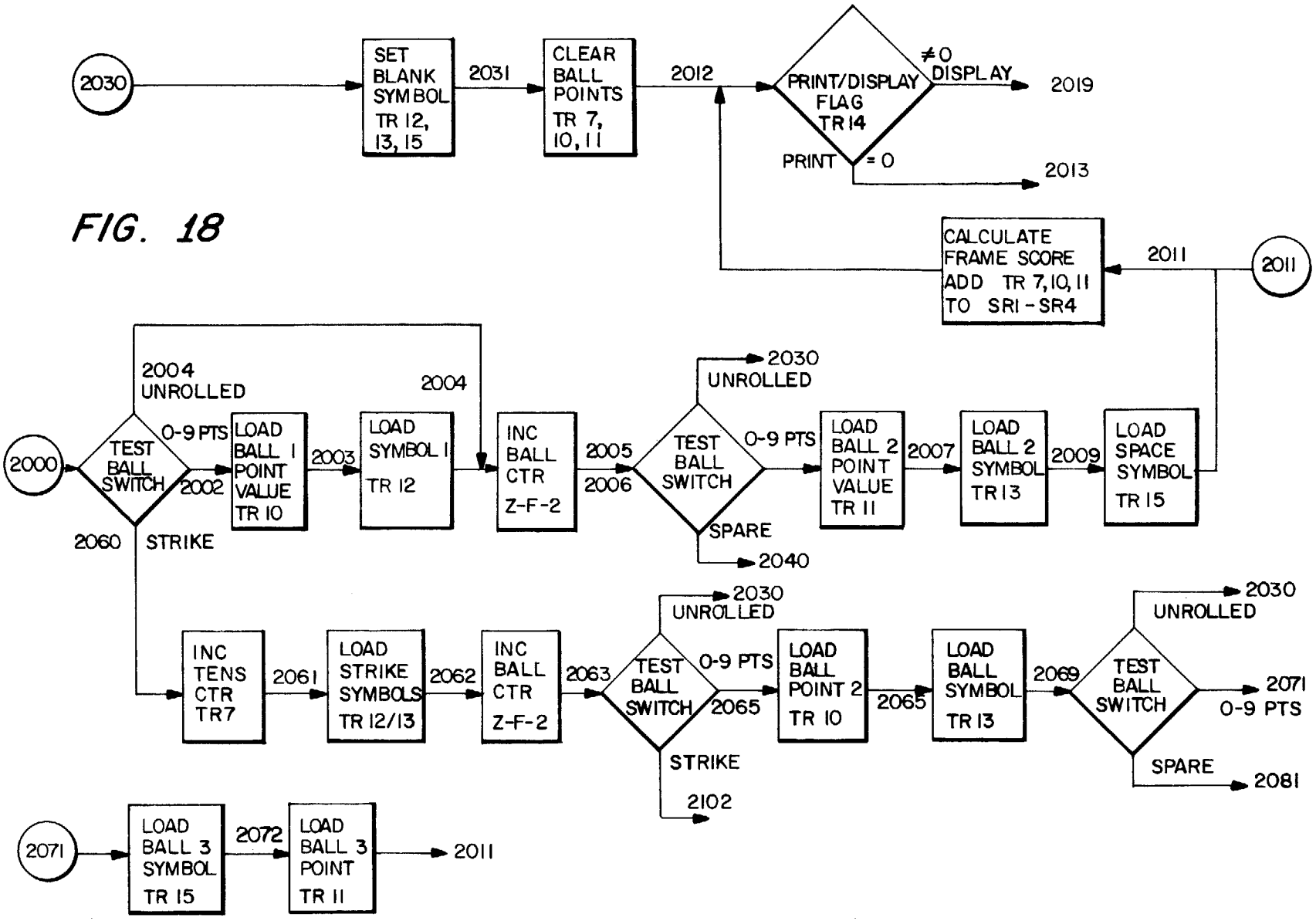
Figure 19:
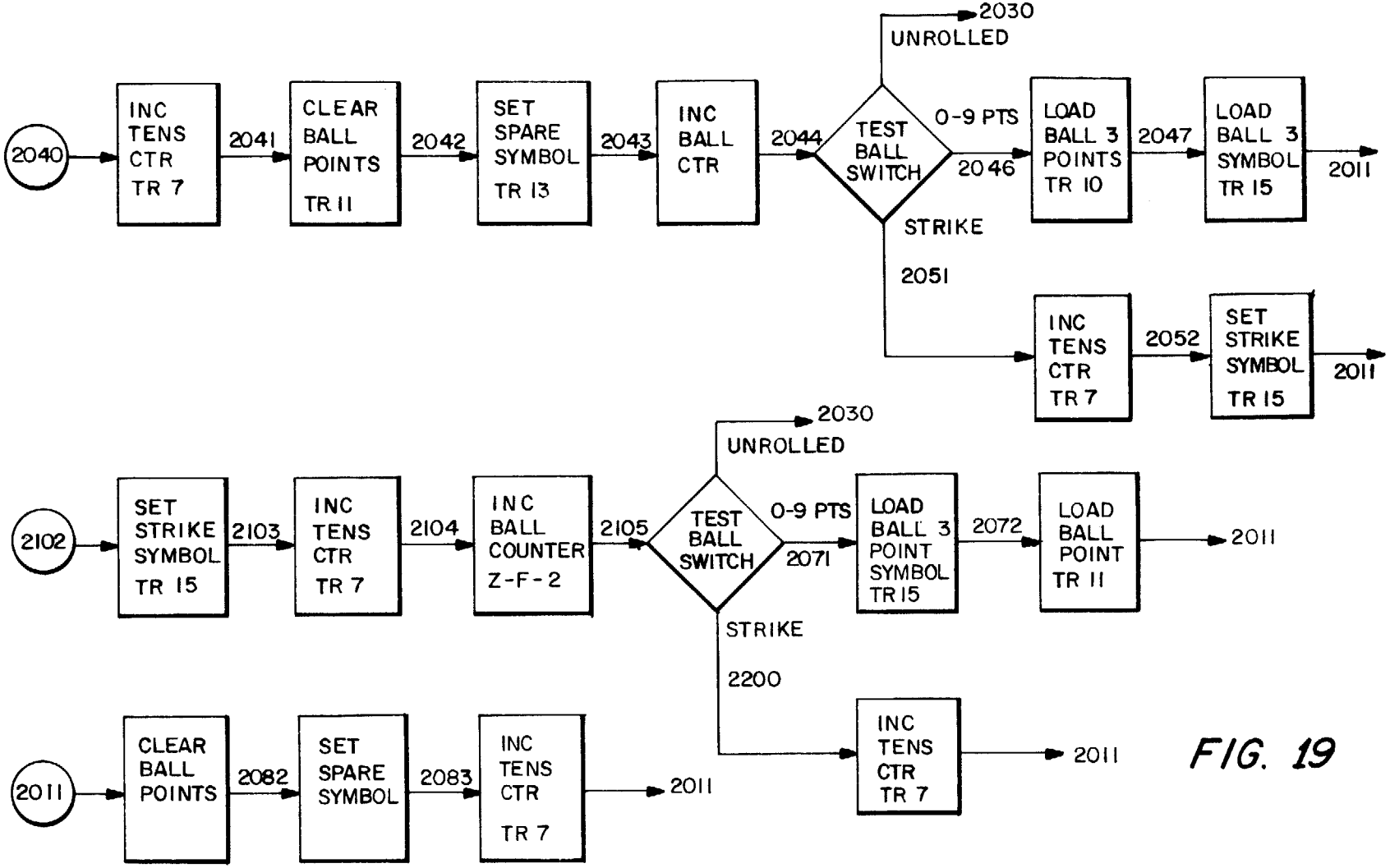
Figure 22:
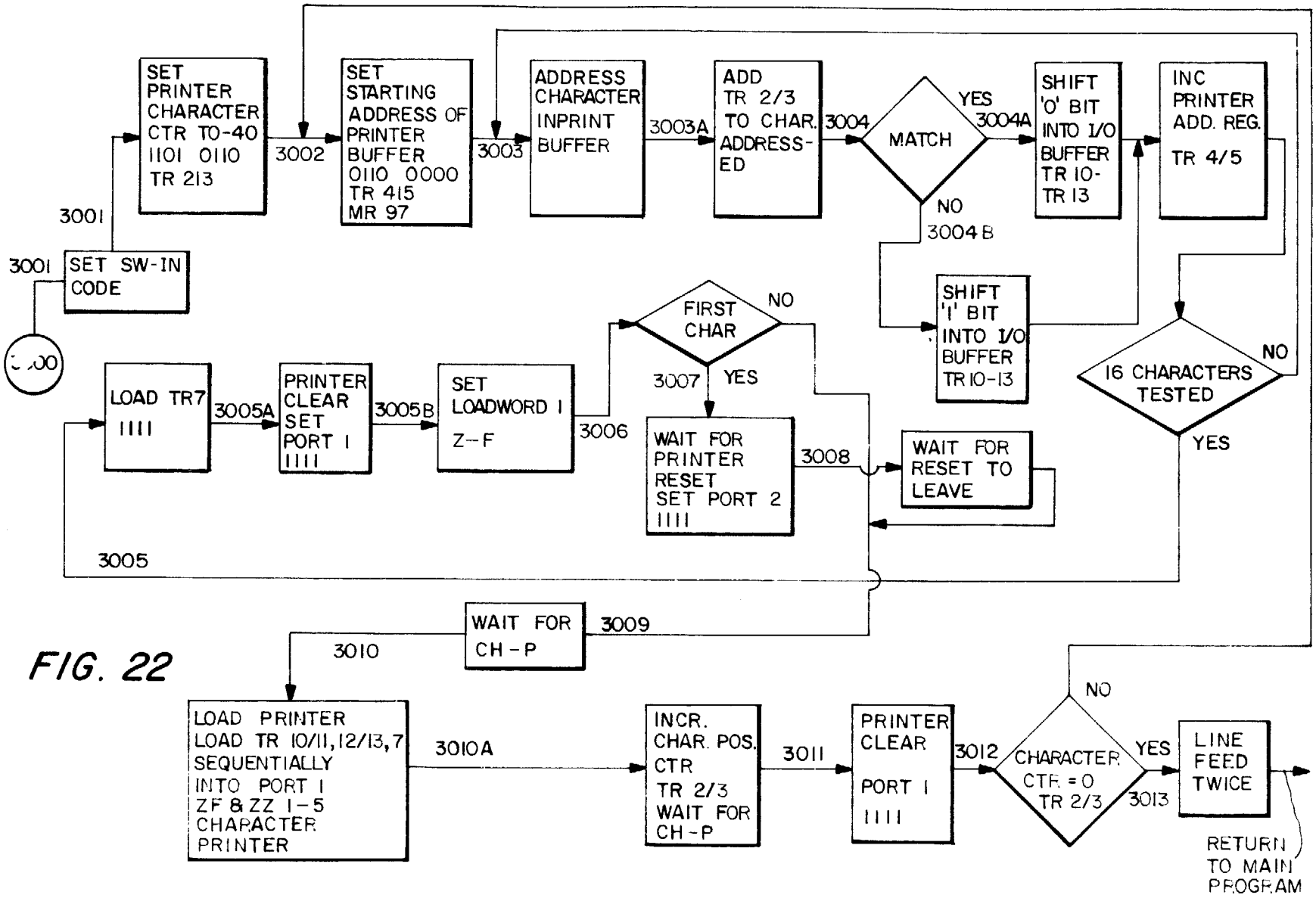
Figure 23:
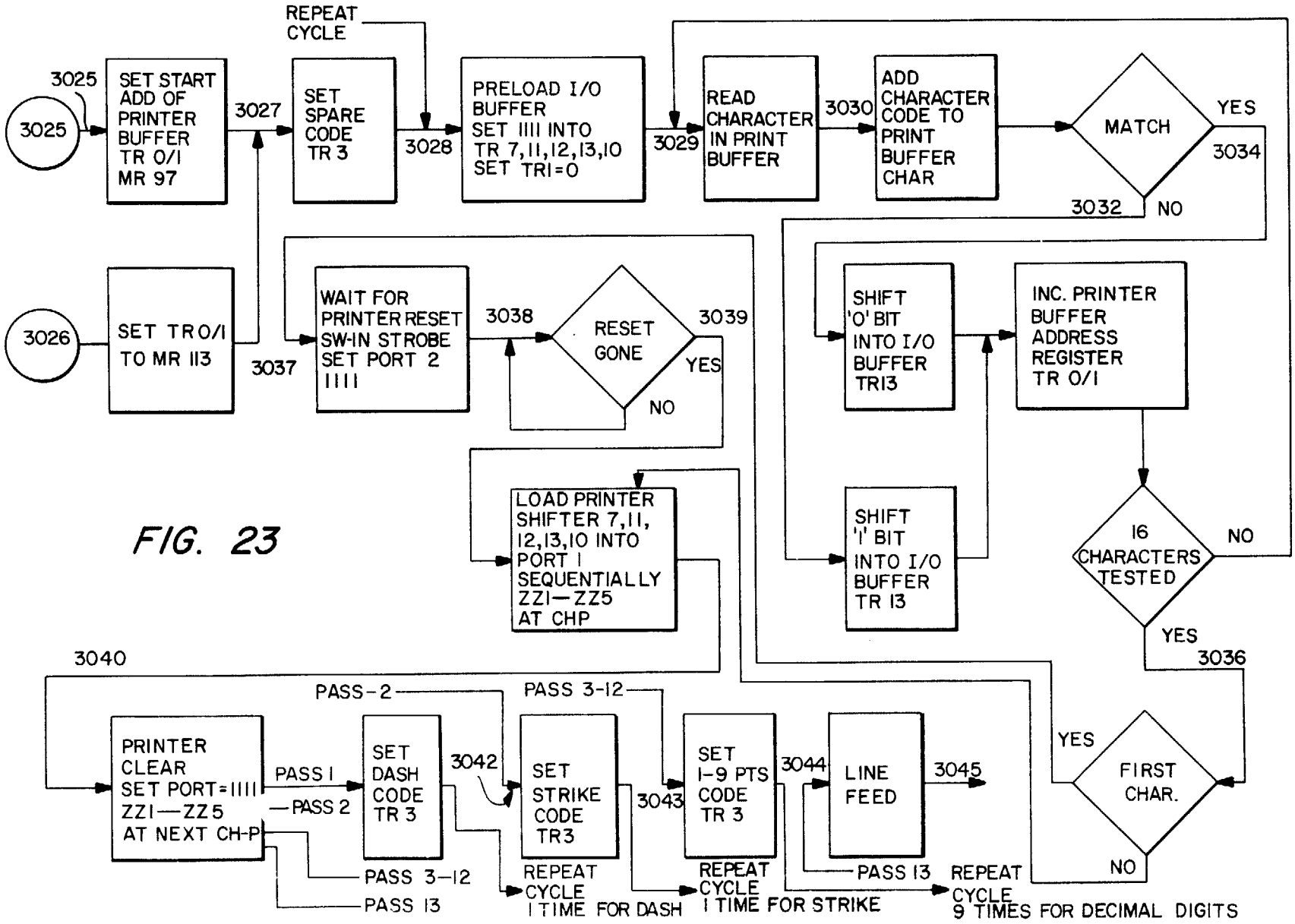

FIGS. 11 and 11A taken together comprise a simplified flow diagram of the programmed functions of the present invention;

FIG. 11B is a set of symbol definitions utilized in FIGS. 12 through 23 to show the program functions of the bowling scorer of the present invention; and FIGS. 12 through 23 comprise flow diagrams showing the specific interactions between the various numbered program instructions of the present invention.

THE BASIC BOWLING SCOREKEEPING MEANS

The scorekeeping means of the present invention basically comprises manual input means for recording ball-by-ball pinfall, strikes and spares; computing means selectively energized to calculate individual player and team scores from information present in said manual input means, means for displaying ball and mark information and a running frame score total for each player as well as a running team score total all updated substantially concurrently with the selective energization of the computing means; and printing means selectively energizable and coordinated with the said computing means to printout a post game history of the player and team games from the information present in said manual input means; wherein for each and every selective energization of the computing means the entire game history up to the point of the last completed frame for each and every player is completely recomputed, thereby providing automatic corrections of scoring errors once such errors have been corrected at said manual input means.

While the preferred embodiment of this invention utilizes manual input means, it is also contemplated that the input means can be set automatically by pin sensing and counting means associated with automatic pin spotter equipment rather than set manually.

THE DISPLAY FORMAT OF THE SCOREKEEPING MEANS

Figure 1:
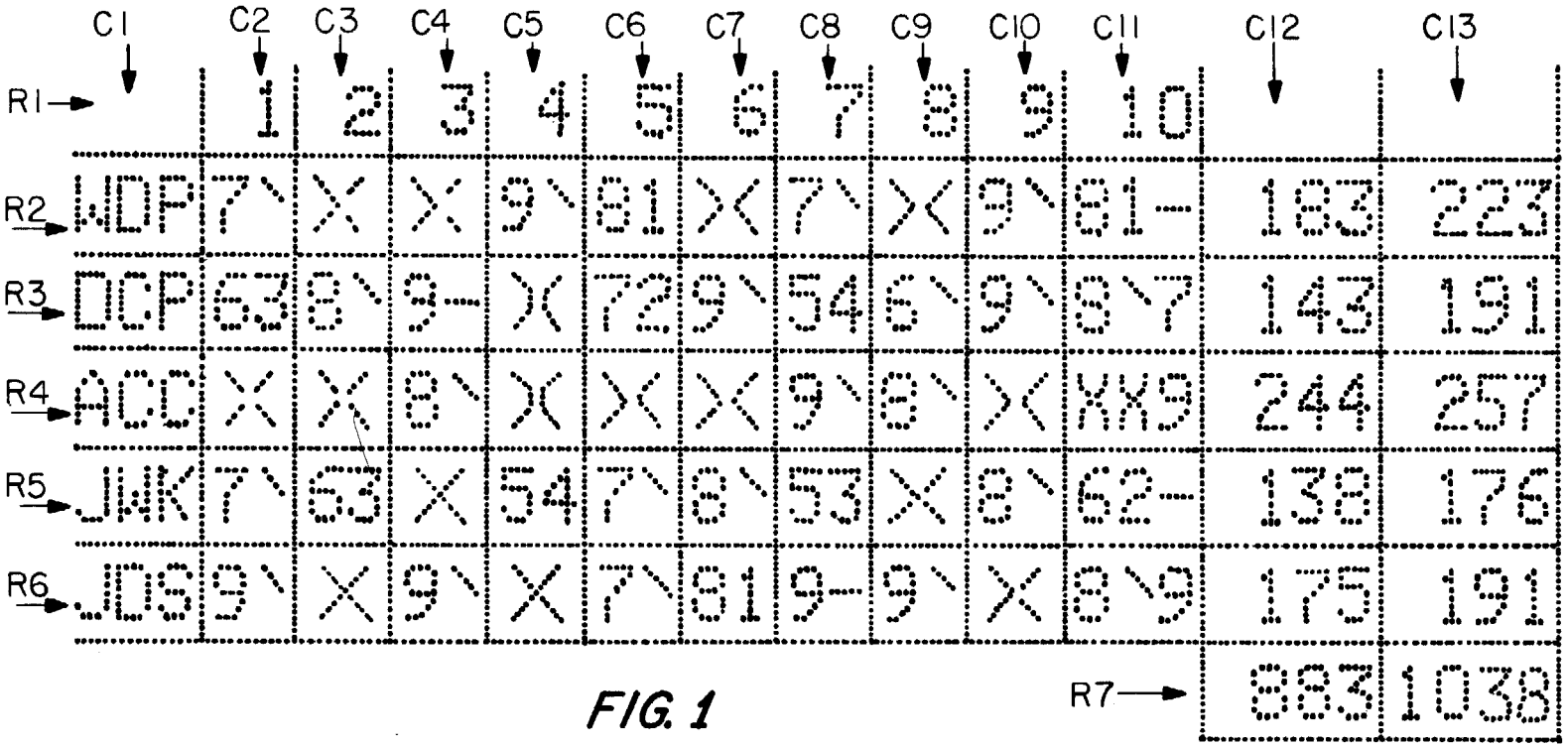
FIG. 1 is a representation of the face of the display means of the present invention with a complete bowling game of a team of bowlers displayed thereon.
Figure 1A:
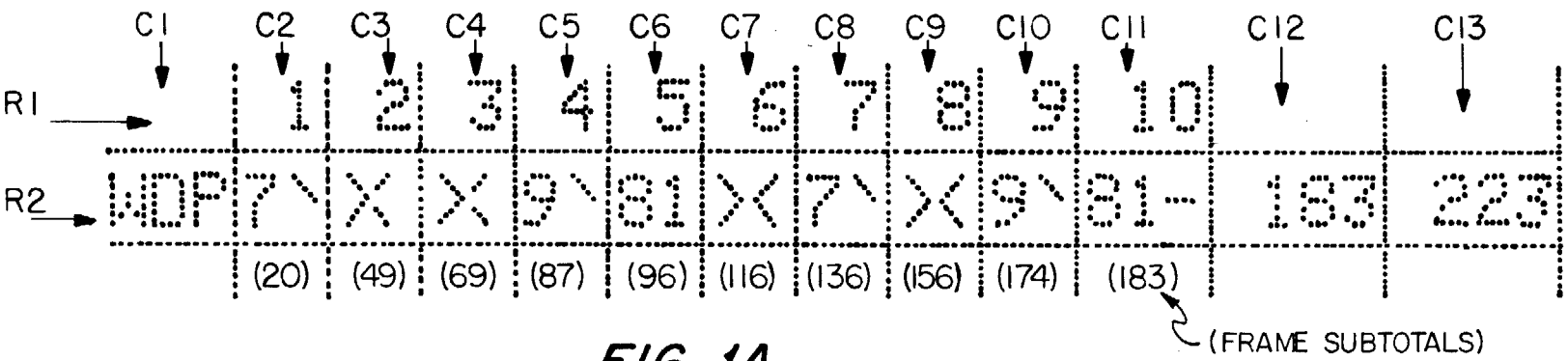
FIG. 1A is a view of the first player's game of FIG. 1 with frame subtotals superimposed thereon to illustrate the relationship to conventional calculation of the score of a bowling game.

(FIGS. 1 and 1A)

In order to comprehensively described the bowling score computing means of the present invention, the ultimate results regarding the display of scoring information will now be described prior to a detailed description of the means to achieve this end.

Referring first to FIG. 1 of the drawings, which shows a bowling display format for an entire bowling team consisting of five bowlers, the display format is shown as consisting of six horizontal rows R1-R6 of 13 columns C1-C13 each plus one horizontal row R7 of 2 columns each, the latter 2 columns C12 and C13 in row R7 comprising spaces in which to indicate the grand total for the bowling team without and with handicap, respectively.

In the top row of the display format, the second C2 through the eleventh C11 of the vertical columns comprise frames 1 through 10 of a conventional bowling game, the 12th column C12 comprises individual player total and team total, without handicap, and the 13th or right-hand column C13 comprises the individual player totals and team totals with the handicap included. The far left column C1 is for bowler identification and the second, third, fourth, fifth and sixth rows R2-R6 include the initials in the first column C1 of the five bowlers comprising the team.

If we consider the score illustrated for the first player WDP on the team whose initials appear at the first column C1 in the second row R2, and proceed from left to right to achieve the game total of that player, the following will be observed:

In row R2, column C2 (frame 1) a first ball score of 7 and a spare has been rolled by the first player WDP. At this point in time there will be no score indication in either of total columns C12 or C13 at row R2. However, as soon as the first ball is rolled in frame 2, namely, column C3, row R2, which consists of a strike as indicated by the symbol at that row and column, a score of 20 will be entered at column C12, Row R2 and a score of 60 will be entered at column C13, row R2, the reason being that the handicap for the player WDP is 40 pins and is reflected in the handicap score of 60.

The fourth ball rolled by the player WDP will occur or be displayed at column C4, row R2, and is shown as being another strike. At this time, because of the superstition constraint built into the bowling score computing means of the present invention there will be no change in the score at column C12, row R2, or column C13, row R2, pending the rolling of another ball and the occurrence of a compute command to the scoring apparatus of the invention.

The fifth ball rolled by the player WDP results in a pinfall of 9 pins and is indicated at column C5, row R2, in the left-hand side of frame 4 therein. The sixth ball is then shown as being a spare. At the completion of this frame or immediately subsequent to the rolling of the fifth ball which resulted in a 9 count, the scoring for the second frame at column C3, row R2 is completed and if the score computing means of the present invention has been actuated a score of 49 will appear at column C12, row R2 and a score of 89 will appear at column C13, row R2. In this situation, it should be realized that the superstition constraint was lifted the moment the string of consecutive strikes commencing at column C3, row R2 had been terminated by the rolling of the fifth ball in column C5, row R2, which resulted in a 9 count as opposed to another strike.

The occurrence of the spare on the sixth ball as shown in column C5, row R2 also results in a completion of the fourth frame scoring including the first and second ball bonus points for the strike registered at column C4, row R2 (frame 3) and as a result, if subsequent to the rolling of the sixth ball spare at column C5, row R2 the computing means is actuated, a new score of 69 will appear at column C12, row R2, and a score of 109 will appear in column C13, row R2, thereby updating the latter two columns up through the completion of the third scoring frame for the player WDP.

The fifth frame for the player WDP which occurs in column C6, row R2, is a flat frame, namely, a first ball of eight and a second ball of one resulting in a nine count for the fifth frame and a bonus count of eight to be added to the fourth frame score to complete that frame. Accordingly, if the compute cycle is initiated after the eight count in column C6, row R2 then the score at column C12, row R2 will be updated to read 87 and the score in column C13, row R2 will be updated to read 127. If, on the other hand, the compute cycle is not initiated until after the one count in the fifth frame, then at the energization of the computing cycle, the score at column C12, row R2 will read 96 and the score in column C13, row R2 will read 136.

With the foregoing scoring process set forth, the score will continue to be registered and computed as previously described up through the tenth frame in column C11, row R2, which comprises another flat frame indicated by a first ball pinfall of 8 and a second ball pinfall of 1 with a blank space being included to the right thereof to indicate that there was no third or bonus ball for the tenth frame of the player WDP.

By referring now to FIG. 1A which comprises a chart of the pinfall information for the player WDP together with a second row of cumulative frame scores illustrating the progress of the game through the entire ten frames of the player, it will be seen that the final score for the player without handicap is indicated in column C13, row R2 as 183, and with handicap (40 pins) in column C13, row R2 as 223.

Assumin that all of the players have bowled the games as shown, the team total will appear in column C12, row R7 as 883 without handicap, and with handicap as 1,038 in column C13, row R7.

Accordingly, the subtotals parenthetically shown in FIG. 1A are the individual frame subtotals for column C2 through C11 at row R2 of the display format. As will hereafter be more fully described, the parenthetical frame subtotals are regenerated by a recalculation cycle after the entire game has been completed for the purpose of generating a print-out in which the information shown in FIG. 1A is shown for each individual player as a complete printed post game history of that player's game.

At this point it should be noted that because of the superstition factor and other consistent strings of marks, all of the frame subtotals are not necessarily displayed in any given game in column C12 for each player total, but rather, are updated at random by energization of the compute cycle of the present invention as well as by a determination within the device itself as to whether or not a given frame has been completed, i.e., whether or not the score for that frame includes first and second ball counts, any marks, and all appropriate bonus points associated with such marks as in conventional scoring of bowling frames.

Figure 1B:
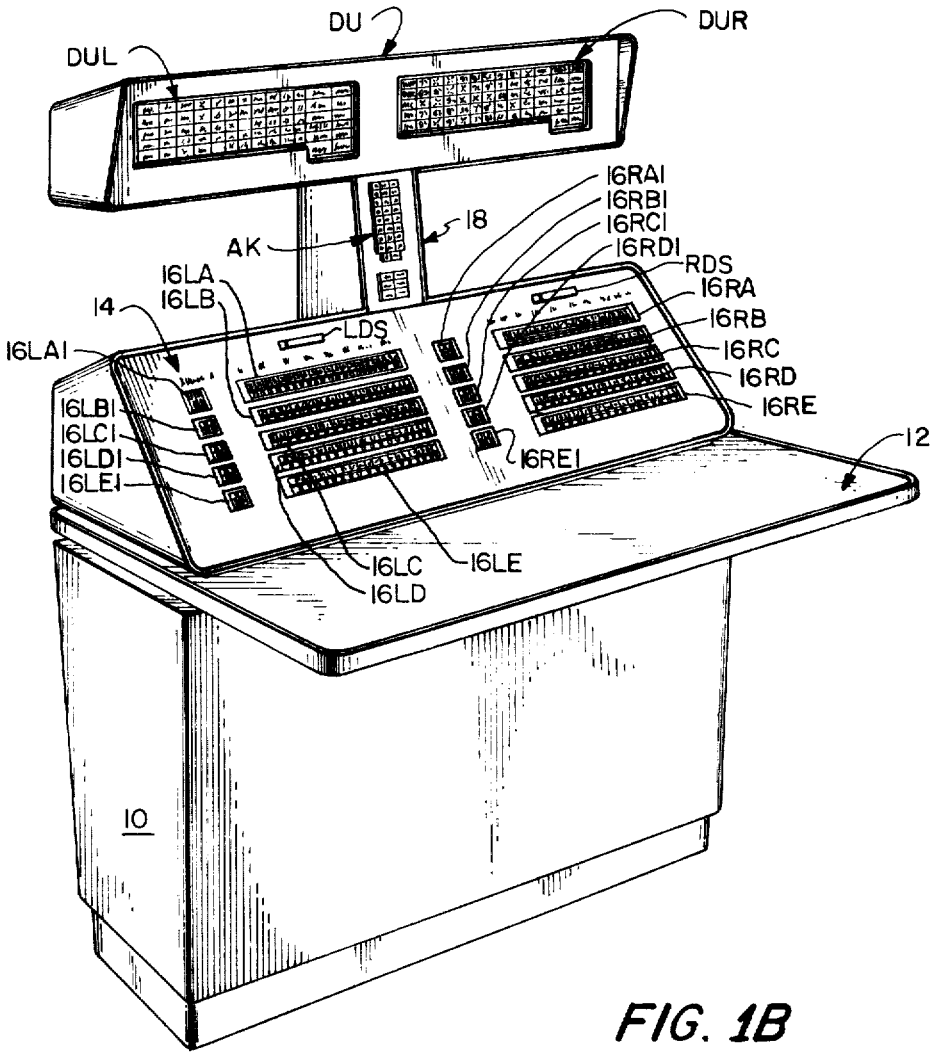
FIG. 1B is a perspective of a physical embodiment of the invention.

A physical embodiment of the invention is shown in FIG. 1B as comprising an upright console having a cabinet portion 10; an overhanging or cantilevered table area 12 above the cabinet 10; a control board 14 rising upward at an angle from the back of the table 12 having ten switch banks 16LA through 16LE and 16RA through 16RE symmetrically positioned thereon in two groups of 5 each; compute-display buttons LDS and RDS for the left and right switch groups respectively; upright stanchion 18 at the top rear center of the control board 14 and including intermediate its ends at alpha input keyboard AK; and a left/right display unit DU comprising left and right team display modules DUL and DUR, respectively, mounted at the top end of the said vertical stanchion 18.

Figure 1F:
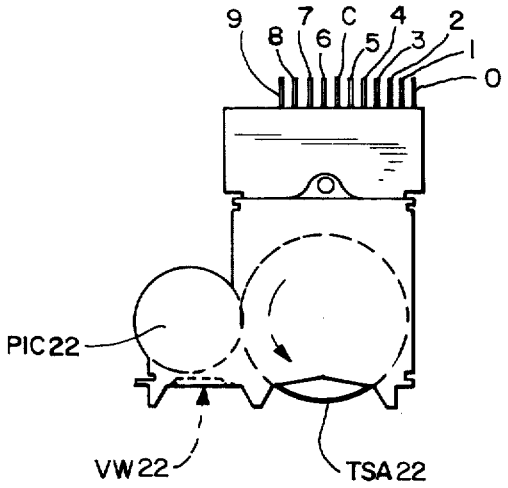
FIG. 1F is a side elevation of a typical handicap switch in the bank of FIG. 1E.
Figure 1C:
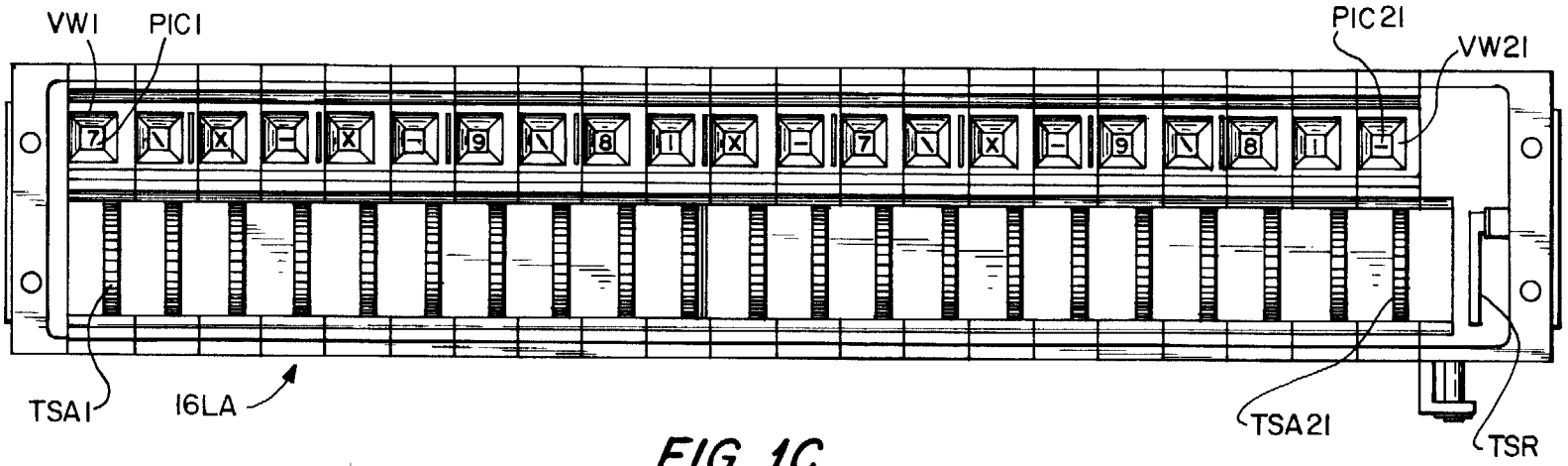
FIG. 1C is a top pllan view of the details of a ball point switch bank for a single bowler.
Figure 1E:
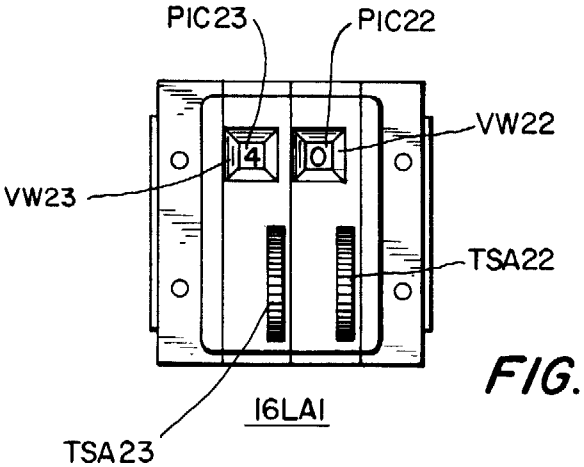
FIG. 1E is a top plan view of a handicap switch bank for a single bowler.
Figure 1D:
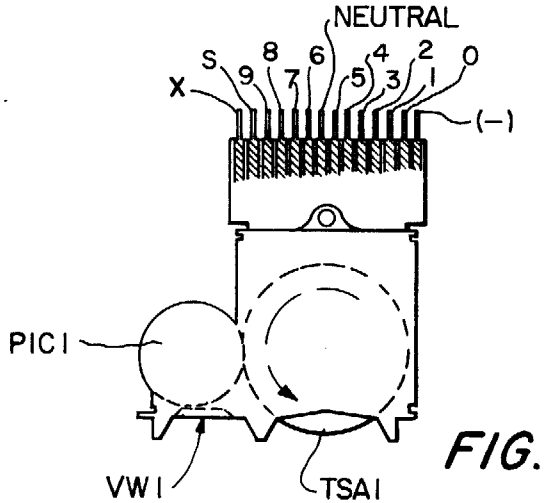
FIG. 1D is a side elevation of a typical ball point switch in the bank of FIG. 1C.

The first left hand switch bank LA for the first player on the left hand team of bowlers (e.g., WDP of FIGS. 1 and 1A) is shown in enlarged detail in FIGS. 1C and 1D as comprising 21 thumbwheel switch actuators TSA1 . . . TSA21, which respectively position 21 switch position indicator cylinders P1C1 . . . P1C21, the latter having a plurality of position characters therein with a single discrete position character being visible at any given time through viewing windows VW1 . . . VW21 associated, respectively, with the said indicator cylinders P1C1 . . . P1C21.

The complete ball-by-ball history of the player WDP is shown in the viewing windows VW1 . . . VW21 fully correlated to the displayed bowling game of FIG. 1 and FIG. 1A.

Referring now to FIGS. 1E and 1F, the handicap switches 16LA1 (for the player WDP) for reading in the handicap of that player to the scoring computer of the invention are shown as comprising a bank of two tumbwheel actuators TSA22 and TSA23, which respectively position two (2) switch position indicator cylinders PIC22 and PIC23, the latter each having position characters 0 through 9 thereon visible through associated viewing windows VW22 and VW23, respectively, to thereby show a player's handicap.

As shown in FIG. 1B, there are ten sets of handicap switches 16LA1 through 16LE1 and 16RA1 through 16RE1 providing one set of handicap switches for each player on the left (16LA-E) and right (16RA-E) teams.

A detailed description of the interconnection of the ball point and handicap switch banks will be hereinafter more fully described with reference to FIGS. 3 and 3A.

The physical embodiments of the ball point and handicap switches 16LA-E, 16LA1-E1, 16RA-E and 16RA1-E1, are further illustrated in FIGS. 1D, 1E and 1F, showing side views together with output terminal configurations for the ball point and handicap switches.

These switches have the thumbwheel switch actuators TSA in a gear drive configuration with the position indicator cylinders PIC.

The output terminals or pins of the ball point switches comprise a common pin together with pins for a blank (−) and the characters 0, 1, 2, 3, 4, 5, 6, 7, 8, 9, X and /, representing unrolled balls through various ball scores to strike and spare, respectively.

The odd numbered switches, i.e., position indicators PIC1, 3, 5, 7, 9, 11, 13, 15, 17, 19 are adopted to be positioned for the blank (−) through strike (X) condition while the even numbered switches are adopted to be positioned for the blank (−) through spare (/) condition.

The last two switches in the tenth frame, however, i.e. position indicators PIC20 and PIC21, are positionable for both strike (X) and spare (/) conditions to properly effect scoring in the tenth frame of a bowling game in the conventional scoring method.

As shown in FIG. 1C, a recessed gang reset lever TSR is provided such that at the end of a bowling game or at any other desired time, all of the switches TSA1 - TSA21 in a given player's switch bank can be reset to the unrolled ball position, i.e., ready for recording the ball points, etc., for the next game to be bowled.

In the handicap switches 16LA1-E1 and 16RA1-E1, the terminals provided for the units and tens portions of the handicap correspond to of a common terminal (C) and the digits 0 through 9. These digits are imprinted or otherwise placed on the position indicator cylinders PIC22 and PIC23 of each set (pair) of handicap switches.

THE GENERAL SYSTEM OF THE PRESENT INVENTION

The present system comprises a dual system for two teams with each team assigned five banks of lever switches. Each player in the team is assigned a row or bank of 21 lever switches. Each such switch is assigned to a particular ball in a particular frame for a particular player. As each ball is rolled the corresponding lever switch would be rotated to indicate the proper ball points obtained for that ball.

The reason for the 21 switches being assigned to each player is that there is a possibility of 21 balls being rolled in any given game.

In the scoring format previously described herein the score would not be automatically updated each time a lever switch is positioned, but rather, the scoring for a team would be executed when the corresponding team calculation button or other suitable energizing switch is closed to initiate a compute cycle. This compute cycle executes a program in a suitable calculating device which will calculate the scores for all five players and display the ball points, the marks, the scores for each player and the team totals up to the point of the last completed frame for any given player. The exception to this particular scoring and team totaling format exists in the event that a string of strikes is being rolled by any given player in which event the superstition factor is taken into account and that player's cumulative scores are not posted individually until the string strikes is broken, subject to the last completed frame constraint described above.

Each time the display and compute switch is actuated, the calculating device of the present invention will scan all of the ball switches which have been previously set with ball data and then the calculating device will calculate the current score of each and every player and the team up to the point of the last completed frame of any given player.

Also, for each such actuation of the display and compute switch, the calculating device will be cleared of all previously calculated information and will begin recalculation at the first ball of the first frame for each player on the team.

Previous history of the game and scores for the players and the teams will not be held in the calculating device between execution of the programs other than the information which is held on the visual display portion of the device and that information cannot be used for calculating purposes.

In other words, each calculation is independent and does not depend upon any former calculation information othe than that information retained on the ball switch input panel for each and every player on the team. This information can be changed manually and the manual changes will be taken care of as automatic corrections during a recalculation cycle upon actuation of the display or compute switch.

Referring in detail to FIG. 2 of the drawings, the main controls for the bowling scorer of the present invention are shown as including a central processing unit ZA, a first read-only memory ZB, second, third, fourth, fifth, sixth and seventh read-only memories ZC, ZC2, ZC3, ZC4, ZC5 and ZC6, a first random access memory ZD, a command delay module ZE, a command decoder module ZF, and a second random access memory ZG. All of these modules and memory circuit units are interconnected by common two-way data lines, D0, D1, D2, and D3. These circuit modules generate the control functions for scanning the player input switches which are schematically shown at LHS and RHS signifying left-hand team and right-hand team input switches, respectively. Furthermore, the circuit modules ZA through ZG direct the flow of data amongst the various modules during a calculation of the bowling score.

The read-only memories ZC1--ZC6 store the program sequence of the calculation, displaying, and printing cycles of the bowling scorer of the present invention. The central processing unit ZA is the calculating and control unit for the four read-only memories ZB and ZC — Z6 and also controls the two random access memories ZD and ZG.

The first random access memory ZD provides temporary storage of data used for immediate calculation in the central processing unit ZA.

Aside from its programming function, the first read-only memory ZB is connected to the output of the ball point encoder circuits ZT1-4 and ZT5-8 which derive the data from the input switches LHS and RHS by a group of data lines DA1, DA2, DA4 an DA8. Through these data lines DA1-2-4-8 and the first read-only memory ZB, the ball value or pinfall information is transmitted into the central processing unit ZA for calculation.

The first and second random access memories ZD and ZG provide output signals used as control functions in the scoring system of the present invention. These random access memories ZD and ZG are used also to store the initials of various players on the bowling teams being scored for print-out purposes at the completion of the game as well as team names and data for immediate calculation in the central processing unit ZA.

As previously referred to, the data lines D0, D1, D2 and D3 are bi-directional and interconnect the main control units ZA through ZE and ZG to transfer instruction information, data informatiion, and instructions for control and display through these data lines. Suitable synchronization and timing lines are also provided between these main control modules but they are not shown in FIG. 2 and will be more fully described hereinafter with respect to other figures of the drawing.

As previously described, a group or blank of left hand switches, LHS, is provided for one team hereinafter designated the left-hand team of bowlers and likewise, a bank of switches RHS, is provided for the other team hereinafter described as the right-hand team of bowlers. A common input switch strobing circuit for selectively scanning the various banks of switches is provided by a ball counter ZF2 and a player counter ZF3 which have their outputs both set into an input switch selector ZY having a first output directed to the left-hand team switches LHS and other output directed to the right-hand team switches RHS. The input switch selector ZY selectively drives the switches of each player to generate signals at the input of right-hand and left-hand ball point encoders ZT1-4 and ZT5-8, respectively.

The selectively energized ball point encoders are both connected through a left-right switch selector ZH which routes the various encoded ball point data from the ball switches through the line DA1, DA2, DA4 and DA8 into the first read-only memory ZB from whence this data is directed into the central processing unit ZA for calculation of the bowling score resulting from the sequence of ball points being fed thereto as the various switches for each individual player are scanned in sequence.

The left-right selector ZH also has a select right input terminal LEFT for constraining the left-right selector ZH to select the outputs from the right-hand ball point encoder ZI1-4.

The right and left-hand ball point encoders ZT1-4 and ZT5-8, respectively, are selectively enabled for either display purposes or printing purposes as follows:

A right display switch module RDS is shown as having an enabling output RDP connected to the input of the righthand ball point encoder ZT1-4. The control or enabling output RDP also serves to couple a right print command module RP to the input of the right-hand ball point encoder ZT1-4.

The left-hand ball point encoder ZT5-8 is enabled through an enabling output LDP from a left display switch module LDS and a left print command module LP. Furthermore, a printer P is provided which has an enabling output PR for informing the right-hand ball point encoder ZT1-4 that it is ready to print and an enabling output PL for informing the left-hand ball point encoder ZT5-8 that it is ready to print. Upon coincidence of enabling signals on the enabling outputs PR and RDP the right-hand ball point encoder ZT1-4 will encode the ball points and scores for the purpose of a right team printout and likewise, upon coincidence of an enabling signal on the enabling outputs PL and LDP, the left-hand ball point encoder ZT5-8 will encode ball point information for a left team print-out.

If the enabling outputs RDP and LDP are energized only by the right display switch module RDS or the left display switch module LDS, respectively, then the respective ball point encoders ZT1-4 and ZT5-8 are enabled only for score computation and display purposes.

The outputs from the ball point encoders are designated as RBE1-2-4-8 for the right-hand ball point encoders ZT1-4 and as LBE1-2-4-8 for the left-handball point encoders ZT5-8. Both of these encoder outputs are directed into the input of the left-right selector ZH. The output of the left-right selector ZH comprises the data lines DA1-2-4-8 which drive a corresponding input in all read only memories ZB, ZC1—ZC6 for the purpose of entering data into the central processing unit ZA.

An alpha keyboard AK has an output AK1 for connection to the input test of the central processing unit or main control module ZA as will be more fully described hereinafter. The alpha signals are adapted to be stored in the random access memories ZD and ZG. At the output of the first random access memory ZD are four data lines DL0, DL1, DL2 and DL3, which lead to input lines of identical designation on the printer control module ZZ for the purpose of transmitting the alpha information from the second random access memory ZG through the first random access memory ZD output lines into the printer control ZZ as will be hereinafter more fully described.

The second random access memory ZG has several control outputs including a scan SW's output constraining a scan of the player ball point switches LHS and RHS, an ALPHA INPUT control output constraining the entry of alpha input information, a switch in SW IN control output and a LEFT control output to be hereafter more fully described regarding their specific functions. The second random access memory ZG has a main control or enabling input ZG2 which is directly connected to the data lines D0, D1, D2 and D3 interconnecting the seven major control modules ZA through ZG, respectively.

The printer control module ZZ has a LOAD WORD 1-5 input, a main control input connected to the data lines D0, D1, D2 and D3 and a main control output ZZ1A to ZZSA which is connected directly to the input of a hammer driver module ZX which in turn has a control output ZX1 driving the printer module P.

The command delay module ZE has a single enabling input ZE1 whhich corresponds to the data lines D0-1-2-3 interconnecting the major control modules ZA through ZG and a single command output ZE2 which is commonly connected to respective inputs of a left-right display unit DU, a command decoder ZF and a display control module DC. The display Control module DC has a strobe display output DC1 which is directly connected to a corresponding strobe display input DU1 on the left-right display unit DU.

The left-right display unit DU thus has an input corresponding to the command delay output ZE2, a strobe display input DU1 and a main command or enabling input DU2 which is directly connected to the data lines D0-1-2-3 interconnecting the main modules ZA through ZG.

The command decoder ZF has 16 outputs numbered 0 through 15 consecutively which are listed in the following table:

Terminal 0 - no function
Terminal 1 - down ball command (DN Ball)
Terminal 2 - up ball command (UP Ball)
Terminal 3 - clear ball command (CL Ball)
Terminal 4 - up player command (UP Player)
Terminal 5 clear player command (CL Player)
Terminal 6 - load word one command (Load Word 1)
Terminal 7 - load word two command (Load Word 2)
Terminal 8 - load word three command (Load Word 3)
Terminal 9 - load word four command (Load Word 4)
Terminal 10 - load word five command (Load Word 5)
Terminal 11 - no function
Terminal 12 - LF (later described)
Terminal 13 - no function
Terminal 14 - SW RESET (Described later)
Terminal 15 - no function.

The 12th Terminal LF of the command decoder ZF is connected directly to a correspondingly labeled input terminal LF in the printer module P. It is through this terminal LF that the advance command is sent to the printer for constraining the printer to drive the printing tape during a print-out.

The ball counter ZF2 is driven by outputs 1, 2 and 3 of the command decoder ZF and has as its input like labeled terminals CL BALL, UP BALL and DN BALL corresponding to the command outputs of the command decoder ZF.

Likewise, the player counter ZF3 has like numbered or labeled input terminals to outputs 4 and 5 of the command decoder ZF, namely, CL PLAYER and UP PLAYER.

Both of these counters ZF2 and ZF3 drive the input switch selector ZY at a time concurrent with a scan switch signal which comes from the SCAN SW's command output of the second random access memory ZG into a like labeled enabling input ZYC of the input switch selector ZY. An input ZYA is connected to the output of the ball counter ZF2 and an input ZYB is connected to the output of the player counter ZF3 to complete the enabling circuitry for the input switch selector ZY.

THE PLAYER BALL POINT SCORE INPUT SWITCHES

The ball score input switches for the several players on each team will now be described with particular reference to several of the input switches associated with the left-hand team player A designated in FIGS. 3 and 4 as LA.

As previously described in connection with FIG. 2, the player counter ZF3 must count for five players to be consecutively scanned for each of the teams being scored and accordingly has three digital output terminals J, K and L associated therewith.

By the same token, the ball counter ZF2 which produces a ball count for each of 21 switches must have sufficient digital outputs to count from 0 through 20 to satisfy this 21 switch count (5 bits in binary code) and therefore has digital output terminals A, B, C, D and E associated therewith.

Reference is also made to FIGS. 5, 5A, 5B and 5C which clearly illustrates the ball count and player count circuit modules together with a schematic representation of banks of switch modules for the various players on the various teams identified by the designations ZY5 through ZY19. These switch modules ZY5 through ZY19 represent the ball scoring switches for players LA, LB, LC, LD and LE, in other words, the left-hand team to be scored. It should be noted however that a like bank of switch modules is to be utilized for the right-hand team and that all of these switches can be driven by the same switch driving circuit, generally comprised of the circuit modules ZY1, ZY2, ZY3 and ZY4 which are integrated circuit logic modules.

In this connection, the right-hand team ball score input switches are driven from the main switch selectors ZY1 through ZY4 by way of the additional input switch selector modules ZY20 through ZY34. All of these circuits were previously described in connection with FIG. 2 under the generic designation ZY.

Figure 4:
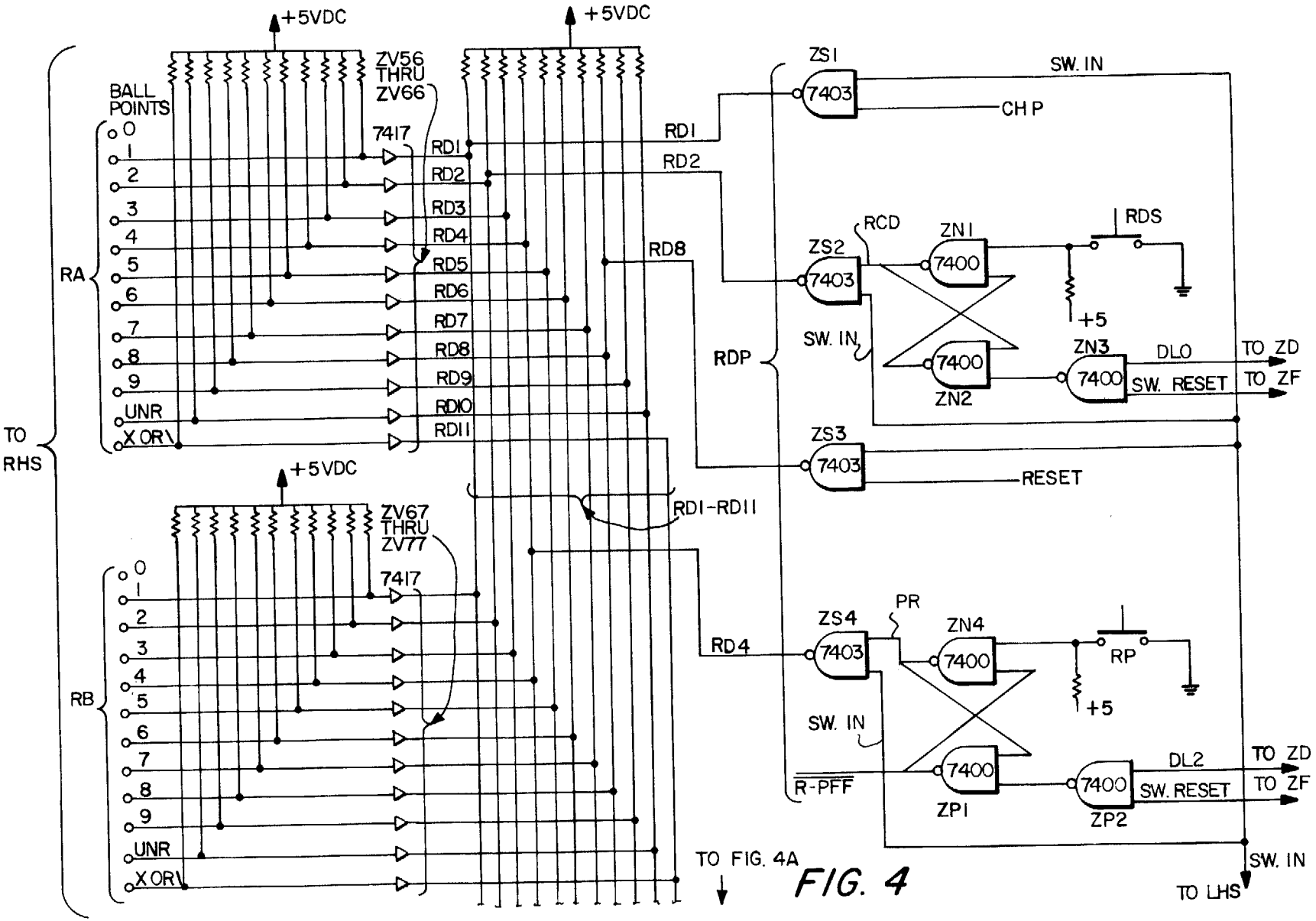

This common driving circuit, by reference to FIGS. 2 and 4, is shown to be ultimately controlled regarding which switch data is transmitted to the input data lines DA1-2-4-8 of the read only memories ZB, ZC—ZC6, by means of the constraint placed upon the transmission of ball switch data through the left-right selector ZH.

To calculate the score and display a bowling game, the control unit ZA starts by commanding the ball counter ZF2 and the player counter ZF3 to reset to 0.

This in turn causes the input switch selector network ZY1 through ZY34 to drive the wiper of the first lever switch which is assigned to the first ball of the first frame of player A on either team and thence to sequence through the entire 21 ball switches for each player and for each player in sequence until such time as the entire team score for either the left or right team has been scanned.

Each lever switch is composed of a single pole 12 position switch and 11 of the 12 output positions are connected to the ball point encoder circuit ZT which in turn feeds the encoded ball point data to the left-right selector circuit ZH.

The output contacts for the first position of all 21 switches assigned to the same player are connected in parallel and are fed to the ball point encoder ZT through a buffer driver ZV used to provide isolation between the switch banks of the respective players on a team.

Reference is now made to FIG. 3 wherein several ball point switches for player A of the left-hand team (LA) are shown in more detail.

A plurality of decimal lines LD1 through LD11 wired in parallel to a common source of bias are shown connected, respectively, to ball point terminals representing ball counts of 0, 1, 2, 3, 4, 5, 6, 7, 8, 9, unrolled, and strike or spare, respectively, the strike or spare position depending upon whether or not the switch represents a first or second ball in a frame. The ball point input terminals for both the individual ball point switches as well as certain handicap point switches are commonly identified by the designation BPI.

The first ball switch SA1 for the player LA is shown as comprising a wiper attached to a terminal conventionally known as a No. 9 terminal on a commercially available 74156 integrated circuit logic module ZY5 and is adapted to be set manually to any one of the ball point input terminals BPI depending upon the ball count achieved by the first ball rolled by the player LA.

The second ball switch SA2 for the player LA is attached to the same integrated circuit ZY5 in the ball switch selector circuit at the conventionally commercially designated terminal No. 10 and is also adapted to be selectively positioned with respect to a set of ball point input terminals BPI associated specifically with the wiper of the switch SA2.

The difference in the two sets of the ball point input terminals BPI for the switches SA1 and SA2 is simply that the 11th decimal line LD11 of the left hand team ball switch bank is that in the first ball switch (and all odd numbered ball switches) the 11th decimal line LD11 corresponds to a strike and in the even numbered switches for the player LA, the 11th decimal line LD11 corresponds to a spare.

Furthermore, with regard to the handicap input switches SA22 and SA23 for the player LA and like handicap switches for each of the other players on the two teams, there is no 11th decimal line involved and those switches are comprised of 10 terminal or decade type switches representing tens and units such that, selectively, the wipers of these switches (for example, the wiper of switch SA23 extends from a commercially designated terminal No. 5 on an integrated circuit ZY7 commercially known as a 74156 integrated circuit logic module) are adapted to be positioned anywhere from ball point inputs 0 through 9 designating decades or tens for each position. The other handicap switch SA22 is connected in a similar fashion except its ball point input positions BPI will relate to units as opposed to tens for the purpose of adding to the decade type handicap set on the switch SA23.

At this juncture, it should be understood that the program for the entire bowling score computer as set into the read only memories ZB, ZC1—ZC6, respectively, controls the interpretation of the ball point input settings to properly add tens, units, and strike and spare indications together with bonus point calculations into the ultimate score to be displayed by the device.

As illustrated in FIG. 3, going from top to bottom of the switch contacts BPI associated with the wiper of the first ball switch SA1, the first position UNR which corresponds to the decimal line LD10 provides a signal to the ball point encoder ZT to indicate to the control device ZA that the particular switch has not been moved and should be interpreted as a ball that has not been rolled. In other words, the terminal corresponding to decimal lines LD10 or RD10 are the neutral or initial positions for all of the 21 ball switches for each player.

The second position of the switch SA1 is not connected to indicate that the ball has 0 points, i.e., to take care of gutter balls, fouls, etc.

Positions 3 through 11 of the switches SA1 and SA2 are typical of the other ball point input switches, other than the handicap switches, and are wired in the same manner as the first position and are fed to the ball point encoder to indicate ball points of 1 through 9 through corresponding decimal lines LD1 through LD9, respectively. The 12th switch position is wired to the decimal line LD11 in a similar manner for all of the switches (to decimal line RD11 for the right-hand team switches) to indicate a strike or spare value for the ball rolled. This signal is routed through the logic ZR5 or ZR7, depending upon whether the strike or spre has been rolled for the right or left hand team, respectively, and thence a signal is generated from the latter to energize the central control unit ZA to indicate a TEST status for determining whether a strike or a spare has been rolled and to adjust the programming accordingly.

The wiper of each switch is brought our independently and is driven by one of the designated outputs of the input switch selector decoder devices ZY5, ZY6, ZY7, etc. through ZY34.

Each switch of a given player is scanned sequentially from the switch corresponding to the first ball of the first frame through the last ball of the 10th frame until all 21 of that player's switches have been scanned sequentially. Players are then scanned sequentially from the first player through the fifth player with each player having his entire set of ball point switches scanned in sequence.

The ball counter ZF2 sequences the input switch selector ZY (ZY1 through ZY34) by starting at 0 and counting through 20 to provide the 21 drive signals for the 21 switches in the players individual bank of switches.

The player counter ZF3 counts from a count of 0 through 4 to select the proper bank of switches for each of the five players on a team by the appearance of a binary representation of this count on the leads L, J, K from the player counter ZF3 into the first logic module ZY1 of the input switch selector ZY.

The ball counter ZF2 and the player counter ZF3 drives two identical switch selector logic networks, one for the left-hand team, namely, ZY5 through ZY19 and one for the right-hand team, namely, ZY20 through ZY34. Each team has a ball point encoder ZT. For the right-hand team this comprises the circuit logic modules ZT1 through ZT4 and for the left-hand team this comprises the logic circuit modules ZT5 through ZT8 as best shown in FIG. 4.

Referring for the moment to FIG. 4 and to the ball point inputs adjacent the player designation LA for the first player of the left hand team, these are a continuation of the connections of the ball point inputs BP1 described with reference to FIG. 3, which are typically shown as including 11 buffer drivers ZV1 through ZV11 driving each of the respective decimal lines LD1 through LD11 for generating the input functions for the left-hand team ball point encoder ZT5 through ZT8.

As can now more readily be seen, each ball point switch of each of the players on the left-hand team, namely, players LA, LB, LC, LD, and LE, have ball point inputs connected through 11 buffer drivers bearing various ZV designations (ZV1 - ZV55) all feeding the common encoder inputs or decimal code lines LD1 through LD11 in a similar pattern to that previously described in FIG. 3 for the switches SA1 and SA2 such that all of the information, from all of the ball point switches, of all of the players on the left-hand team is fed directly into the inputs of the left-hand encoder comprised of the logic modules ZT5, ZT6, ZT7 and ZT8. These logic modules, accordingly, generate the ball point output codes on outputs LBE1, LBE2, LBE4 and LBE8 for the left hand team and drive the left/right selector ZH accordingly.

Adjacent the logic circuit module ZT8 is the inverter ZR7 which directs the strike or spare state signals into one input of a NAND gate ZR6 which in turn has a $\overline{\text{TEST}}$ output connected to the $\overline{\text{TEST}}$ input of the central control module ZA, a transistorized level shifter circuit comprised of a transistor QT, capacitor CT, load resistor RT1 and bias resistors RT2 and RT3, as shown in FIG. 6B. This specific $\overline{\text{TEST}}$ input determines the existence of a strike or a spare condition for the program in the calculating loop of the bowling scorer primarily consisting of the central control unit ZA, the read only memories ZB, ZC1—ZC6 and the first and second random access memories ZB and ZG.

Figure 4A:
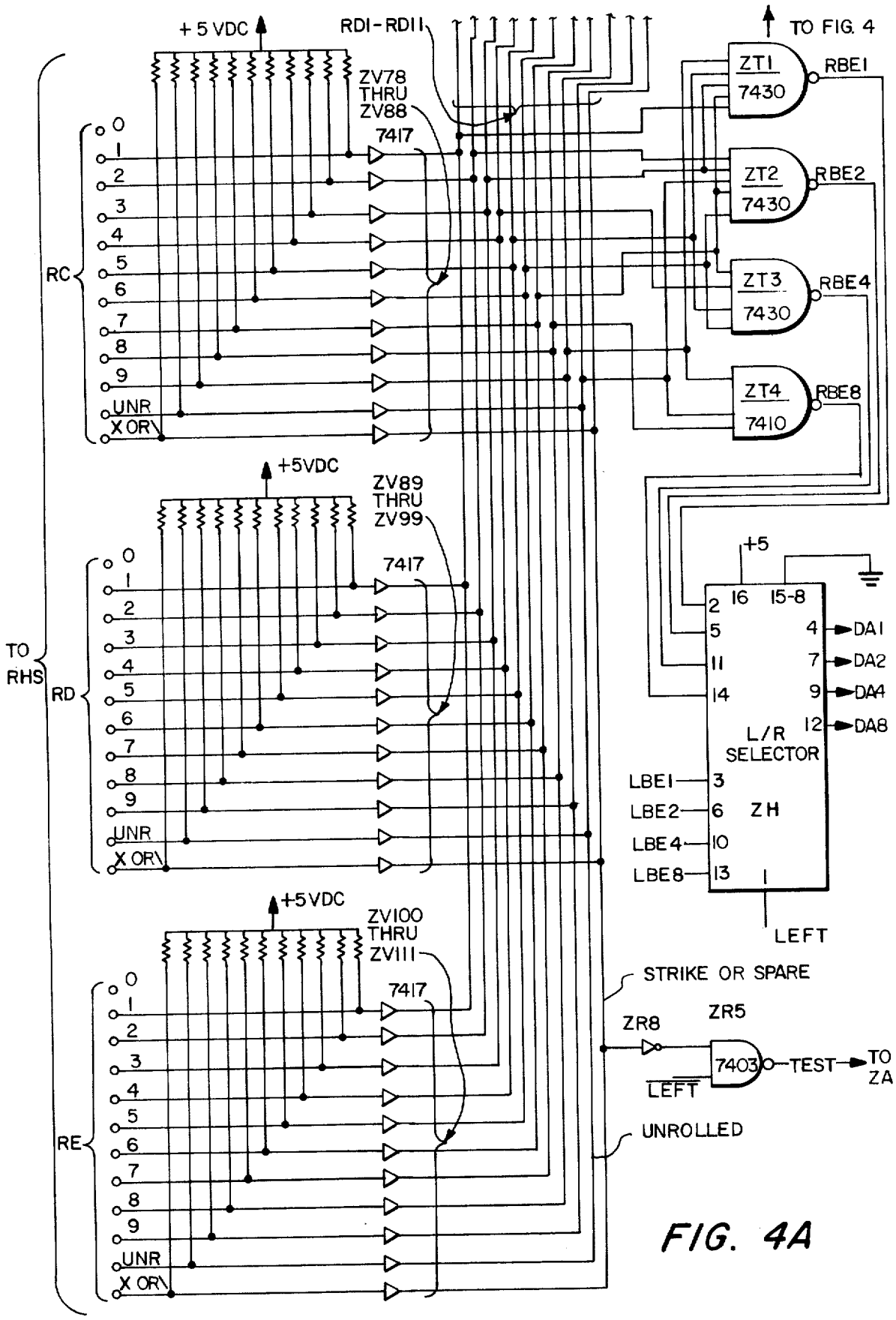
Figure 4B:
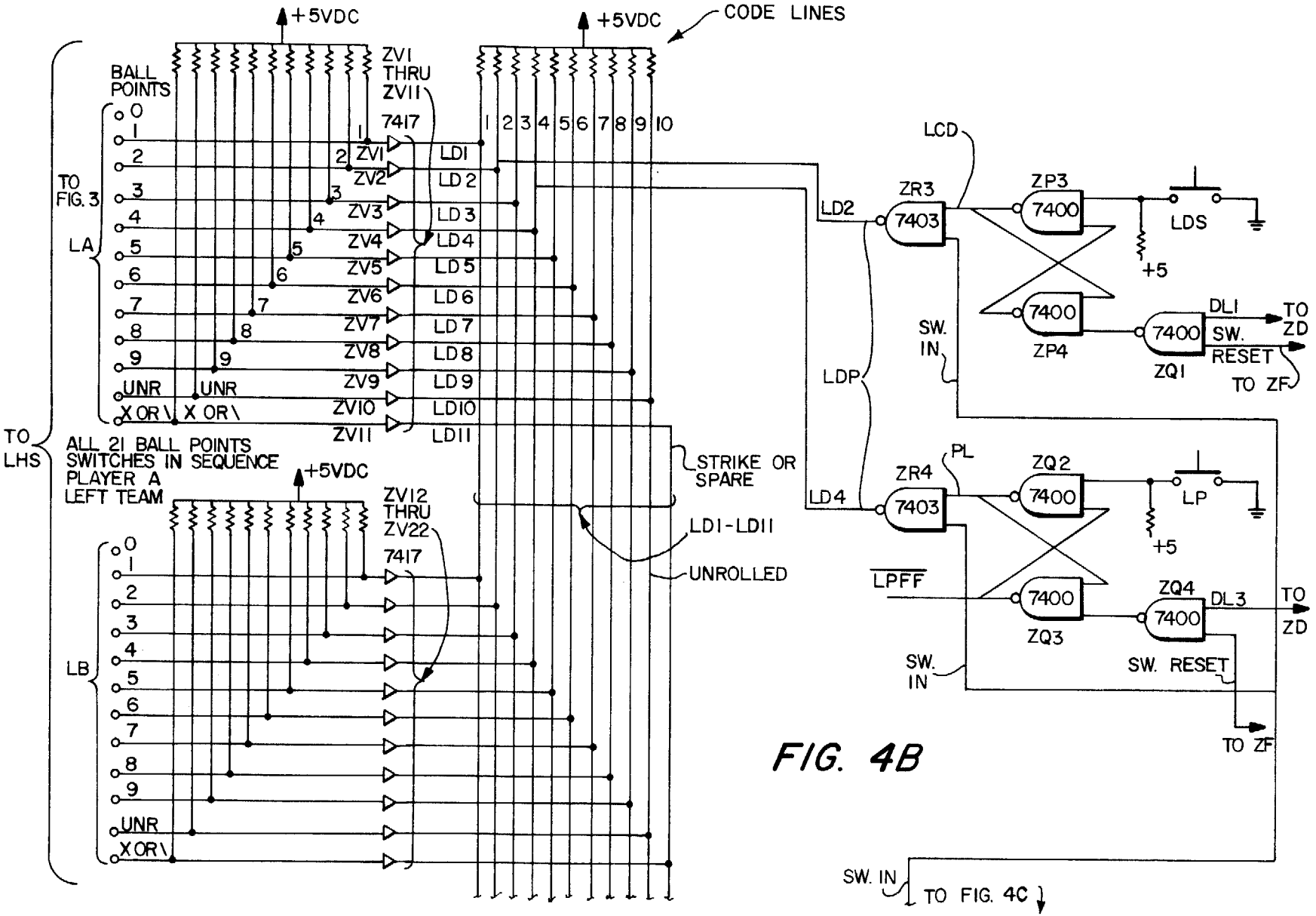
Figure 4C:
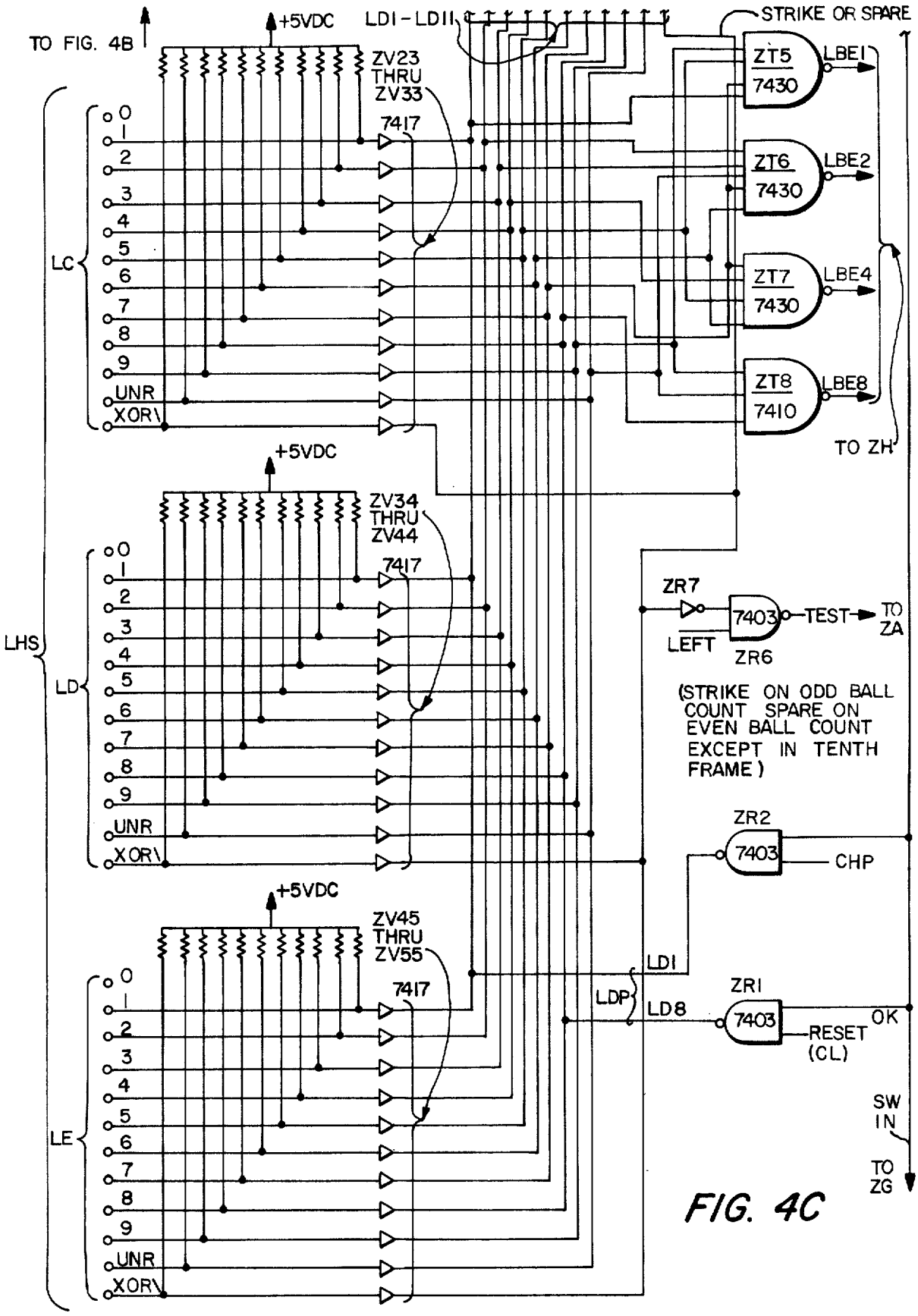

As further shown in FIGS. 4, 4A, and 4C the output leads LBE1-2-4-8 from the left ball point encoder ZT5-8 comprise the ball code inputs of like designation for the left/right selector ZH, the latter comprising a commercially available integrated circuit logic module number 74157 to which the inputs LBE1-2-4-8 are connected to the commercially standardized terminal designations 3, 6, 10 and 13 of the left/right selector ZH. As shown, the left right selector ZH is a 16 terminal commercial logic module and will be more fully defined and designated at a later point in the specification by proper reference in a table of components together with other circuit components which are commercially available.

The same interrelationships exist for the ball switches and components of the right-hand team (players RA, RB, RC, RD and RE).

For example, the right-hand team buffer drivers ZV are shown in FIGS. 4 and 4A as including buffer drivers ZV56 through ZV111; the right-hand decimal lines or ball point encoder inputs are shown as RD1 through RD11; the right-hand ball point encoder ZT comprises logic modules ZT1 through ZT4 having respective outputs RBE1, RBE2, RBE3 and RBE4 driving the left/right selector ZH; and the inverter ZR8 and NAND gate ZR5 generating a $\overline{\text{TEST}}$ signal to the central control module ZA for the strike and spare information appearing on the decimal code line DR11.

The ball point encoder modules ZT1 - ZT4 for the right hand team each comprise NAND gates having inputs connected to the right decimal code lines RD1 - RD10 as follows:

ZT1 -RD1, RD3, RD5, RD7, RD9 ZT2 - RD2, RD3, RD6, RD7, RD10 ZT3 - RD4, RD5, RD6, RD7 ZT4 - RD8, RD9, RD10.

The ball point encoder modules ZT5 - ZT8 for the left-hand team each comprise NAND gates having inputs connected to the left decimal code lines LD1 - LD10 as follows:

ZT5 -LD1, LD3, LD5, LD7, LD9 ZT6 - LD2, LD3, LD6, LD7, LD10 ZT7 - LD4, LD5, LD6, LD7 ZT8 - LD8, LD9, LD10.

THE INPUT SWITCH SELECTOR ZY

The input switch selection and scanning circuitry is best shown by reference to FIGS. 5, 5A, 5B and 5C which illustrates the interrelationships between the ball counter ZF2, player counter ZF3 and their respective outputs with the logic modules ZY1 through ZY19 of the switch selector network to effect a sequential strobing of the ball point switches of the left hand team players LA, LB, LC, LD and LE.

The integrated circuit logic modules ZY1 through ZY4 are commercially available 16-pin 74155 circuits with the pins (terminals) numbered by conventionally accepted commercial standards. Accordingly, with the circuit module identities and pin numbers as shown, one of ordinary skill in the art can readily construct the illustrated embodiment of the invention.

The logic modules ZY5 through ZY19 are conventional 16-pin commercially available 74156 integrated circuit logic modules with conventional pin (terminal) numbers.

The input and output pin connections to the logic modules ZY5, ZY6 and ZY7 for player LA are shown as typical of the connections for all ten players on the left and right hand bowling teams.

In this regard the ball point switches of each of the players are identified with the ZY logic modules as follows:

ZY1, ZY2, ZY3, ZY4; All players
ZY5, ZY6, ZY7; Player LA
ZY8—ZY10; Player LB
ZY11—ZY13; player LC
ZY14—ZY16; Player LD
ZY17—ZY19; Player LE
ZY20—ZY22; Player RA
ZY23—ZY25; Player RB
ZY26—ZY28; Player RC
ZY29—ZY31; Player RD
ZY32—ZY34; Player RE.

The input switch selector ZY1 through ZY34 is driven by the combined player counter ZF3 and ball counter ZF2 under command from the command decoder ZF via the terminals 1, 2, 3, 4 and 5 of the command decoder ZF which represent down ball commands, up ball commands, clear ball commands, up player commands, and clear player commands, respectively.

The player counter ZF3 comprises a commercially available integrated circuit logic module 7493 with the fourteen conventionally numbered terminals having the UP PLAYER command coming into the terminal No. 1 and the clear player (CL PLAYER) command coming through an inverter ZJ8 into a pair of input terminal pins Nos. 6 and 7, these terminal designations being the standard commercial designations for this type of logic module. The output of the player counter ZF3 is taken through its conventionally designated terminals Nos. 9, 8 and 11 corresponding to player count lines at J, K and L, respectively, which represent or carry the three bit binary code necessary to count consecutively for five players on each team.

The player count bit lines L, J, K are directly connected to commercially designated input terminals 1, 15 for the line L, the commercial terminal designation 13 for the line J and commercial terminal designation 3 for the line K which serve as some of the input terminals for the first input selector module ZY1 (which comprises a commercially available logic module 74155). The remaining input to the first input switch selector module ZY1 is connected with its commercially designated terminals 2 and 14 and comprises a a scan switches (SCAN SW'S) command which is emitted from the second random access memory ZG previously described in connection with FIG. 2.

As has been previously described, all of the initial logic circuit modules ZY1, ZY2, ZY3 and ZY4 comprise conventional 16 terminal 74155 logic modules which are commercially available.

The ball counter ZF2 is a commercially available 74193 logic module of at least a 14 terminal pin configuration into which the clear ball signal is applied through an inverter ZJ7 into the terminal number 14 of the module ZF2. The down ball (DN BALL) and UP BALL inputs are connected to terminals 4 and 5, respectively, of the logic module ZF2.

The outputs of the player counter ZF2 are taken from conventional terminal pins 3, 2, 6 and 7 which represent ball count bit outputs A, B, C and D, respectively. A fifth ball count bit E is taken from output terminal pins 12 and 13 on the logic module ZF2 by feeding both of these terminal pins through a cross coupled NAND gate configuration comprised of NAND gates ZM4 and ZM5 having inputs respectively connected to terminal pins 12 and 13 of the ball counter module ZF2. An additional clear ball (CL BALL) input is provided to the NAND gate ZM5 which is a direct connection from the output terminal No. 3 on the command decoder ZF as previously described in connection with FIG. 2. The output bit E is directly coupled from the output of the NAND gate ZM4 and cross coupled to one of the inputs of the NAND gate ZM5 in this configuration.

The output A from the ball point counter ZF2 is provided with two additional outputs A-prime (A') and A-double prime (A'') by connection through two buffer drivers ZK9 and ZK10 respectively. The output B of the ball counter ZF2 is provided with two additional outputs B-prime (B') and B-double prime (B'') by connection to buffer drivers ZK11 and ZK12 respectively and the output C is provided with two additional outputs C-prime (C') and C-double prime (C'') by connection through two buffer drivers ZK13 and ZK14 respectively. In all of the foregoing, the outputs of the various buffer drivers comprise the prime and double prime designated output. This configuration is required to prevent overloading of the ball counter logic module ZF2 due to the fact that the A, B, and C outputs, generically speaking, must drive three input terminals on each of the logic modules ZY5 through ZY34 in order to properly scan or strobe each and every switch of each and every player on the two teams being scored.

The output signals D and E are directly connected from the ball counter ZF2 to commercially designated input terminal pins 13 and 3 respectively, on each of the logic modules ZY2, ZY3 and ZY4 in the input switch selector circuit generically designated as ZY in FIG. 2.

The output A from the player counter ZF2 or its equivalent A-prime (A') or its equivalent A-double prime (A") is directly connected to terminal pin No. 13 of the switch scanning logic modules ZY5 through ZY34. Likewise, the output signal bit B from the player counter ZF2 or its equivalent, B' or B", is connected to the conventionally designated terminal pin 3 on the switch scanning modules ZY5 through ZY34. Likewise the output bit C or its equivalent output C' or C" are connected to commercially designated terminal pins 1 and 15 on each of the switch scanning modules ZY5 through ZY34.

Figure 5A:
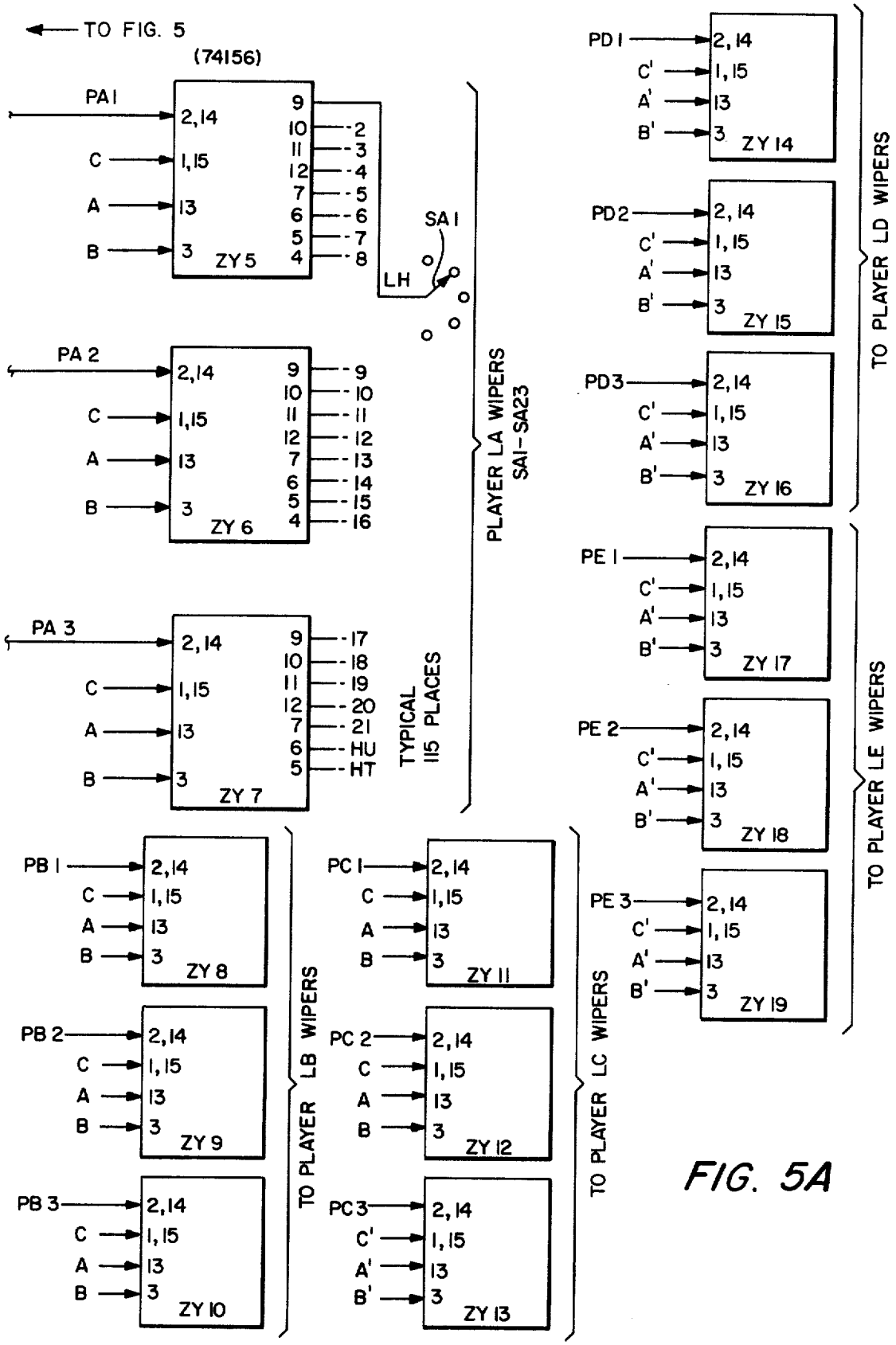
Figure 5B:
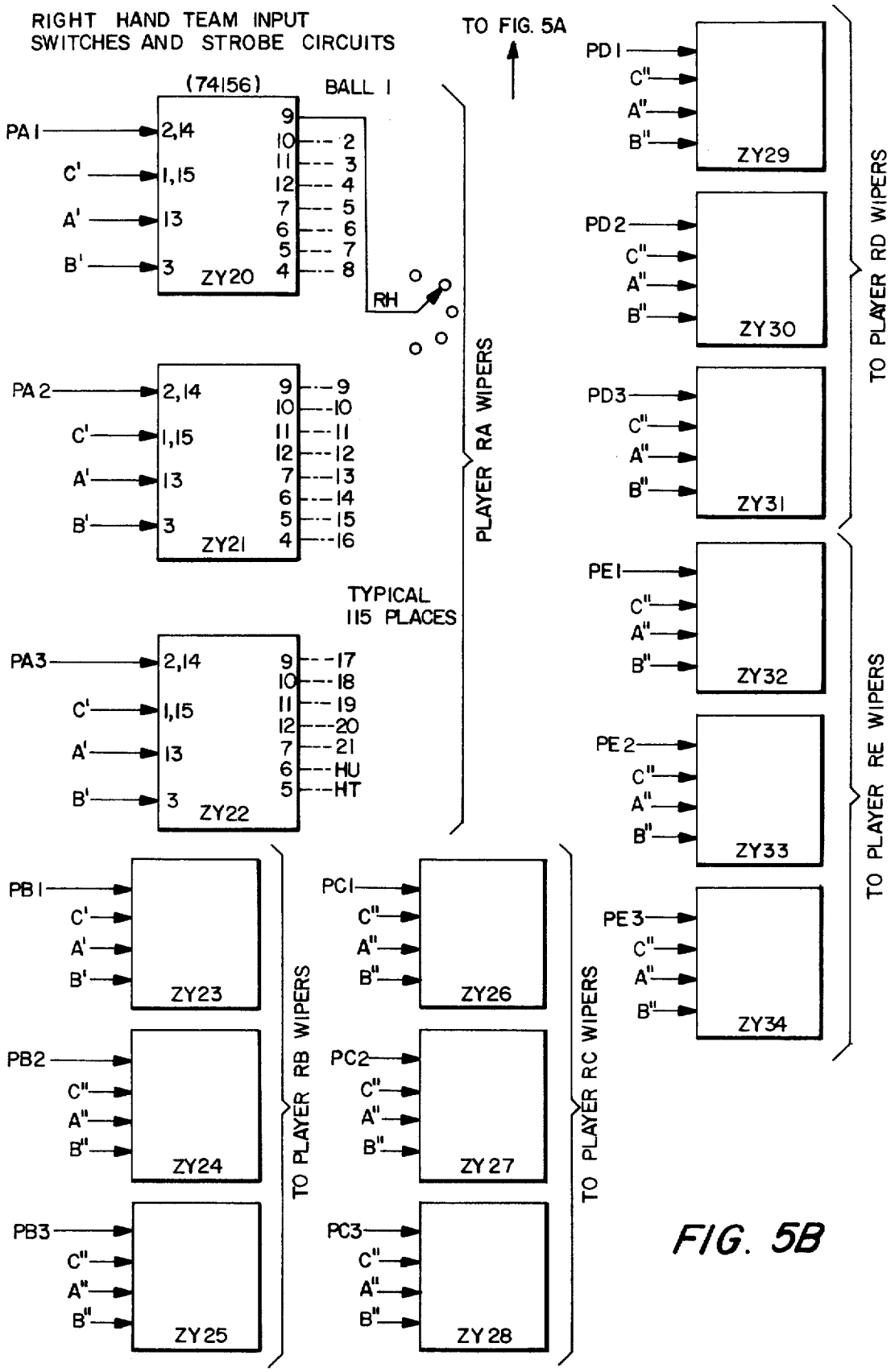

As shown in FIG. 5A, for example, from ZY5 through ZY12 it is the signal bits A, B and C which drive these logic modules and for the logic modules ZY13 through ZY19, it is the prime designations, A', B' and C' of these ball counter outputs which drive these logic modules.

As shown in FIG. 5A, each player is given three logic modules for the purpose of controlling the ultimate scanning of the individual ball switches. Player A, as previously designated in the foregoing table is accorded terminal logic modules ZY5, ZY6 and ZY7. Each of these logic modules have a dual terminal pin designation 2 and 14 to which is connected an enabling signal for energizing the logic module of that player to control the scanning of each group of switches controlled by the particular logic module.

Figure 5:
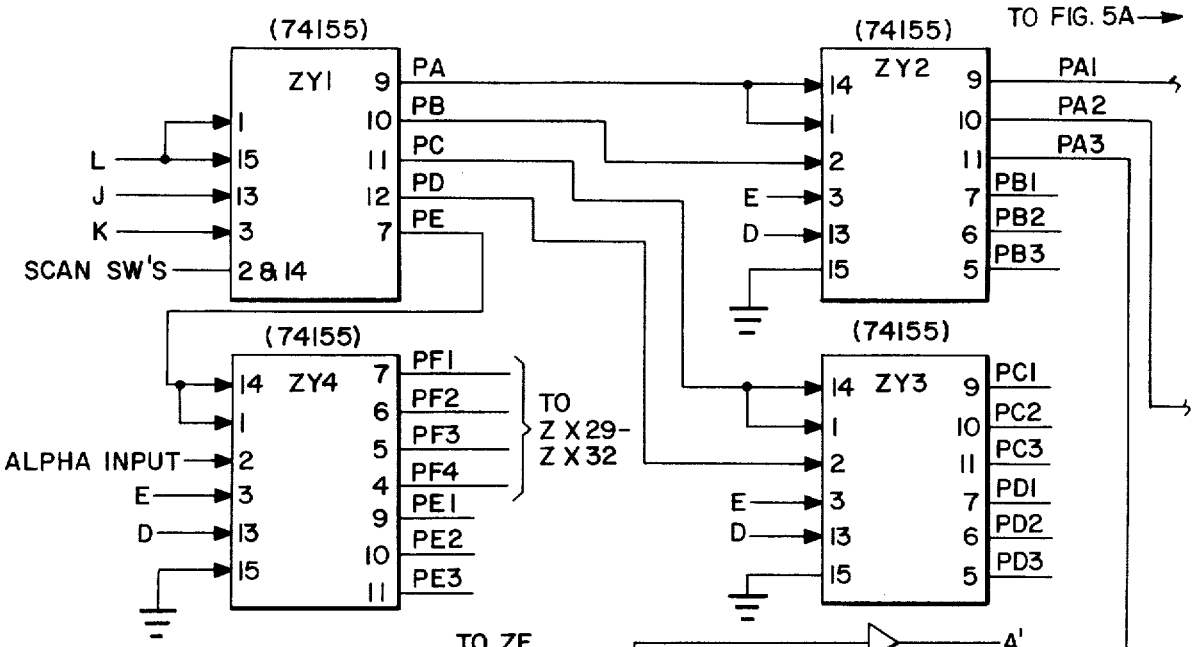

By way of further example, the logic module ZY2 of FIG. 5 which controls the enabling of the various switch scanning modules ZY5 through ZY34 in combination with the other major input logic modules ZY1 through ZY4, has three output terminal pins conventionally designated 9, 10 and 11 from which player enabling signals for the first player of the team being scanned are designated as PA1, PA2 and PA3, respectively. These signals are further respectively connected to the combination terminal pin designation 2, 14 of the switch scanning modules ZY5, ZY6 and ZY7, respectively.

This pattern is repeated for each and every player by the various outputs of the input logic modules ZY2, ZY3 and ZY4 of the input switch selector circuit generically designated as ZY.

Specifically, output terminal pins 7, 6 and 5 on the second input module ZY2 correspond to the second players enabling signals PB1, PB2 and PB3, respectively, which are connected to the terminal pair combination 2,14 of the switch scanning modules ZY8, ZY9 and ZY10, respectively.

The third player on a team being scanned for the computation of a score is accorded player enabling signals PC1, PC2 and PC3 from commercially designated output terminals 9, 10, and 11, respectively, of the third input logic module ZY3 in the switch selector network.

The fourth player is accorded player enabling signals PD1, PD2 and PD3 from conventionally designated output terminals 7, 6 and 5, respectively, of the third input logic module ZY3 of the input switch selector circuit ZY.

The fifth player on a team is accorded player enabling signals PE1, PE2 and PE3 which are emitted from the conventionally designated terminal pins 9, 10 and 11, respectively, on the fourth input logic module ZY4 of the input switch selector circuit ZY.

The third player enabling signals PC1, PC2 and PC3 are directly connected to the player switch scanning modules ZY11, ZY12 and ZY13, respectively; the fourth player enabling signals PD1, PD2 and PD3 are connected to the switch scanning logic modules ZY14, ZY15 and ZY16, respectively; and, the fifth player enabling signals PE1, PE2 and PE3 are connected to the input switch scanning modules ZY17, ZY18 and ZY19, respectively, for the left-hand team.

These player enabling signals PA1-3, PB1-3, PC1-3, PD1-3 and PE1-3, are also selectively and similarly interconnected with the units ZY20-22, ZY23-25, ZY26-28, ZY29-31 and ZY32-34, respectively. This completes the player enabling signal connections for the right hand team of players RA through RE.

The first input logic module ZY1 of the switch selector circuit ZY has conventionally designated output terminal pins 9, 10, 11, 12 and 7, which carry primary player enabling signals PA, PB, PC, PD and PE, respectively, to the input of the second, third and fourth input logic modules ZY2, ZY3 and ZY4, as follows:

The primary enabling signal PA for the first player LA or RA on a team being scanned is directly connected to the conventionally designated input terminal pins 14 and 1 of the second logic module ZY2;

The primary player enabling signal PB for the second player on a given team (LB or RB) is directly connected to the conventionally designated input terminal pin No. 2 of the second logic module ZY2;

The primary enabling signal PC for the third player on a given team (LC or RC) is directly connected to the conventionally designated input terminal pins 1 and 14 of the third input logic module ZY3;

The primary enabling signal PD for the fourth player on a given team (LD or RD) is directly connected to the conventionally designated input terminal pin 2 on the third input logic module ZY3; and The primary enabling signal PE for the fifth player on a given team (LE or RE) is directly connected to the conventionally designated input terminal pins 1 and 14 on the fourth input logic module ZY4.

The interconnections of the second, third and fourth input logic modules ZY2, ZY3 and ZY4 are completed by grounding the conventionally designated terminal pins 15.

From the foregoing description, it can be seen that all of the ball point switches are sequentially scanned for each player, for the entire team in a player by player sequence, by the constraint imposed on the logic modules ZY1 - ZY34 by the changing bit patterns of the ball count on lines A, B, C, D and E and the changing bit patterns of the player count on the lines L, J and K.

THE COMPUTE-DISPLAY AND PRINT COMMAND CIRCUITS

Referring jointly to FIGS. 4, 4A, 4B, 4C the right and left compute-display command moduls RDS and LDS, respectively, and the right and left print command modules RP and LP, respectively, which were generically described in reference to FIG. 2, will now be described in detail.

Referring first to the right-hand team command modules, the compute-display and print commands are sent to the inputs of the right hand ball point encoder ZT1 - ZT4 through the right hand decimal code lines RD1, RD2, RD4 and RD8 from the outputs of four command NAND gates ZS1, ZS2, ZS3, and ZS4, respectively. Each of the NAND gates comprise commercially available logic modules identified in the Appendix herein. These outputs correspond to the generic designation RDP previously described in FIG. 2.

The first command NAND gate ZS1 is provided with two inputs corresponding to the SW. IN terminal of the second random access memory ZG in the main control circuit and a synchronizing input, CH-P, the purpose of which will be more fully described hereinafter.

The second command NAND gate ZS2 is provided with two inputs as follows:

A SW. IN terminal corresponding to the like designated output terminal at the second random access memory ZG; and A right compute-display input terminal RCD which is the output terminal of a first NAND gate ZN1 is cross-coupled configuration with a second NAND gate ZN2, the former having a normally biased input terminal selectively shorted to ground through a normally open right compute-display switch RDS, and the latter (ZN2) having an input corresponding to the output of a third NAND gate ZN3. This NAND gate ZN3 has a first input corresponding to the SW RESET output (pin 14) of the command decoder module ZF (previously described with reference to FIG. 2), and a second input corresponding to the output data line DLO of the first random access memory ZD in the main control circuit.

All of the NAND gates ZN1 - ZN3 are commercially available logic modules identified in the Appendix herein.

The third command NAND gate ZS3 has a first input corresponding to the SW. IN output of the second random access memory ZG and a second input comprising a RESET terminal, the purpose of which will be more fully described hereinafter.

The fourth command NAND gate ZS4 is provided with two inputs as follows:

A SW. IN terminal corresponding to the like designated output terminal at the second random access memory ZG; and A right print input terminal PR which is the output terminal of a first NAND gate ZN4 in cross-coupled configuration with a second NAND gate ZP1, the former having a normally biased input terminal selectively shorted to ground through a normally open right print switch RP, and the latter having an input corresponding to the output of a third NAND gate ZP2. This NAND gate ZP2 has a first input corresponding to the SW RESET output (pin 14) of he command decoder module ZF (previously described with reference to FIG. 2), and a second input corresponding to the output data line DL2 of the first random access memory ZD in the main control circuit.

All of the NAND gates ZN4, ZP1 and ZP2 comprise commercially available logic modules identified in the Appendix herein.

The second NAND gate ZP1 has a print command output identified as R-PFF which will be hereinafter more fully described with reference to the description of the print-out means of the present invention.

Referring now to the left hand team command modules, the compute-display and print commands are sent to the inputs of the left-hand ball point encoders ZT5-ZT8 through the left-hand decimal code lines LD1, LD2, LD4 and LD8 from the outputs of four command NAND gates ZR2, ZR3, ZR4 and ZR1, respectively. Each of these NAND gates comprise commercially available logic modules identified in the Appendix. These outputs correspond to the generic designation LDP previously described in FIG. 2 as comprising the control command connection between the module LDS-LP and the left-hand ball point encoder ZT5-8.

The first NAND gate ZR1 is provided with two inputs corresponding to the SW. IN terminal of the second random access memory ZG in the main control circuit and a RESET terminal, the purpose of which will be more fully described hereinafter.

The second command NAND gate ZR2 is provided with two inputs as follows:

A synchronizing inut CHP, the purpose of which will be hereinafter more fully described, and a SW. IN input corresponding to the like designated output terminal at the second random access memory ZG.

The third command NAND gate ZR3 is provided with two inputs as follows:

A SW. IN terminal corresponding to the like designated output terminal at the second random access memory ZG; and A left compute-display input terminal LCD which is the output terminal of a first NAND gate ZP3 in cross-coupled configuration with a second NAND gate ZP4, the former having a normally open left compute-display switch LDS, and the latter (ZP4) having an input corresponding to the output of a third NAND gate ZQ1. This NAND gate ZQ1 has a first input corresponding to the SW RESET output (pin 14 via inverter ZK1) of the command decoder module ZF (previously described with reference to FIG. 2) and a second input corresponding to the output data line DL1 of the first random access memory ZD in the main control circuit.

All of the NAND gates ZP3, ZP4, and ZQ1 are commercially available logic modules identified in the Appendix.

The fourth command NAND gate ZR4 is provided with two inputs as follows:

A SW. IN terminal corresponding to the like designated output terminal at the second random access memory ZG; and A left print input terminal PL which is the output terminal of a first NAND gate ZQ2 in cross-coupled configuration with a second NAND gate ZQ3, the former having a normally biased input terminal selectively shorted to ground through a normally open left print switch LP, and the latter having an input corresponding to the output of a third NAND gate ZQ4. This NAND gate ZQ4 has a first input corresponding to the SW RESET output of the command decoder module ZF (previously described with reference to FIG. 2), and a second input corresponding to the output data line DL3 of the first random access memory ZD in the main control circuit.

All of the NAND gates, ZQ2, ZQ3 and ZQ4 comprise commercially available logic modules identified in the Appendix.

The second NAND gate ZQ3 has a print command output identified as LPFF which will be hereinafter more fully described with reference to the description of the print-out means of the present invention.

THE COMPUTING UNIT

Referring jointly to FIGS. 2, 6, 6A and 6B the computing and command generating circuit of the present invention will now be described in more detail.

All of the various units ZA through ZE and ZG are interconnected with the bi-directional data lines D0, D1, D2, and D3 as generally indicated in FIG. 2.

The specific interconnections shown in FIG. 6 are as follows:

The read only memories (ROMS) ZB, ZC1—ZC6 are commercially available units designated as INTEL ROMS No. 4001. These are 16-pin integrated circuit modules having the data lines D0, D1, D2 and D3 interconnected with the commercial terminal pins 1, 2, 3 and 4, respectively, of each of the ROMS ZB, ZC1—ZC6. Further, the CM ROMS (command ROMS) line input appears at the terminal pin No. 11 of the ROMS ZB, ZC1—ZC6. A CLEAR (CL) or RESET signal appears at terminal No. 9 of each of the said ROMS. A SYNC signal from the central control unit ZA appears at terminal No. 8 of the said ROMS to complete the interconnection of all of the ROMS ZB, ZC1—ZC6 with the computer network. The first ROM ZB also includes terminal pins 16, 15, 14 and 13 corresponding to data inputs DA1', DA2', DA4' and DA8' which are connected, respectively, with input data lines DA1, DA2, DA4 and DA8 through inverter circuits ZR14, ZR15, ZR16 and ZR17, shown adjacent ROM 2D (ZC5) in FIG. 6B as a typical ROM input. These lines are brought into the first ROM ZB from the left-right selector ZH as previously described.

There are two random access memories (RAM) which have a commercial designation as an INTEL Ram No. 4002 and have terminal pins 1, 2, 3 and 4, interconnected, respectively, with the bidirectional data lines D0, D1, D2 and D3. A command RAM (CM-RAM) signal line is provided from the terminal pin 16 on the central control unit ZA to terminal pin 11 on each of the RAMS ZD and ZG. A SYNC signal is applied from terminal 8 of the central control unit ZA to terminal pin No. 8 on the RAMS ZD and ZG. A CLEAR (CL) signal is applied from an external circuit means (to be hereinafter more fully described) to terminal pins 9 on the RAMS ZD and ZG.

The first RAM ZD has output terminals 16, 15, 14 and 13 which correspond, respectively, to output data lines DL0, DL1, DL2 and DL3. These output data lines are respectively driven by the said terminals through inverters ZR10, ZR11, ZR12 and ZR13 and are directed to the input of the printer control module ZZ as previously generally described with respect to FIG. 2 and which will hereinafter be more fully described with reference to FIG. 8.

With respect to the second RAM ZG, it is provided with output terminal pins 13, 14, 15 and 16 which respectively carry output signals LEFT (SELECT LEFT), SW. IN (switch in), ALPHA INPUT and SCAN SW's.

The command delay module ZE is interconnected with the bi-directional data lines D0, D1, D2 and D3 through four inverters ZJ1, ZJ2, ZJ3 and ZJ4, respectively, the outputs of the latter being designated DD0, DD1, DD2, and DD3, respectively, and being respectively connected to the terminal pins 4, 5, 6 and 7 of the command delay module ZE. These lines DD0 through DD3 comprise the information inputs to the command delay module ZE. Other inputs to the command delay module are derived from the CM RAM output of the main or central control unit ZA through an inverter ZJ5 driving the first input of a NAND gate ZQ5 having a second input 02 and having its output driving terminal pin 10; and clock phase and SYNC signals which are fed into terminal pin 8 of the command delay module ZE from the output of a NAND gate ZM1. The NAND gate ZM1 has a first input receivng a first clock phase input 01 and a second input receiving a SYNC signal from the output of an inverter ZK5 which is driven by another inverter ZK4 having a SYNC signal applied to its input. The command delay module ZE has four outputs DC0, DC1, DC2 and DC3 corresponding to its terminal pins 15, 14, 13 and 12, respectively, which provide coded commmand signals for the command decoder module ZF.

The command decoder module ZF is driven as follows:

At a first input terminal by the output of NAND gate ZM2, the latter having a second clock phase input 02 and a $\overline{\text{SYNC}}$ input taken from the output of the inverter ZK4; at a second input terminal by the output of a NAND gate ZM3 having as its inputs the last two coded outputs DC2 and DC3 from the command delay module ZE; and four additional input terminals driven by, respectively, the parallel or correponding inputs DD0, DD1, DD2 and DD3 originally applied to the command delay module ZE from the inverters ZJ1 - ZJ4, respectively. The outputs of the command decoder module ZF comprise the output terminals 0 through 15 as previously described with reference to FIG. 2.

The central control unit ZA comprises a commercially available INTEL MICROCOMPUTER CIRCUIT NO. 4004 and includes the following connections:

Terminal pins 1, 2, 3 and 4 comprise the input-output data line connections D0, D1, D2 and D3, respectively;

Terminal 10 comprises the input for the $\overline{\text{TEST}}$ signal from ZR5 or ZR6 in the left and right compute-display print modules LDS-LP and RDS-RP to indicate to the central control unit ZA that a strike or spare has been rolled by the right or left-hand team players.

Terminal pins 6 and 7 of the central control unit ZA receive two clock phase signals, namely, clock phase $\phi 1$ and clock phase $\phi 2$, respectively.

Terminal 9 of the central control unit ZA receives a CLEAR (CL) signal, terminal 11 comprises a command ROM (CM-ROM) output signal to the various read only memories (ROMS) of the computing unit; and terminal pin 16 comprises a cmmand RAM (CM-RAM) output control signal for the random access memories (RAMS) in the computing unit.

The CLEAR (CL) signal is generated by an independent circuit shown in FIG. 6A which comprises a source of bias (+5 volts) connected through a series connected resistance RCL-1 and capacitor CCL to −10 volts, the junction between this resistor RCL1 and capacitor CCL driving the input of a transistor QCL through a diode DCL. The transistor QCL with load resistor RCL2 provides a CLEAR signal CL.

THE DISPLAY UNIT DRIVER

The display unit DU referring to FIGS. 2, 6 and 7 is driven by the four outputs DD0 through DD3 of the inverter amplifiers ZJ1 through ZJ4, respectively, together with the latter two coded command outputs DC2 and DC3 of the command delay module ZE. In addition, there are two outer inputs to display unit DU from the outputs of first and second AND gates ZL1 and ZL2 which as shown in FIG. 7 are derived from the following configuration;

Command inputs are provided to the first and second AND gates ZL1 and ZL2 from the output of an inverter amplifier ZJ6. The first AND gate ZL1 is also provided with a select left input signal LEFT corresponding to the select left signal at the terminal pin 13 of the second RAM ZG.

The second AND gate ZL2 is provided with a SELECT RIGHT input signal (LEFT is a logic "0,") which is derived from the SELECT LEFT signal (LEFT = logic "1") through an inverter ZK6, the output of the latter being directly connected to the second input terminal of the second AND gate ZL2.

The input to the inverter amplifier ZJ6 (having its output connected in common to the inputs of the said AND gates to ZL1 and ZL2) is derived from the output of a NAND gate ZT7 which has four inputs as follows: a first input corresponding to the coded output DC3 of the command delay module ZE; a second input corresponding to an inverted coded output DC2 of the command delay module ZE which is derived by driving the second input of the said NAND gate ZT7 through an inverter ZK1; a third input comprising a second clock phase signal $\phi 2$; and a fourth input comprising an inverted SYNC signal corresponding to the signal derived from the output of the inverter amplifier ZK4 in the command delay driver circuit of FIG. 6.

The SELECT RIGHT signal (LEFT = logic "0") is also connected to the SELECT RIGHT input signal terminal pin 1 of the Left/right selector module ZH as previously described in connection with FIGS. 2 and 4.

THE PRINTER DRIVER CIRCUIT

The printer driver circuit of the present invention will now be described with reference to FIG. 8 and is shown as including five input logic modules ZZ1, ZZ2, ZZ3, ZZ4, and ZZ5, all having input terminal pins 4, 5, 6 and 7, connected respectively, with the data lines DL0, DL1, DL2 and DL3 from the output terminals of the first RAM ZD.

These logic modules ZZ1 through ZZ5 also each include a terminal pin 10 which is connected through respective inverters ZK15 through ZK19 with the LOAD WORD 1, LOAD WORD 2, LOAD WORD 3, LOAD WORD 4 and LOAD WORD 5 outputs of the command decoder ZF corresponding to the output terminals 6, 7, 8, 9 and 10 thereof, respectively.

These modules ZZ1 - ZZ5 each further include a terminal pin 9 which is connected to ground.

The output terminal pins of the logic modules ZZ1 through ZZ5, numbered 12, 13, 14 and 15 for each of said modules are connected one to each of 20 printer hammers in the printer circuit hereinafter to be more fully described. Printer hammers 1 - 4 are driven by the outputs of the printer control module ZZ1; hammers 5 - 8 by ZZ2; hammers 9 - 12 by ZZ3; hammers 13 - 16 by ZZ4; and hammers 17 - 20 by ZZ5.

PLAYERS INITIALS (ALPHA INPUTS)

The players initials are manually put into the calculating unit by means of the alpha keyboard AK and are stored in the second RAM ZG for printing as will now be more fully described with reference to the details of the ALPHA keyboard as shown in FIG. 9.

The ALPHA keyboard includes first, second, third and fourth integrated circuit modules ZX29, ZX30, ZX31, and ZX32, all of which comprise 16 terminal commercially available modlues designated as No. 74156 and more fully identified in the Appendix to this specification in which all of the modular parts and commercially available circuitry is set forth.

Each of these modules ZX29 and ZX32 includes a terminal pin combination 2 and 14 to which are connected, respectively, sequencing signals from the switch scanning logic circuitry of FIG. 5 identified as PF1, PF2, PF3 and PF4 respectively, which are emitted from output terminal pins 7, 6, 5 and 4 of the integrated circuit module ZY4 in FIG. 5. In this connection, it should also be noted that the ALPHA INPUT enabling signal is applied to input terminal pin 2 of the switch scan selecting module ZY4 from the second RAM ZG (FIG. 6).

It can be readily seen that by the four digit logic output PF1 through PF4, that all ten players on both teams can be selected in sequence to properly enter into the display module DU the individual initials of each of the ten players LA-LE and RA-RE on the two teams being scored.

In addition, again referring jointly to FIGs. 5 and 9, the outputs A, B and C from the ball counter module ZF2 are utilized, respectively, to drive terminal pins 13, 3 and 1, 15 of each of the modules ZX29 through ZX32.

The modules ZX29 through ZX32 are provided with output terminals and corresponding output signal functions as follows:

| Output terminal pin No. | Output function | Enabling switch |
|---|---|---|
| Module ZX29 | | |
| 9 | Left enter | AK2 |
| 10 | Right enter | AK3 |
| 11 | Blank | AK4 |
| 12 | A | AK5 |
| 7 | B | AK6 |
| 6 | C | AK7 |
| 5 | D | AK8 |
| 4 | E | AK9 |
| Module ZX30 | | |
| 9 | F | AK10 |
| 10 | G | AK11 |
| 11 | H | AK12 |
| 12 | I | AK13 |
| 7 | J | AK14 |
| 6 | K | AK15 |
| 5 | L | AK16 |
| 4 | M | AK17 |
| Module ZX31 | | |
| 9 | N | AK18 |
| 10 | O | AK19 |
| 11 | P | AK20 |
| 12 | Q | AK21 |
| 7 | R | AK22 |
| 6 | S | AK23 |
| 5 | T | AK24 |
| 4 | U | AK25 |
| Module ZX32 | | |
| 9 | V | AK26 |
| 10 | W | AK27 |
| 11 | X | AK28 |
| 12 | Y | AK29 |
| 7 | Z | AK30 |

As also illustrated by the foregoing table, there are 29 enabling switches AK2 through AK30 which enable, respectively, the previously indentified sequence of output functions in the table. All of these switches are connected to a common line AK31 which is in turn connected to a source of bias and drives the input of an isolater buffer ZX33 having its output identified as $\overline{\text{TEST}}$ input. The output of the buffer amplifier ZX33 comprise the ALPHA keyboard output AK1 previously shown in general terms in FIG. 3.

To further elaborate on the general operation of the ALPHA keyboard AK, the ALPHA codes are generated by the ball couunter ZF2 along with the decoder units ZY4 in the switch strobing input logic network together with the logic modules ZX29 through ZX32 in the ALPHA keyboard AK. These units, cooperating together, strobe the various ALPHA keys AK2 through AK30. As the ball counter ZF2 is indexed, an internal counter in the central control unit ZA is also indexed accordingly until a key closure, i.e., one of the enabling switches AK2 through AK30, is sensed by the $\overline{\text{TEST}}$ line from the buffer amplifier ZX33.

There are three special keys in the enabling switch bank AK2 through AK30, namely, the LEFT SELECT key or LEFT ENTER key AK2, the RIGHT SELECT or RIGHT ENTER key AK3 and the BLANK key AK4.

To load initials into the left hand side of the display module DU, the LEFT SELECT key AK2 is closed. This closing of the switch AK2 will clear the player initial area of the left display DU by way of the central control unit ZA. Then the switches AK4 through AK30 are selectively closed to enter the player initials into the display unit DU.

Since each of five players are permitted to enter their first, middle and last initial, that is, three initials per player, there will be 15 ALPHA keys operated in sequence once the left enter ALPHA key AK2 has been closed.

If less than five players are to be entered, the blanking key AK4 can be closed a sufficient number of times to enter successive blanks to complete a five-player sequence. Initials or blanks, due to the speed of strobing or scanning of the ALPHA enabling switches AK2 through AK30 would be displayed as each key is pressed.

The ALPHA characters are held in the second RAM ZG for use with the printer as will be hereinafter more fully described. As each ALPHA code is entered, it is first displayed in a manner similar to the scoring data and is then stored in the RAM ZG.

THE PRINT-OUT UNIT

The printer unit of the present invention will now be described with reference to FIGS. 10 and 10A and is shown as generally including 20 columns of ALPHA numeric characters on a conventional printing drum, the printer being identified as a commercially available type in Appendix III hereof. These columns of ALPHA numeric characters are actuated by the printer hammers 1 through 20, the hammers 1 through 20 being driven by driver amplifiers ZX1 through ZX20, respectively, by selectively grounding therethrough the near ends of the hammer driver coils HDCl through HDC20.

For the purpose of disclosing an operative print-out mechanism of the best mode contemplated by the inventor herein, reference is hereby made to a commercially available printer known as Alpha-Numeric Printing Mechanism Model AN-101F of SHINSHU SEIKI CO., LTD., 80 Harashimden, Hirooka, Shioliri-shi, Nagano-ken, Japan, a member of Suwa-Seiko Group. This printer is a known and commercially available item.

Incorporated by reference herein and a copy thereof is attached hereto as Appendix III is a publication entitled, "Specifications for Alpha-Numeric Printer AN-101F (Preliminary) Aug. 1, 1971 (1)", of the Shinshu Seiki Co., Ltd. "

The printer P is partially controlled by the drivers ZX1 through ZX20 which are used to drive the hammer coils HDC1-20 in the printer P. The hammer signals are generated by the data stored in the hammer buffer units ZZ1 through ZZ5 in the printer control module ZZ. This data has been generated in the unit ZA and as previously described with reference to FIG. 8 is loaded into the hammer buffer units ZZ1 through ZZ5 by commands from the command decoder module ZF instructing the loading of words 1 through 5 from the output terminal pins 6 through 10, respectively, of the command decoder ZF.

Previously referred to in FIG. 4 were two signals known as RESET and synchronizing signals CHP which comprise the synchronizing pulses issued from the printer P to synchronize the control unit ZA to the printer P. These two signals are brought into the control unit ZA through two alternate paths. During the print cycle, the left-right selector ZH will have been set to select data from the proper team, i.e. the right or left-hand team to be printed.

If the left/right selector ZH had selected the left-hand team, the input synchronizing signal CH-P and RESET would be routed to the left-hand ball point encoder ZT5 through ZT8 by way of the command NAND gates ZR1 and ZR2.

If the left/right selector ZH had been set in the right-hand mode, the two synchronizing signals CH-P and RESET would have been routed through the right-hand ball point encoder ZT1 through ZT4 by way of the command NAND gates ZS1 and ZS3.

As the score is computed for each team during either a left print or a right print cycle, the data to be printed is entered incrementally into the second RAM ZG and is immediately thereafter used to drive the printer P to print the information on a suitable print-out type. Thus, there is only a temporary storage of such data in the RAM ZG for the express purpose of print-out and no cumulative scoring data is stored in the second RAM ZG or the first RAM ZD other than the player's initials, during the compute display programs. If any storage is effected whatsoever, it is only in the nature of a dynamic register for the purpose of a current calculation and the data is not stored in a retrievable form during the compute display programs.

At the initiation of a print-out cycle of the bowling scorer of the present invention, it is necessary to energize the printer motor. To start a print-out program, the proper control switch LP or RP for left or right-hand print-out is pressed.

Each switch LP or RP sets its associated control flip-flop consisting of the cross coupled NAND gates ZQ2, ZQ3 or ZN4, ZP1, respectively.

The resulting signals from the flip-flops generates the line feed forward signal $\overline{\text{LPFF}}$ when the left hand print-out switch LP is actuated and the right line feed forward signal $\overline{\text{RPFF}}$ when the right-hand print command switch RP is actuated.

Either or both of these signals $\overline{\text{LPFF}}$ and $\overline{\text{RPFF}}$ cause the output of the NAND gate ZX25 in the motor control circuit of FIG. 10A to be driven low, turning off the transistor Q4 associated therewith through the OR network comprised of output resistors MR1, MR2 and MR3.

With the transistor Q4 turned off, the transistor Q5 is turned on thereby allowing a current to flow through the printer motor from the plus 15 volt DC source shown in FIG. 10 through the said transistor Q5 to turn the motor PM on and rotate the drum (not shown) of the printer P.

If a first manual line feed switch MLF1 in the input circuit of the transistor Q4 is closed connecting the base of the latter to ground, this will also generate a low input to the transistor Q4 to keep the motor running should it be desired to manually advance the print paper in the printer P.

Without a low output signal from the control AND gate ZX25 or the manual line feed switch MLF1, the transistor Q4 turns on due to its connections with the five volt DC bias source shown in FIG. 10A thereby turning off the transistor Q5 and stopping the flow of current through the printer motor PM, thereby turning off the motor. The resistor MR2 shown at the base (input) of the transistor Q5 is a dropping resistor which provides the turn on current for the transistor Q5. The collector of the transistor Q5 and one side of the printer motor PM are connected to ground through a capacitor MC1 and a diode MD1 connected in parallel for the purose of noise suppression.

The 15 volt DC supply indicated in FIG. 10 is a common supply for the printer motor PM, the printer hammers previously discussed, the printer ribbon and line feed coils of the printing device identified in FIG. 10 as Ribbon Feed Coil and Forward Line Feed Coil, respectively.

In order to properly program the printer P which is a dynamic constantly rotating drum and hammer type, it is necessary to provide synchronizing pulses to constrain the hammers to strike the drum through the print paper and printer ribbon at the proper points in time.

To achieve this, there are provided two synchronizing pulse amplifiers which are used to amplify the RESET pulse (Indicates the first character position, a zero, of the print drum) and the synchronizing signal CHP (sets of two pulses to indicate the beginning and end of each character position). The print drum character position configuration will be set forth in more detail hereinafter in conjunction with the hammer driver and buffer operation to be hereinafter more fully described.

The commercially available printer utilized in the preferred embodiment of the invention includes rotating parts in which permanent magnets are positioned for the purpose of generating pulses in conjunction with first and second detecting heads R and T, corresponding to the RESET and CHP pulses respectively.

In the provision of RESET pulse, this pulse is generated in the RESET head or coil R by means of a permanent magnet pulsing the coil once for each revolution of the print drum. This signal is coupled through the capacitance RC1 to turn on a first transistor Q1 which then turns off a transistor Q2 coupled to the output thereof. The output signal RESET goes high as the drum pulses the beginning of the first character on the print drum as is commercially known. Three resistors RR1, RR2, and RR3 are provided to bias the transistor Q1 off when no RESET pulse is generated. Biasing registers RR4 and RR5 are provided between the collectors of the respective transistors Q1 and Q2 and a common source of bias identified as plus 15 volts DC.

The RESET pulse appears at the collector terminal of the second transistor Q2, the emitter of the latter being grounded and the base thereof being connected directly to the collector of the first transistor Q1.

The snchronizing signal CHp is generated by the position of two magnets positioned to indicate the beginning and the end of a given character position on the printer drum. These magnets are attached, as is commercially known, to the hammer drive shaft of the printer which completes one revolution for each character on the drum (the hammer drive shaft makes 42 revolutions for each revolution of the print drum). These two magnets generate pulses in the synchronizing signal pickup heads T. The resulting signal in the pickup head coil is coupled through a capacitor RC2 to a third transistor Q3 which is normally biased off by a network consisting of resistors TR12 and TR3.

The pulse generated in th pickup head T turns on the third transistor Q3 placing a low signal on the input of an inverter circuit ZX28 to produce a positive going pulse comprising the synchronizing signal CHp.

The input of this inverter ZX28 is connected to ground through a capacitor TC3 to eliminate very short noise spikes in the signal emitted by the third transistor Q3, the collector terminal of the latter being directly connected to the input of the said inverter ZX28.

In order to advance the print which comprises a roll of paper tape or the like, as well as the inked printer ribbon of the printer P, the command decoder module ZF generates a line feed pulse LF from pin No. 12 thereof and applies it to the input terminal pins 1 and 2 of a commercially available 74122 Multivibrator ZX22. The Multivibrator ZX22 is used to generate the correct pulse length to activate the ribbon feed coil and the forward line feed coil of the printer P shown in FIG. 10B since the line feed pulse LF is too short for proper activation thereof.

A pulse length determining network is provided by a biased resistor MVR in connection with a diode MVD and a capacitor MVC connected in parallel with the said diode, from one end of the biasing resistor MVR. The capacitor MVC is connected to terminal pin 11 on the other side thereof and the diode MVD is connected by its cathode to the terminal pin 13 of the multivibrator ZX22.

Terminal pin 8 of the multivibrator ZX22 comprises the output thereof and carriers the line feed pulse to the input of a sixth transistor Q6 through a conventional input resistance network. The collector emitter path of the sixth transistor Q6 is connected from a voltage source (+15V.D.C.) at one side of the Ribbon Feed and Line Feed Coils to ground through a suitable load resistance network, and the emitter of the sixth transistor Q6 is directly connected to the base or input terminal of a seventh transistor Q7 which connects, via its collector emitter path, the other side of the Ribbon and Line Feed Coils to ground. Accordingly, when a line feed pulse is received at the base of Q6, the sixth transistor Q6 is turned on and in turn, turns on the power transistor to Q7, thereby drawing current from the 15 volt DC source through the Ribbon and Line Feed Coils of the printer P. At the termination of the multivibrator cycle ZX22, i.e., the termination of the line feed pulse at the terminal pin 8 thereof, the seventh or power transistor Q7 turns off and the Ribbon Feed and Line Feed Coils of the printer P are de-energized, thereby advancing the print paper and the printer ribbon to prepare the print paper to receive the next information to be printed out.

Also, as shown in FIG. 10, there is provided a resistor, capacitance and diode network across the ribbon feed and forward line feed coils for the purpose of arc suppression.

A manual line feed switch is also provided at the input terminals 1 and 2 of the control multivibrator ZX22 to be actuated in conjunction with the manual line feed switch MLF1 in the printer motor control circuit for the purpose of effectuating manual advance of the print paper and ribbon.

When the manual line feed switch MLF2 at the input of the multivibrator ZX22 is actuated, it is connected to receive the RESET pulses from the RESET amplifier to thereby trigger the multivibrator ZX22 and provide line feed pulses under the manual constraint of the manual line feed switch MLF2 in proper synchronization with the printer P.

PRINTER HAMMER OPERATION

The print drum of the printer p contains 21 columns of 42 alpha-numeric characters each. Only the first 20 columns (shown in FIG. 10 as numbered from right to left) are used in the present invention. A replica of the format of alpha-numeric characters on the print drum of the printer p is as follows:

| | | | | | | | | | | | | | | | | | | | | |
|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 1 | 1 | 1 | 1 | 1 | 1 | 1 | 1 | 1 | 1 | 1 | 1 | 1 | 1 | 1 | 1 | 1 | 1 | 1 |
| 2 | 2 | 2 | 2 | 2 | 2 | 2 | 2 | 2 | 2 | 2 | 2 | 2 | 2 | 2 | 2 | 2 | 2 | 2 | 2 | 2 |
| 3 | 3 | 3 | 3 | 3 | 3 | 3 | 3 | 3 | 3 | 3 | 3 | 3 | 3 | 3 | 3 | 3 | 3 | 3 | 3 | 3 |
| 4 | 4 | 4 | 4 | 4 | 4 | 4 | 4 | 4 | 4 | 4 | 4 | 4 | 4 | 4 | 4 | 4 | 4 | 4 | 4 | 4 |
| 5 | 5 | 5 | 5 | 5 | 5 | 5 | 5 | 5 | 5 | 5 | 5 | 5 | 5 | 5 | 5 | 5 | 5 | 5 | 5 | 5 |
| 6 | 6 | 6 | 6 | 6 | 6 | 6 | 6 | 6 | 6 | 6 | 6 | 6 | 6 | 6 | 6 | 6 | 6 | 6 | 6 | 6 |
| 7 | 7 | 7 | 7 | 7 | 7 | 7 | 7 | 7 | 7 | 7 | 7 | 7 | 7 | 7 | 7 | 7 | 7 | 7 | 7 | 7 |
| 8 | 8 | 8 | 8 | 8 | 8 | 8 | 8 | 8 | 8 | 8 | 8 | 8 | 8 | 8 | 8 | 8 | 8 | 8 | 8 | 8 |
| 9 | 9 | 9 | 9 | 9 | 9 | 9 | 9 | 9 | 9 | 9 | 9 | 9 | 9 | 9 | 9 | 9 | 9 | 9 | 9 | 9 |
| A | A | A | A | A | A | A | A | A | A | A | A | A | A | A | A | A | A | A | A | A |
| B | B | B | B | B | B | B | B | B | B | B | B | B | B | B | B | B | B | B | B | B |
| C | C | C | C | C | C | C | C | C | C | C | C | C | C | C | C | C | C | C | C | C |
| D | D | D | D | D | D | D | D | D | D | D | D | D | D | D | D | D | D | D | D | D |
| E | E | E | E | E | E | E | E | E | E | E | E | E | E | E | E | E | E | E | E | E |
| F | F | F | F | F | F | F | F | F | F | F | F | F | F | F | F | F | F | F | F | F |
| G | G | G | G | G | G | G | G | G | G | G | G | G | G | G | G | G | G | G | G | G |
| H | H | H | H | H | H | H | H | H | H | H | H | H | H | H | H | H | H | H | H | H |
| I | I | I | I | I | I | I | I | I | I | I | I | I | I | I | I | I | I | I | I | I |
| J | J | J | J | J | J | J | J | J | J | J | J | J | J | J | J | J | J | J | J | J |
| K | K | K | K | K | K | K | K | K | K | K | K | K | K | K | K | K | K | K | K | K |
| L | L | L | L | L | L | L | L | L | L | L | L | L | L | L | L | L | L | L | L | L |
| M | M | M | M | M | M | M | M | M | M | M | M | M | M | M | M | M | M | M | M | M |
| N | N | N | N | N | N | N | N | N | N | N | N | N | N | N | N | N | N | N | N | N |
| O | O | O | O | O | O | O | O | O | O | O | O | O | O | O | O | O | O | O | O | O |
| P | P | P | P | P | P | P | P | P | P | P | P | P | P | P | P | P | P | P | P | P |
| Q | Q | Q | Q | Q | Q | Q | Q | Q | Q | Q | Q | Q | Q | Q | Q | Q | Q | Q | Q | Q |
| R | R | R | R | R | R | R | R | R | R | R | R | R | R | R | R | R | R | R | R | R |
| S | S | S | S | S | S | S | S | S | S | S | S | S | S | S | S | S | S | S | S | S |
| T | T | T | T | T | T | T | T | T | T | T | T | T | T | T | T | T | T | T | T | T |
| U | U | U | U | U | U | U | U | U | U | U | U | U | U | U | U | U | U | U | U | U |
| V | V | V | V | V | V | V | V | V | V | V | V | V | V | V | V | V | V | V | V | V |
| W | W | W | W | W | W | W | W | W | W | W | W | W | W | W | W | W | W | W | W | W |
| X | X | X | X | X | X | X | X | X | X | X | X | X | X | X | X | X | X | X | X | X |
| Y | Y | Y | Y | Y | Y | Y | Y | Y | Y | Y | Y | Y | Y | Y | Y | Y | Y | Y | Y | Y |
| Z | Z | Z | Z | Z | Z | Z | Z | Z | Z | Z | Z | Z | Z | Z | Z | Z | Z | Z | Z | Z |
| + | + | + | + | + | + | + | + | + | + | + | + | + | + | + | + | + | + | + | + | + |
| – | – | – | – | – | – | – | – | – | – | – | – | – | – | – | – | – | – | – | – | – |
| / | / | / | / | / | / | / | / | / | / | / | / | / | / | / | / | / | / | / | / | / |
| * | * | * | * | * | * | * | * | * | * | * | * | * | * | * | * | * | * | * | * | * |
| $ | $ | $ | $ | $ | $ | $ | $ | $ | $ | $ | $ | $ | $ | $ | $ | $ | $ | $ | $ | $ |
| . | . | . | . | . | . | . | . | . | . | . | . | . | . | . | . | . | . | . | . | . |

To print a particular character in a particular column, the control system of the present invention, via the buffer register ZZ1 through ZZ5, generates a signal for the hammer of the particular column which will thereby trip the hammer just as the character on the print drum passes to the hammer. The control system ZA-ZG uses the RESET pulse from the printer p as an indication that the next character to pass the hammer is the first character, that character being a zero ($\phi$).

The control system ZA through ZG then counts the synchronizing signal CHP pulses and generates one hammer trip pulse for each hammer driver coil HDC1 through HDC20 to be energized to print the proper character in each column. The exception to this generation of print pulses would be where a space is to be left in a given area and for such a space no hammer trip pulse would be sent to the columns in which spaces are required.

To generate the trip pulses for the hammers H1 through H20, the buffer register ZZ1 through ZZ5 stores the hammer information for each character position of the print drum. The control system will load this buffer 42 times to print and 42 times to turn off all the hammers for each revolution of the print drum.

One bit is assigned to each hammer. If the first hammer is to be tripped on a particular character a logic 0 is loaded into the bit designated for hammer H1 (pin 15) in the module ZZ1. This signal would then turn on the hammer driver ZX1 which would complete the direct current pass through the hammer coil HDC1 and cause the first hammer H1 to print the character selected in column 1 of the print drum. If hammer H1 is not to be tripped, a logic 1 is loaded into the logic module ZZ1 and this will turn off the hammer driver ZC1 precluding energization of the first hammer H1 as generally shown in FIG. 10. A similar actuation occurs in all 20 of the hammer driver circuits ZX1 through ZX20 with each hammer H1 through H20 firing as its designated character passes beneath it on the print drum.

To generate the hammer bit pattern which is loaded into the hammer buffers ZZ1 through ZZ5, the central control unit ZA counts the synchronizing signal CHP pulses. The characters to be printed have been assigned drum positions 0 through 41 and have been stored in 20 double registers of 8 bits each in the first RAM ZD. The central control unit ZA compares the CHP pulse count with the drum position code of each character to be printed. If there is a match, a logic 0 will be loaded into the bit position in the buffer register ZZ1 through ZZ5 for the particular column to trip the hammer and print the character. If there is no match of the drum position code and the CHP count code, a logic 1 is loaded into the bit position of the column and the hammer is not tripped.

The calculation of the hammer bit pattern is made in the central control unit ZA and stored in the first RAM ZD as 5 four bit numbers. This calculation takes place as the previous character is being printed by the printer P.

At the end of a character position, a synchronizing pulse CHP is generated to tell the central control unit ZA to turn off all hammers. Between each character of the print drum, the buffer register ZZ1 through ZZ5 is loaded with each bit a logic 1 to turn off all the hammers. At the very beginning of each character on the drum a synchronizing pulse CHP is generated by the printer P in the sensing circuit previously described with reference to FIG. 10A. This signal causes the control unit ZA to load the buffer register ZZ1 through ZZ5 with the new hammer bit pattern stored in the first RAM ZD causing those hammers which are required to be driven to print the designated characters in the proper column. The hammer bit pattern is loaded into the five four bit registers ZZ1 through ZZ5 by strobe pulses generated by the command decoder module ZF. The four bits DL0, DL1, DL2 and DL3 are routed through the first RAM ZD.

THE PRINT-OUT FORMAT

Once a print-out cycle has been initiated for one bowling team, the complete game history of that team's bowlers, including team name, bowlers' initials, bowlers' individual handicaps, bowlers' ball-by-ball and mark histories, bowlers' frame subtotals, bowlers' game totals, team total and team handicap total are contemplated to be displayed.

In a preferred format, the bowlers' game histories for each bowler are printed out five frames at a time in four printed lines beneath a fifth line containing a given bowler's initials and handicap as follows:

| | | TEAM NAME | | |
|---|---|---|---|---|
| WDP | | HNDCP | | 40 |
| 7/ | X | X | 9/ | 8/ |
| 20 | 49 | 69 | 87 | 96 |
| X | 7/ | X | 9/ | 81 |
| 116 | 136 | 156 | 174 | 183 |
| DCP | | HNDCP | | 48 |
| 63 | 8/ | 9/ | X | 72 |
| 9 | 28 | 37 | 55 | 65 |
| 9/ | 54 | 6/ | 9/ | 8/7 |
| 80 | 89 | 108 | 126 | 143 |
| ACC | | HNDCP | | 13 |
| X X | | 8/ | X | X |
| 28 48 | | 68 | 98 | 127 |
| x 9/ | | 8/ | X | XX9 |
| 147 165 | | 185 | 214 | 244 |
| JWK | | HNDCP | | 38 |
| 71 | 63 | X | 54 | 71 |
| 16 | 25 | 44 | 53 | 71 |
| 81 | 53 | X | 8/ | 62- |
| 86 | 94 | 114 | 130 | 138 |
| JDS | | HNDCP | | 26 |
| 9/ | X | 9/ | X | 7/ |
| 20 | 40 | 60 | 80 | 98 |
| 81 | 9- | 9/ | X | 8/9 |
| 107 | 116 | 136 | 165 | 175 |
| | | TEAM TOTAL | | 883 |
| | | HNDCP | | 1038 |

For the sake of illustration, note that the bowler's games in the foegoing print-out are the same bowling games illustrated in FIG. 1, on the display screen of the invention.

PROGRAM INITIATION AND COMPLETION

Four program initiate switches are used to initiate the specific program called for by any given bowler. Two switches are assigned to the left hand team and likewise, two switches are assigned to the right hand team.

The left display switch LDS causes the calculating units ZA through ZG to calculate the left team score player by player and ball by ball and display it on the left-hand side of the display unit DU.

The right display switch RDS initiates the program to calculate and display the score of the right hand team player by player and ball by ball on the right side of the display unit DU.

The left print switch LP causes the entire system to print out the entire game of the left-hand team and likewise, the right print switch RP causes the bowling scores of the right-hand team to be printed out for the complete game.

Between program executions for display or print-out as determined by the energization of the previously described program initiate switches, the control unit ZA continues to scan the status of the four control switches RDS, LDS, RP and LP.

If the left display switch LDS is pressed, the flip-flop consisting of the cross-coupled NAND gates ZP3 and ZP4 is set. Prior to scanning the output of this flip-flop, the left/right selector ZH has been set for left-hand input by the application of the left select control signal LEFT to the circuit of FIG. 7, thereby causing the left/right selector ZH to select left and permit entry of the left-hand inputs LBE1, LBE2, LBE4 and LBE8 from the left-hand ball point encoders ZT5 through ZT8. Therefore, any data appearing on the output data lines DA1, DA2, DA4 and DA8 will be data for the left-hand team to be entered into the computing network ZA through ZG.

When the flip-flop consisting in the cross-coupled NAND gates ZP3 and ZP4, is set, the SW. IN strobe will read in a code of two from the left decimal line LD2 to the left-hand ball point encoders ZT5 through ZT8 via the command NAND gate ZR3.

If the left print switch LP had been pressed, the flip-flop composed of the cross-coupled NAND gates ZQ2 and ZQ3 would have been set. Then, when the SW. IN strobe signal was generated, this would constrain a code of four to be read into the left-hand ball point encoder ZT5 through ZT8 through the control NAND gate ZR4 and the left decimal line LD4. When this code is read into the ball point encoder, the output of the encoder LBE1 through LBE8 and the data lines DA1 through DA8 would constrain the central control unit ZA to decide which program to execute from the ROMS ZB, ZC, ZC2 and ZC3.

After the completion of a given program a SWITCH RESET (SW RESET) would be generated in conjunction with the output code of the RAM ZD, the said output code appearing on the output lines DL0, DL1, DL2 and DL3, to drive the line DL1 to a high state. This signal would reset the flip-flops comprised of either the cross-coupled NAND gates ZP3, ZP4, or ZQ2, ZQ3 so that the program would not be executed for a second consecutive time.

The main computer program would then scan the word that was read to see if another program was to be executed. If so, the next program would be executed in turn. At the completion of each program a code is sent out through the RAM ZD and a switch reset signal (SW RESET) would be generated to reset the particular control flip-flop involved.

During a calculation program for any given player, the control unit ZA will select the proper team switches LHS, RHS and the proper side of the display unit DU depending upon which compute display switch LDS, RDS has been actuated.

The left/right selector ZH will then be set up to select the output of either the right-hand ball encoder ZT1 through ZT4 or the left-hand ball point encoder ZT5 through ZT8.

Assuming that the left signal has been set up, the left/right selector ZH will only accept data from the correct ball point encoder for that team. The information from the left/right selector ZZH is then routed through the data lines DA1, DA2, DA4 and DA8 to the calculating unit through the inputs of the first ROM ZB.

As each ball point switch LHS for a given player is scanned, the binary information from the correct ball point encoder will be routed to the control unit ZA for interpretation and for decoding the value of the ball tobe used in the calculation of a bowling score.

The scanning of the ball switches will normally proceed from the first switch in a given player's bank of switches to the last switch in a player's bank of switches with the exception that when a strike or spare has been rolled, the next one or two switches would be scanned to calculate the bonus points for that given strike or spare. It is to be understood that one additional switch is scanned for spare bonus points and two additional switches in sequence are scanned to calculate strike bonus points. After these switches have been scanned ahead of the current ball switch the program requires that the next switch in sequence be rescanned to commence the sequence all over again.

In other words, the bonus point scan is an advance scan which must be retracted and redone in order to go through and calculate the bowling score from all of the 21 ball point switches ultimately to be thrown or set by a given player throughout his bowling game.

After all of the switches of the first player LA have been scanned, the player counter ZF3 would be advanced by one and the ball counter ZF2 would be reset to 0. The control unit ZA would then cause all of the 21 switches of player LB (left team) to be scanned. This sequence will continue until all 21 switches of the 5th player LE on the left team have been scanned and his score calculated.

Figure 5C:
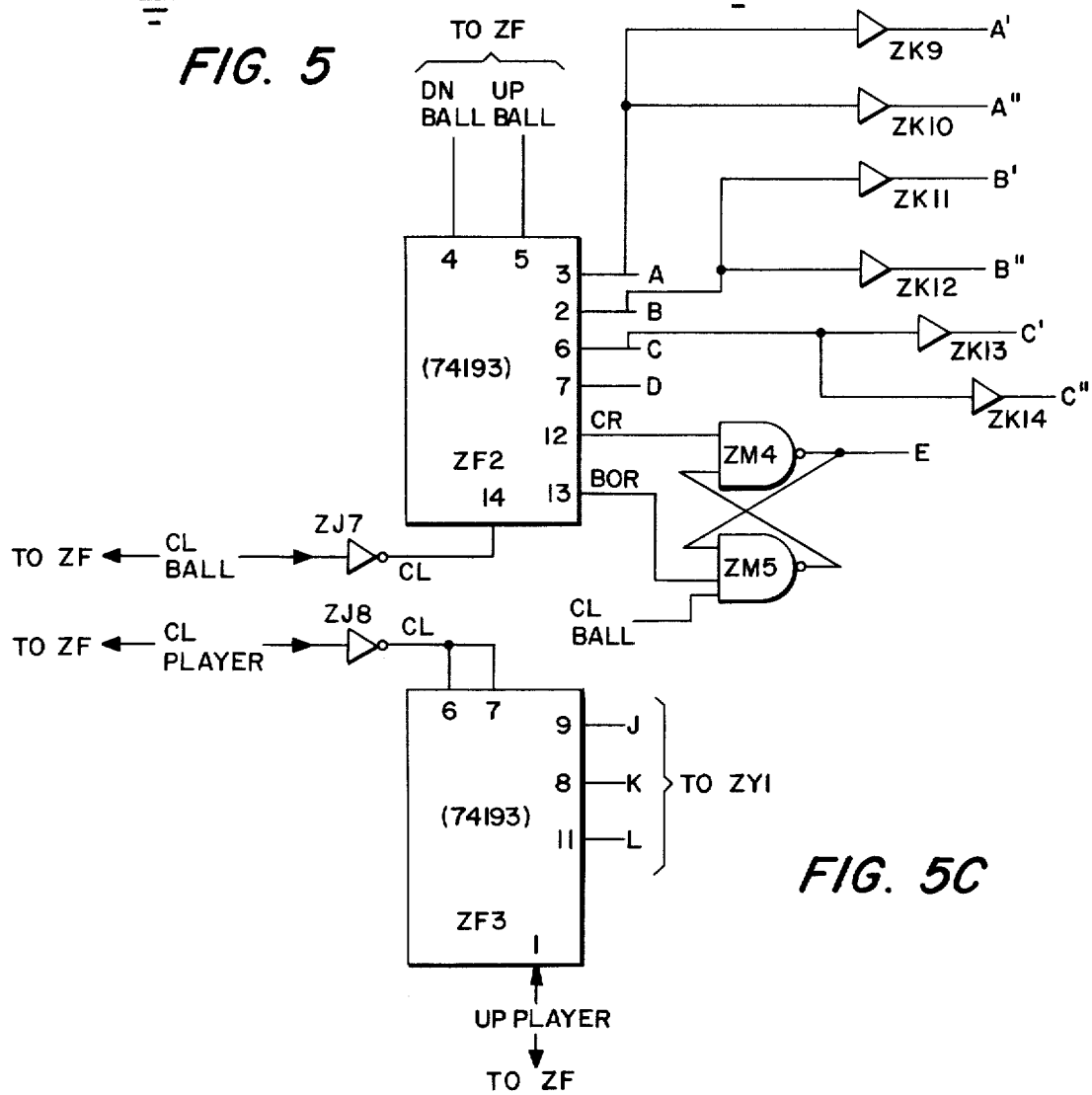

During the scanning of the ball point switches, a ball code A through E is sent to the input switch selector ZY2 through ZY34 as previously described in connection with FIGS. 5-5c. The player code J, K and L and the scan switches (SCAN SW'S) enabling signal, as previously described in conjunction with the description of FIGS. 5-5c, are sent into the main input module ZY1 of the player scanning logic circuit.

Thereafter, the switch scanning units ZY5 through ZY19 provide outputs which drive the wipers of the lever switches for the players LA-LE of the left-hand team as previously described and likewise, the units ZY20 through ZY34 provide outputs which would drive the wipers of the lever switches of the players RA-RE of the right-hand team, as previously described with reference to FIGS. 5-5c, if no LEFT SELECT signal LEFT had been applied to terminal pin 1 of the left/right selector ZH.

The input selector circuitry ZY decodes the ball counter ZF2 and the player counter ZF3 binary codes to provide an output signal to drive any selected lever switch for any given player on a team.

For example, if the first ball switch of the first frame for the first player LA of the left-hand team is to be scanned (ZY5 pin 9), the output line from pin 9 of the switch scanning logic module ZY5 would be pulled low. This signal would be fed through the wiper of the first switch of the player LA and if the lever switch was for example positioned to indicate a ball count of 9 on the first ball bowled by the player LA, the decimal line LD9 would be pulled low through the isolating buffer amplifier ZV9 associated therewith.

Decimal line LD9 would then cause the output of the ball point encoder units ZT5 and ZT8 to assume a high state. This code would then be routed through the left/-right selector ZH and ultimately to the central control unit ZA through the ROM, ZB, ZC1 . . . ZC6 via the data lines LBE1 through LBE8 and DA1 through DA8. The resulting binary code would then be read into the central control unit ZA, interpreted and used in calculation.

The player code inputs JKL will all be driven low for player LA and thereby cause the output pin No. 9 of ZY1 to be driven low, thus generating the first player enabling signal PA at the terminal pins 1, 14 of the second switch selector logic module ZY2. This results in a low signal on output terminal pin 9 of the second switch selector module ZY2 resulting in the player actuation signal PA1 at the terminal pins 2, 14 of the fifth logic module ZY5 in the switch scan selector network.

The all low LJK combination input (ZVB in FIG. 2) to the first logic module ZY1 in conjunction with a SCAN SW's input signal causes the output terminal pin 10 of that unit to go high on the PB line which drives terminal pin 2 high on the second unit ZY2. Now if the ball count signals D and E are both low, at terminal pins 13 and 3, respectively, of the second unit ZY2, the unit ZY5 for the player switches 1 through 8 will remain selected until all 8 of these switches have been scanned and read into the main control unit ZA.

Output signals A, B and C from the ball counter ZF2 will select one of the first set of 2 lever switches of player A. If the output count D is high the next unit ZY6 will be selected and the next 8 lever switches scanned as A, B and C are again employed to select the proper switch within that series of 8 switches, namely, player switches 9 through 16 of the player LA.

Should the output of the ball counter ZF2 have the E line high and the D line low, the next consecutive logic module ZY7 would be selected and the proper lever switch in the third group of switches for player LA would be selected by the permutations and combinations of the signals A, B, C acting to strobe consecutively through player switches 17 through 21, HU and HP, the latter two switches being the handicap units and handicap tens switches.

This is the method for scanning each and every switch of one player and a similar method is used to select the proper switches for the remaining four players based upon the ultimate outputs PA1-3, PB1-3, PC1-3, PD1-3 and PE1-3 from the second, third and fourth input selector logic modules ZY2, ZY3 and ZY4.

The decimal lines LD1-LD11 and RD1-RD11 for the left and right-hand teams, respectively, generate four bit binary codes using gates ZT5 through ZT8 for the left-hand team and gates ZT1 through ZT4 for the right-hand team. The outputs of these gates are, as previously described, selected by the left-right selector unit ZH in accordance with its response to a LEFT SELECT or RIGHT SELECT signal from the main control unit ZA as constrained by the control switches LDS, LP, RDS and RP.

As the individual switches of each player are scanned, the points for each ball are displayed upon the display unit DU in the proper left-hand or right-hand position for the team being scanned up through the last completed frame for each player. The value set into the switch for each ball is used to calculate the score.

The players accumulative scratch and handicap score are displayed to the right of the bowler's frame points as shown by the format of FIGS. 1 and 1A, which illustrate one side of the visible screen of the display unit DU. The handicap score is calculated from input information selected by the switches SA22 and SA23 as previously described in FIG. 3A (16LA1-E1 and 16RA1-E1 in FIG. 1B). These switches are preset at the beginning of the game as is conventionally practiced in the scoring of bowling games.

Each player will have a handicap from 0 to 99 added to his scratch score. The handicap score will be displayed to the right of his scratch score on the display format as shown in FIGS. 1 and 1A.

As each player's score is calculated, the calculating device totals the scratch points and the handicap points for the entire team and displays them at the bottom of the display DU, below the players individual scratch and handicap displays. The command decoder unit ZF provides control signals for controlling the ball and player counters ZF2 and ZF3, respectively, incrementing and decrementing the ball counter ZF2 and incrementing the player counter ZF3 and operation of the printer P, all as have been previously described.

These control functions are executed when the proper code, i.e., two (2) four-bit words with the high order bits being one and one, are sent from the control unit ZA through the command delay unit ZE and decoded by the command decoder ZF. These are the binary bits appearing on the decimal code lines DC2 and DC3 previously described in conjunction with the description of FIG. 6.

To display a character on a visual display unit DU, a command word is sent from the central control unit ZA, decoded by the units ZK1, ZT7, ZJ6, ZL1 or ZL2 (FIG. 7) to provide the strobe signal to enter the six-bit code generated thereby into the display unit DU.

The command is then sent from the unit ZA in two four-bit words. Where the two high order bits of the first word are 10, a display strobe is generated. The two lower bits of word 1 along with word 2 make up the six bit code for the alpha-numeric character to be displayed on the display unit.

GAME CALCULATION FOR DISPLAY OR PRINTOUT

Since the calculation and the sequence of inputting ball information from the ball switches is similar, both programs use much of the same program. Where the program requirements differ, special programs are written for each type of program. This requires that the program be able at certain points to determine which of the special program loops it should execute. Also, since the first nine frames are calculated in almost exactly the same way, the program loops back through the same set of sequences to calculate the score for each of the nine frames. A special routine of sequences is used to calculate the score in the tenth frame which may have two or three balls scored. Also, since each player is calculated in exactly the same way, the same calculation loop is used for each player.

Description of Registers in CPU (ZA) and Each RAM (ZD and ZG)

The central processor unit, ZA, contains sixteen four bit registers TR0 through TR15 which are used as temporary registers to hold data as addresses for a RAM, immediate calculation, or program control.

Each RAM contains 80 four bit registers in that section. 64 main registers designated MR and 16 status registers designated SR. Each RAM contains a four bit output port for transferring four bit codes to external circuits other than ZA, ZB, ZC-ZC6, ZD, and ZG. Each of the MR and SR registers can be read without destroying the data or can be rewritten with new data under program control.

The following definitions and ground rules are used throughout the scoring calculation routines.

1. PRINT FLAG: Register TR14 is used for the print flag. When this register is tested for zero, a value of zero indicates to the CPU that it should follow the program that is used in the print compute cycle. If the value of TR14 is not zero, the CPU will then follow the routine for the display cycle.

2. GAME COMPLETE TEST: Printout of a team game can only be obtained if at least one player has rolled at least the second ball in the tenth frame. This restricts printouts to completed games only. This restriction is not applied to the display calculation.

3. DISPLAY/PRINT FLIP FLOPS: These flip flops are set when the display-compute or print-compute switches are activated. They shall remain set until their respective programs have been completely executed and then they shall be reset.

4. PRINTOUT BUFFER: Thirty-two 4-bit registers are used to hold the information which is to be printed out on one line of printout. If the printout is alpha numeric, two 4-bit registers are used to hold one alpha numeric character.

5. MEMORY REGISTERS:
Right team alphas; MR1 - MR48
Left team alphas; MR49 - MR96
Printer buffer; MR97 - MR128

6. STATUS REGISTERS AND TOTALS

| | |
|---|---|
| SR1-SR4 | Player totals |
| SR5-SR8 | Player display/printout totals |
| SR9-SR12 | Team totals |
| SR13-SR16 | Team handicap totals |
| SR17 | |
| SR18 | |
| SR19 | |
| SR20 | |
| SR21 | Frame counter |
| SR22 | Superstition flag |
| SR23 | Handicap units |
| SR24 | Handicap tens |
| SR25 | Strobe code |
| SR26 | Clear code |
| SR27 | Player number |
| SR28 | |
| SR29 | 5 frame number |
| SR30 | |
| SR31 | |
| SR32 | |

7. CPU REGISTERS

TR7 register is used to temporarily hold the number of strikes or spares in the frame calculation.

TR10 — This register is used to temporarily hold the value of the first ball of a frame or one of the bonus balls.

TR11 — This register is used to temporarily hold the value of the second ball or a bonus ball.

TR12 — This register is used to hold the code for the ball symbol for ball 1 of a frame.

TR13 — This register is used to hold the code for the ball symbol for the second ball of a frame.

TR14 — This register is used to indicate whether the program is a print or a display program.

TR15 — This register is used during the tenth frame to temporarily hold the code for the ball symbol for the third ball in the tenth frame. It is also used in conjunction with register 14 in a display program to form an 8 bit code starting with a 10 to load the display with a display symbol.

The other TR registers are used to control the number of loops in the program or are used as addresses for the RAMS.

8. BALL COUNTER ZF2: This hardware counter is used to control the selection of the proper ball switch when the value of the ball is to be read into the CPU unit. It is incremented and decremented as required in the program to select each ball in sequence and to look at bonus balls if they are required. If a bonus ball is examined, then the counter must be decremented in order to prepare it for the next sequence when the next frame is calculated.

9. PLAYER COUNTER ZF3: This hardware counter is used to select the correct player bank of switches. It is incremented each time a players game is completely calculated.

10. SPECIAL REGISTERS IN THE RAM: Some of the SR registers in the RAM are used to control the program cycles.

The five frame counter (SR29) is initially set to −5 to indicate to the CPU unit when it should print the first five frames of a player. The frame counter (SR21) is used to indicate to the CPU unit that it is calculating the first 9 frames. It is initially set to a −9. When the counter SR21 has been incremented to zero on the 9th frame, the CPU then executes the 10th frame program. PLAYER NUMBER (SR27): This register indicates to the CPU unit which players score is being calculated. SUPERSTITION FLAG (SR22): This register when set to a non-zero value prevents the display from indicating a bowlers true score as long as he has a series of strikes being rolled. This restriction is lifted in the 10th frame after a game has been completed.

11. TEST CONDITIONS IN THE PROGRAM: When the program tests a condition such as print, strike, spare, and an unrolled ball, the program will then execute the next step in sequence or will branch to another part of the program if the condition requires it. Example: If a strike is encountered on the first ball of a frame, the sequence to examine the second ball in the frame would be skipped and the program would then examine the balls in the next frame or frames to determine the bonus points. Otherwise, if no strike was encountered on the first ball of a frame the program would then examine the second ball and load the symbols and ball points for both balls of the frame. Since the program sequence is stored in a ROM, the arithmetic and movement of data required in the program has not been shown in the program sequence. The instruction set in the ROM performs these simple but exact executions of the data between registers. Some of these include reading numbers from the RAM into the accumulator in the CPU, clearing the CPU, incrementing and decrementing the accumulator, executing jump instructions in the program, and setting values in the TR registers.

Since the compute-print and compute-display programs use certain portions of the program in common, the program steps will have suffixes such as LP for left print, RP for right print, D for display, and no suffix if the program is common to both.

Program steps 200, 201, 300, 301, and 302 set up the control to printout the team name for either the left team or the right hand team. Instructions of the program 260 through 263 printout the team name and initiate the control for the first players initial for the printout program.

Instructions 450 and 451 printout the players initials, the word handicap, and the players handicap points. These also set the five frame counter to a −5. This program is used once for each player during a compute-print program.

Instructions 402 through 413 are used to clear all totals from the registers at the beginning of a compute cycle and are used to clear out player totals after each player has had his game computed.

Steps 500 through 514, steps 521 through 593, steps 720 and 721, and steps 800 through 898, are used to read the ball point switches, load the ball point symbols and values in the TR registers 7, and 10-13, and calculate the score during the first 9 frames. Steps 2000 through 2012, and 2030 through 2204 are used to load the ball symbols and ball values in the TR registers 7, 10-13, and 15, and calculate the frame score for the tenth frame. Steps 2013 through 2020 are used to printout the tenth frame ball points and frame score or display the frame symbols for the tenth frame.

Steps 900 through 905, and 970 are used to display the player totals and the team totals. Steps 951 and 952 are used to printout the team totals and the team handicap totals after all five players have had their game printed out.

---

100 Power up; reset control:
When DC power is applied, the CPU, RAMS, and ROMS have their internal registers cleared to zero. When the clear signal is removed, the control proceeds to step 101.

101 Clear alpha flag. TR0/1:
When register TR1 is equal to zero, the control unit can only respond to signals from the left select key or right select key on the alpha keyboard or the four compute-display-print switches. During the input of players initials and team initials, the alpha flag is not equal to zero. This allows the control to input data from the alpha keys on the alpha keyboard.

102 Set alpha input strobe:
This code is set in the output port of RAM 2. (ZG), hereinafter referred to as "port 2". This allows the control to scan the left or right select keys to determine if an alpha input program should be executed.

103 Clear ball counter ZF2:
The ball counter is reset to zero to allow the alpha keyboard switches to be scanned starting with the left select key AK2 and ending with the alpha key "Z" (AK30).

104 Set alpha code 1 alpha A (display code) TR4/5:
Registers TR4 and 5 are initially set for a code corresponding to the alpha letter "A".

105 Set alpha code 2 equal to A (printer code) TR6/7:
Registers TR6 and TR7 are set initially to the code corresponding to "A". Alpha code 2 is the code format required to be loaded in the RAM registers and subsequently used during the printout of players initials and the team name.

106 Set alpha stop counter TR8/9:
These registers TR8 and TR9 control the number of program cycles required to examine all of the alpha input keys to determine if one of the alpha input keys was executed. When the last apha keyboard switch, "Z" (AK30) has been scanned and no key has been operated, the control then examines the left/right compute-display-print switches to see if their programs should be exe- -continued cuted.

107 Test alpha select key; if operated, go to step 132:
The control enters a program to allow the entry of alpha input for the left team when the control senses that the left alpha select key (AK2) is down. This program will then allow three initials for each of the five players and nine alphas for the team name to be entered into the RAM registers for printout and to display the five players initials. If the left alpha select key (AK2) was not executed the control then proceeds to scan the right alpha select key (AK3).

108 Increment ball counter ZF2:
The ball counter is incremented in order to sequentially scan the outpt of each key on the alpha keyboard.

109 Test right alpha select key (AK5); if operated, go to step 130:
If the right alpha select key (AK5) has been executed, the control will enter a program to enter the players initials and the team name for the right team.

110 Test alpha flat: if not set, go to step 118:
The CPU examines the code in register TR1 to see if the control is prepared to accept codes from the alpha keyboard. If the code in register 1 is not equal to zero the control then proceeds to scan the 27 alpha input keys (AK4–AK30). If the code is equal to zero, the control then examines the left/right compute-diplay-print switches (LDS/LP and RDS/RP) to see if their programs should be executed.

111 Increment ball counter ZF2:
See paragraph 108

112 Test blank key (AK3); if operated, go to step 150:
The blank key (AK3) is used to display a short dash or a position on the display which is not a player initial. A blank space is then printed on the printout if the player does not have three initials.

ALPHA KEYBOARD SCAN 113 thru 117 All of the alpha keys (AK5–AK30) on the alpha keyboard are scanned to determine if one of them has been executed. The first key to be scanned is the "A" (AK5). Scanning continues until the last key, "Z" (AK30) has been scanned or one of the keys between A and Z was found to be pressed. If a key was found that was pressed, the program would proceed to step 152 and enter the key code into the system. To test the alpha keys in order, the ball counter is incremented once for each key. Since the alpha code for a "B" is one count higher than the alpha code for the "A", alpha code 1 and alpha code 2 must also be incremented once for each switch. The alpha stop counter, TR8/9, is also incremented once for each key. If the "C" key (AK7) was pressed just as the control tested the blank key (AK4) the following steps would be executed in the program to enter the "C" code into the system: Step 113, 114, 115, 116, 117, 113, 114, 115, 116, 117, 112, 114, and then would proceed to step 152 to enter the code.

SCORING CALCULATION INITIATION

118 Store switch scan code and D/P clear code; set SW-IN/L:
The switch scan code which is loaded in port 2 (RAM ZG) to activate the scan of the ball input switches during a game calculation is stored in SR17. The display/print clear code which is used to clear the display/print flip flops for the left team are stored in SR18. The SW-IN/L code is loaded into port 2 (RAM ZG) in order to examine the left/display (LDS) or left-print (LP) compute switches to see if they have been activated.

119 Read left display/print switches LDS/LP:
A four bit code which contains information on the left display (LDS) and the left print (LP) compute switches is read into the CPU (ZA).

120 If left display switch (LDS) is operated, go to step 250:
The bit corresponding to the left display switch (LDS) is examined and if it is set the program proceeds to step 250.

121 If left print switch (LP) is operated, go to step 200:
The bit assigned to the left print switch (LP) is examined and if it is set the program goes to step 200.

122 Set SW-IN/R strobe; store switch scan code and D/P clear code:
The switch-in strobe for the right team is loaded in to RAM port 2. The switch scan code is stored in SR25 and the display/print clear code is stored in SR26.

123 thru 125 See steps 119 through 121.

126 Wait for key release; go to step 140:
The program would stall at this point if one of the alpha input keys was pressed. This was necessary to prevent loading of extraneous key codes due to the bounce of the key switch. When the switch is released the program goes back to step 102 after clearing printer.

-continued

PLAYERS INITIALS PROGRAM

130 Set alpha flag TR0/1 and set right alpha memory start address TR10/11:
The first step in the right team alpha input program is to set the alpha flag register TR1 to a non-zero code. The first memory location which the first initial of the first player is stored is loaded into TR10/11. The code TR1 is also used to enable the right hand display system to allow it to receive players initials. The program proceeds to step 133, in order to prepare the memory for the right team players initials and team name.

132 Set alpha flag TR0/1 and set left alpha memory start address TR10/11:
This is similar to step 130 except the code in TR1 is set to a non-zero code which would enable the left hand display system.

133 thru 137 Steps 133 through 137 clear 48 four bit registers which are used to store 24 eight bit alpha codes. The right hand team uses reigsters MR1 through MR 48. The left hand team uses registers MR49 through MR96. Each register is loaded with a code of 1111. Register TR2 is loaded with a −3 code to position only three initials for each player on the display. Register TR3 is loaded with a −15 code to allow only 15 initials for all five players to be on the display. Alpha letters entered beyond a count of 15 up to a count of 24 are entered into the memory to serve as the teams name. The initial area of the display is cleared and display made ready for the first players initials. A memory full counter TR14/15 is set to allow only 24 alphas to be entered for each team. After this has been done the program proceeds to step 126 and waits for the key to release.

PRINTER CLEAR

140 Clear printer (ZZ1 to ZZ5):
The registers ZZ1 through ZZ5 are loaded with all 1's to deenergize the printer hammers (H1 to H20). This part of the program is used during the printout of a bowling game and is also used in the idle program where the alpha input switches (Ak2 to AK30) and the compute switches (LDS/LP and RDS/RP) are examined. Its function in the idle program is to prevent the accidental random firing of the print hammers when no print program is to be executed.

BLANK INPUT 150 thru 151 Since special codes are needed to show the short dash used on the display to occupy the space where a players initial is not used and the special code required by the printer to print a space, the display code in TR4/5 and printer code in TR6/7 are replaced with the correct code to show the short dash on the display and a space code on the printer. The regular alpha keys "A" through "Z" are not altered in registers TR4/5 and TR6/7 since these codes correspond to the key that was pressed.

152 Test display full; if full go to step 159:
Register TR3 is incremented once for each alpha code entered. When 15 alpha codes have been entered step 158 in which the alpha code is loaded into the display is skipped when the team name is being entered into the memory.

153 thru 157 Each time an alpha input is entered the display full counter (TR registers) is incremented by one. The line full counter (TR registers) is incremented once each time an alpha input is entered until 3 initials have been entered. When three initials have been entered for one player the counter is reset to −3 and a carriage return is sent to the display to position the entry for the next player on the next line. The carriage return code would be sent once for each three characters entered.

ALPHA STORE 158 thru 161 As long as the display is not full (less than 15 characters have been entered), the alpha code will be loaded on the display. When the display is full, additional key code will not be placed on the display but will be loaded in the memory registers MR1–MR96. The memory location address which is loaded in TR10/11 is incremented twice for each character or a total of 48 times for 24 characters which would include 15 players initials and 9 team letters. The memory full counter (TR registers) is also incremented to indicate to the CPU when the alpha input program has been completed.

COMPUTE-DISPLAY PROGRAM

When the control has determined that it should execute a compute-display program in step 120 or 124, the program enters the compute-display program at step 250. This step sets the print flag, TR14, to a code of 1000. The control then sets spaces in the printout buffer MR97 through MR128. The player counter, ZF3, is then set to zero. The ball counter, ZF2 is then set for the second ball of the tenth frame of player one. The print flag is then tested to see if the program is a display program or a printout program. Since a display program is being described, the program would then branch to step 401. The program would then clear out the team totals and the team handicap totals which are stored in registers SR9 through SR16. The player number which is stored in SR27 and controls the number of times that the program executes a player calculation cycle is set to −5. Also the player counter ZF3 is set to zero. The player totals SR1 through SR4 are set initially to zero. The handicap points are then read from the handicap switches and then loaded in the register SR23 through SR24. The ball counter ZF2 is cleared in order to read the first ball of the first frame. The program then tests the print flag TR14 to see if it has a non-zero value. Since the value is non-zero the program continues on and resets the frame counter SR21 to a value of −9. The strobe to read in the ball point switches is then set in port 2. Registers TR7/10/11 are then cleared to accept the ball points for the first frame. The frame count is then read from register SR21 and incremented before rewriting in register SR21. The incremented value of the frame count is then tested. If the value is not 1 through 9, which indicates that the first nine frames have been calculated, the program would then branch to step 2000 to compute the score for the tenth frame. Since in the first frame the value would be 1 through 9 the program then branches to step 500.

Step 500 is always used to test the first ball of each of the first nine frames to see if a strike has been rolled, if the ball is an unrolled ball, or if the switch contains the number of pins earned by the first ball of the frame. Step 501 tests the first ball for a strike. If the first ball is a strike the program would then branch to step 800 to execute a frame calculation involving a strike. This routine will be described later for the strike condition. The next test for the first ball of a frame is to determine if the ball has been rolled. If the ball has not been rolled the program branches to step 505. In step 505 the ball counter ZF2 is again incremented in order to test the second ball of the frame. Since the first ball was not rolled then a correct positioning of the second ball switch would also indicate an unrolled ball and the program would branch to step 720. Step 720 would then store the space symbols which would be displayed later in registers TR12 and TR13. The ball points in registers TR7, 10, 11 are cleared to zero. The program would then proceed to sep 514 where the print flag would be tested and ound not to be set. In this case the program would proceed to step 594 and would load the display with the two space symbols. Before loading the first symbol the superstition flag is tested to see if it is set. Since it is not set the program would load the player totals into the I/O registers for later display since the total displayed for the player would be equal to his true total. Then the control would load the display with symbol 2 for the second ball. The program would then return to step 411 to clear the registers for the calculation of the next frame and also to check to see if the control should branch to the tenth frame calculation.

If instead of an unrolled ball for the first ball in the frame a strike was found, the program would branch to step 800. The first step in the sequence starting at 800 would be to set the superstition flag SR22 to a non-zero value. The strike symbol which is composed of two symbols is stored in registers TR12 and 13. The 10 points obtained from a strike are loaded in register TR7 by adding 1 to this register. Since a strike requires that bonus points be included in a calculation, the ball counter ZF2 is incremented twice to read the first ball in the next frame. This ball switch is then tested to see if another strike has been rolled in the next frame. If a strike has been rolled in the next frame, the program branches to to step 850 where the value in TR7 is incremented for the bonus points. The ball counter is again incremented to advance the strobe to the next frame. Since a special condition exists in frame 9 where the second bonus ball is the next ball rather than 2 ball counts more, a test of the frame count is made to see if the program should branch to step 880 if the count is 1 through 8. Step 880 increments the ball counter ZF2. This second bonus ball is then tested to see if it is a strike. If it is a strike the program again branches to 890 where the register TR7 is again incremented for the points of the second bonus ball. Since the ball counter ZF2 must be the second ball of the previous frame that we intend to calculate and since in order to read the bonus balls of a strike frame the ball counter ZF2 is now advanced too far, the program decrements the ball counter ZF2 three times to fulfill requirement that at the end of a frame calculation the ball counter must be sitting on the second ball of that frame. Steps 891 through 893 fill this requirement. The program would then go to step 511 where the calculation for the frame is accomplished. In step 511 the points in registers TR7, 10 and 11 are added to the player totals loaded in registers SR1 through SR4. The print flag is then tested and found not to be set. Since the print flag has not been set because we are describing a display program, the program branches to step 594 where the display is again loaded with symbol 1 and symbol 2. Between the loading of symbol 1 and symbol 2 the superstition flag is again tested and in this case is found set. Since the superstition flag is set the player total is not moved to the I/O registers SR5 through SR8 since the players total to be displayed are to be those totals which occurred prior to the string of strikes considered as a superstition factor. After displaying symbol 2 the program would then return to step 411 to calculate the next frame.

If the first ball of the frame was not a strike or an unrolled ball the points for the ball would be loaded in register TR10 and the symbol would be loaded in register TR12. Since we do not have a strike condition the superstition flag SR22 would be cleared if it had been previously set. The ball counter ZF2 would be then incremented in order to read the second ball. This ball switch would then be tested to see if the ball was a spare, an unrolled ball, or a number of pins earned. If the second ball was a spare the program would branch to step 570 where the value in TR7 would be incremented by one to obtain 10 points for the frame. The spare symbol would be set in register TR13. And since the value of the frame was loaded in TR7 the ball points in registers TR10 and 11 would be cleared. Since the spare requires that a bonus ball be calculated, the ball counter is again incremented. The first ball of the next frame is then tested to see if the ball is a strike. If a strike is encountered, the program branches to step 580 where the register TR7 is again incremented for the 10 points earned by the bonus ball. The program again goes to step 592 where the ball counter ZF2 is decremented to fulfill the requirement that at the end of each frame calculation the ball counter be setting on the second ball of the frame. The program would then branch to step 510 to clear the superstition flag had it been set and then calculates the frame score instep 511 before returning to calculate the next frame. If the bonus ball had not been a strike the program would have proceeded to step 573 rather than step 580. If the ball had been unrolled the program would have branched to step 590 where all the ball points would have been cleared, since the frame score could not have been calculated as all bonus balls had not been rolled. However, if the bonus ball had been rolled and was not a strike, the ball value would have been loaded in TR10. In step 575 the superstition flag would have been cleared and then the ball counter ZF2 decremented to fulfill the requirement that the frame calculation end with the ball counter setting on the second ball of the frame. The program would then proceed to step 511 to calculate the frame score.

If the second ball of the frame being calculated was not a spare or an unrolled ball points for the second ball would have been stored in register TR11 and the ball symbol in TR13. The superstition flag would then be cleared and the frame calculated in step 511.

In the above description of the strike situation not all of the bonus ball combinations were examined. In general, in each case the ball counter ZF2 is incremented the required number of steps to read the first bonus ball and then the program reads in the bonus ball to determine what value the ball has. The program tests the bonus ball for strike condition, unrolled ball condition, or ball point value condition. Depending upon the type of bonus ball, the program would then branch accordingly to set the ball points into the proper register TR7, TR10 or TR11. Since the bonus balls are not displayed until their respective frames are being calculated, only the ball symbols for the frame being calculated are stored in registers TR12 and TR13. When a series of strikes have been rolled, the first ball in a frame or one of the bonus balls is not a strike, the superstition flag in register SR22 is reset to zero.

FRAME 10

The loading of the ball data and symbol data for frame 10 is similar to the first nine frames. One exception is that there are three symbols to be displayed in the 10th frame. The third symbol is loaded temporarily in TR15. Since this register is also used to send the symbols out to the display, just prior to sending symbol 1, the symbols in registers TR15 and TR12 are exchanged.

The 10th frame calculation uses the same calculation routine type as the first nine frames.

Ballpoints are loaded in TR10 and TR11 and the number of strikes and spares are also loaded in register TR7. The first two ball symbols of the 10th frame are loaded in registers TR12 and TR13.

The program tests the first ball in the 10th frame and then branches or does not branch according to the value of the first ball. The ball counter ZF2 is then incremented to read the second ball and again decide whether it should branch or not branch in order to read a third ball, if a third ball was rolled.

Since a player's true total must be displayed as the player total at the end of the 10th frame, the superstition factor is ignored and the player total in registers SR1 through SR4 is loaded into registers SR5 through SR8.

After scanning and calculating the 10th frame for a player, the print flag is again tested. Since the flag is not set because we are describing a display program, the program branches to step 2019. At 2019, the display is loaded with the symbols 1 through 3. The control then proceeds to step 900. At step 900 the score loaded in the registers, SR5 through SR8, which represents the player's score up to the last completed frame and which contains the superstition restriction, is then display. The player total which is loaded in in SR1 through SR4 is then added to the team total which is loaded in SR9 through SR12.

The handicap points which were loaded in SR23 and SR24 at the beginning of the player calculation are now added to the player's display total which is held in registers SR5 and SR8. This total is then displayed to the right of the player's total on the display. The handicap points are added to the team handicap points loaded in registers SR13 through SR16.

A carriage return signal is then sent to display. The player counter ZF3 and player number in register SR27 would then be incremented.

The player count would then be tested and if was not 1 through 5, the program would proceed to 950. If additional player calculations are required, the program would proceed to step 405 and would calculate in a similar manner for the second and other consecutive players. Assuming that all five players have been calculated, the program would proceed to step 950. At step 950, the print flag would be tested and found not to be set. The progam would then proceed to step 970 where the display would be loaded with the team total and the team handicap total.

After displaying the team total and the team handicap total, the program would proceed to step 210 where the compute-display and compute-print flip-flops would be reset for that team.

COMPUTE-PRINT PROGRAM

The compute-print program would enter the calculation program at step 200 or 300 depending upon which team was to have been printed out. At step 200 or 300, the control would then be set for the location in the memory registers where the team name was being loaded. The program would then proceed to step 251 where the printer buffer (MR97-MR128) would be loaded with spaces, the player counter ZF3 cleared, and the program initialized to score the first player. The print flag would be tested to see if the program was to be a print program rather than a display.

Since we are describing a printout program, the flag would be equal to zero and the program would continue on. The program would then test to see if at least one player had rolled the second ball in the 10th frame, which is a minimum number of balls which must be rolled for a complete game. If no players had completed the 10th frame, the program would then proceed to step 210 where the compute-print flip-flop for that team would be cleared. If the 10th had been completed by one player or more, the program would then proceed to step 260, where the printout buffer (MR97-MR128) would be loaded with the team name. The program would then print out the name using mode 1 in the printout cycle. The control would then set the memory location of the first player initial in register SR23 and SR24. The program would then proceed to step 402.

Since the program 402 through 408 is the same as for the display program, it will not be described here. Since the print flag is equal to zero and is considered set, the program would proceed to step 450. At step 450 the program would print out the player's initials, the work HCP and the handicap points for the first player.

The five frame counter, SR29, would be set to a −5. The printout buffer (MR97 through MR128) is set with spaces. The program would then proceed to step 410. The program would then proceed in a similar manner as described in the display program above. The first exception would take place at step 514. The print flag would be tested and would be found to be set. The program would proceed to step 515 where a test for first pass through frames 1 through 5 would be executed. If it was the first pass through the first five frames, the control would load the printout buffer (MR97-MR128) with the ball symbols for the frame and also for the frame scores.

In step 517 the five frame counter SR29 would be incremented to determine if five frames had been calculated and their ballpoints and scores loaded in the printout buffer. If the frame count was equal to zero, the control would print the ballpoints, symbols, and the frame scores.

In step 520 the control would reset the frame counters, ball counters, and the players totals. The program would then proceed to re-calculate the first five frames again, but this time would not load the ballpoints, ball symbols and the frame scores in the registers MR97-MR128. After passing the first five frames and calculating the sixth frame, the control would then load the printout buffer (MR97-MR128) with the ball symbols, ballpoints and the frame score. The calculation of frame 7 through 9 would continue in exactly the same manner. The tenth frame would then be calculated similar to the display program, but would test the print flag in step 2012 and would find it set. The program would proceed to step 2013 where the printout buffer (MR97-MR128) would be loaded with the ballpoints, ball symbols and the 10 th frame score. The program would then print out the ballpoints and frame score for the last five frames of the game for the player.

The program would then proceed to step 940 where the player total would be added to the team total. The handicap points for the player would then be added to the team handicap total. The program would then proceed to step 906 where the player counters ZF3 and the player count, SR27, would be incremented. The player count would be tested to see if all five players had had their games calculated and printed and if not, the program would proceed back to step 405 to go through the cycle again for each player remaining. If all players have had their games calculated and printed, the program would proceed to step 950. Here the print flag would again be set and the program would proceed to step 951. This would then print out the team totals and the team handicap total. Also the printer would advance ten lines in order to tear off the paper print tape at the printout.

The program would then proceed to step 210 where the compute-display and compute-print flip-flops for that team would be cleared.

DETAILS OF PRINTOUT PROGRAM

DEFINITIONS FOR MODE1 AND MODE2

1. PRINTER CHARACTER COUNTER: This counter uses TR2 and TR3 to hold the negative number of the character position on the print drum.

2. PRINTER BUFFER ADDRESS REGISTER: This register, TR4/5, is used as an incrementing address for the 16 printout characters to allow readout of the characters during the character position matching with Printer Character character counter TR2/3.

3. I/O BUFFER REGISTERS TR7, TR10-TR13: These registers are loaded with the twenty-one(21) bit codes (one for each hammer or column).

4. REGISTERS ZZ1 THROUGH ZZ5: These hardware registers are loaded with the codes from TR7, TR10-TR13 when characters are to be printed.

5. RESET PULSE: This pulse indicates the start of print drum.

6. CHARACTER PULSE, CH-P: These pulses indicate the beginning and ending of a character position on the print drum.

7. MATCH: When the code loaded in the printout buffer is the character on the print drum which is to be printed next, a calculation is made which indicates that the codes are equal. When a match is obtained a "zero" bit is set in the I/O registers for that column.

8. LOAD WORD 1 through 5 STROBES: These strobes load ZZ1 through ZZ5 with information held in I/O registers TR7, TR10-13.

9. MODE1: This mode is used for alpha-numeric codes of 8 bits in length.

10. MODE2: This mode is used for numeric and ball symbols using 4 bit codes.

PRINTOUT PROGRAM MODE1 DESCRIPTION

This program is used to print out Team name, player's initials and handicap points, and Team totals. The main program has loaded 16 alpha-numeric character codes into MR97-MR128. The printout program is entered at step 3000 and returns to the next main program step after the main program step which branched to step 3000.

Step 3000 set SW-IN code for Reset read in. The character position counter TR2/3 is set to −40 in step 3001 once for each line of printout.

The starting address MR97 is set into TR4/5 once for each character position of drum since each character in the printout buffer must be matched against the character position counter. When the matching cycle is completed for all sixteen characters, the counter would be the address of MR128 and must be reset to MR97 in step 3012.

To determine a character match, the character code in MR97 through MR128 is added to the character position counter valve which is negative. The algebraic sum is zero for a match condition, step 3001. The bit in the I/O register is set to "1" for a non-match and is set to "0" for a match condition. This cycle (step 3003-3004) is repeated until all sixteen characters have their codes tested for a match condition.

In step 3005 TR7 is loaded with code 1111 to prevent any of the print hammers (H1-H20) from firing in columns 1 through 9 (4 right hand print columns). The printer registers ZZ1-ZZ5 are set to 1111 to clear all hammers. The strobe signal is set to load word 1.

On the first character the Reset pulse must be checked to synchronize the control with the first position of the print drum, steps 3007 and 3008. After the printout of the first character position of the print drum, steps 3007 and 3008 are skipped.

The program waits at step 3009 for the character pulse, CHP, for the beginning of character position. When the CHP signal arrives, the printer buffer ZZ1-ZZ5 is loaded with the codes for the hammers through port 1 (step 3010) and then waits for the character pulse at the end of the character position after incrementing the character position counter TR2/3.

When the character pulse arrives, registers ZZ1-ZZ5 are set to turn off the hammers (H1-H20) which were set to print (step 3011).

The character counter TR2/3 is tested in step 3012 for a zero condition which indicates that the print drum has passed all 42 character positions. If character positions have not been passed, the program branches back to step 3002 for the next character position of the pring drum. When the complete line has been printed, the program gives a double line feed signal to the printer to advance the paper two lines in step 3013. The program then exits back to the main program.

PRINTOUT PROGRAM MODE2 DESCRIPTION

The printout mode is used to match 4 bit characters to printout ball values, ball symbols and frame scores. The printout buffer, MR97-MR128 is divided into two sections. MR97-MR112 are used to hold ball values and ball symbols. MR113-MR128 are used to hold frame scores for five frames.

The program for both sections is the same except the starting address for each section is different, MR97 for ball symbols and MR113 for frame scores. The program for mode2 has two diffferent program entry points, step 3025 for ball symbols and step 3026 for frame scores. To reset the starting address of the printout buffers MR97-MR112 and MR113-MR128, only TR1 need be reset to zero for each character match test. Both sections after initializing register TRO for the particular printout buffer section use steps 3027 through 3045. TR1, lower four bits of address are set to zero on step 3028 after clearing printer.

The first symbol to be printed is the / to indicate a spare. This is position one on the print drum. TR3 is set to the 4 bit code equivalent to the spar on step 3027.

Steps 3029 through 3035 read the characters to be printed, mach them against the code in TR3, and set the bits in I/O registers TR7, TR10-TR13 for each character position that could be printed. Since only four bit codes are used, only the spare (/), dash (–), strike (*x*), numbers (0–9) codes are matched.

Four bits only allow 15 printable characters and no print for space to be printed. Other positions on the print drum are skipped over and are not printable.

Before loading character 1 (spare symbol) the reset pulse must be obtained to synchronize the print drum position, steps 3036 through 3039. After the first character steps 3036 through 3039 are skipped.

Step 3039 loads I/O registers TR7, TR10-TR13 into printer registers ZZ1-ZZ5 during the character pulse at the beginning of the character position.

The printer is cleared (hammers de-energized) at the next character pulse.

Pass 1, step 3041, after the printing of any spare symbol, sets the code in TR3 for the 4 bit dash code. The program steps through steps 3028 to 3040 to print those columns requiring dashes.

Pass 2, step 3042, sets the strike code in TR3 and repeats steps 3028 to 3040.

Pass 3-11, step 3043, sets the numeric codes 0–9, starting with the "9" code on pass 3, repeating steps 3028 to 3040, until all of the numeric codes have been printed.

Step 3044, gives the printer a single line feed command, On step 3045 the program return to the next step in the main program.

PROGRAM INSTRUCTIONS

| | |
|---|---|
| | **PROGRAM INSTRUCTIONS** |
| | **ALPHA INPUT** |
| 100 | Power up; reset control |
| 101 | Clear alpha flag TR0/1 |
| 102 | Set alpha input strobe |
| 103 | Clear ball counter (ZF2) |
| 104 | Set alpha code 1 = A (display code) TR4/5 |
| 105 | Set alpha code 2 = A (printer code) TR6/7 |
| 106 | Set alpha stop counter TR8/9 |
| 107 | Test left alpha select key (AK2); if operated, go to 132 |
| 108 | Increment ball counter (ZF2) |
| 109 | Test right alpha select key (AK3); if operated, go to 130 |
| 110 | Test alpha flag; if not set, got to 118 |
| 111 | Increment ball counter (ZF2) |
| 112 | Test blank key (AK4); if operated, go to 150 |
| | **ALPHA KEYBOARD SCAN** |
| 113 | Increment ball counter (ZF2) |
| 114 | Test alpha key (AK5–AK30); if operated, go to 152 |
| 115 | Increment alpha code 1 TR4/5 |
| 116 | Increment alpha code 2 TR6/7 |
| 117 | Increment alpha stop counter TR8/9; if not zero, go to 113 |
| | **SCORING CALCULATION INITIATION** |
| 118 | Store switch scan code and D/P clear code; set SW-IN/L strobe |
| 119 | Read left display/print switches (LDS/LP) |
| 120 | If left display switch (LDS) is operated, go to 250 |
| 121 | If left print switch (LP) is operated, go to 200 |
| 122 | Set SW-IN/R strobe; store switch scan code and D/P clear code |
| 123 | Read right display/print switches (RDS/RP) |
| 124 | If right display switch (RSD) is operated, go to 250 |
| 125 | If right print switch (RP) is operated, go to 300 |
| 126 | Wait for key release; go to 140 |
| 127 | Go to 102 |
| | **PLAYERS INITIALS PROGRAM** |
| 130 | Set alpha flat TR0/1 and set right alpha memory start address TR10/11 and TR2/3 |
| 131 | Go to 133 |
| 132 | Set alpha flat TR0/1 and set left alpha memory start address TR10/11 and TR2/3 |
| 133 | Set memory full counter TR10/11 |
| 134 | Clear memory buffer to be loaded |
| 135 | Reset display full TR3 and line full counter TR2 |
| 136 | Clear/initialize display for player initials |
| 137 | Set memory full counter TR14/15 |
| 138 | Go to 126 |
| | **PRINTER CLEAR** |
| 140 | Clear printer buffer (ZZ1 to ZZ5) |
| 141 | Return to main program |
| | **BLANK INPUT** |
| 150 | Set display dash code TR4/5 |
| 151 | Set printer space code TR6/7 |
| 152 | Test display full, if full go to 159 |
| 153 | Increment display full counter TR14/15 |
| 154 | Increment line full counter TR12 |
| 155 | Test line full; if not full, go to 158 |
| 156 | Reset line full counter TR12 |
| 157 | Load carriage return |
| | **ALPHA STORE** |
| 158 | Load alpha code 1 in display |
| 159 | Load alpha code 2 in memory (RAM) |
| 160 | Increment memory location TR10/11 |
| 161 | Increment memory full counter TR14/15; if not zero go to 126 |
| 162 | Go to 101 |
| | **LEFT PRINT PROGRAM SET UP*** |
| 200 LP | Set alpha buffer address for team name TR0/1 |
| 201 LP | Go to 301 |
| | **RIGHT PRINT PROGRAM SET UP** |

-continued

PROGRAM INSTRUCTIONS

300 RP Set right alpha buffer address for team name TR0/1
301 RP Set print flag TR 14 to 000
302 RP Go to 251

DISPLAY SET UP

250 D Set print flag TR14 to 000

GAME CALCULATION

251 Set spaced in printout memory buffer MR97-MR128 and clear player counter ZF3, set ball counter ZF2 for second ball of tenth frame of player one
252 Test print flag; if not set, go to 401
253 P Test game complete, if game is complete, go to 260
254 Clear display/print flip-flop
255 Go to 100
260 P Load printout buffer (MR97-MR128) for team name printout
261 P Print team name using mode 1
262 P Set first player initial memory location in SR23-24
263 P Go to 402
401 D Erase display
402 Clear team totals SR9-SR16
403 Set player number to 5(SR27)
404 Clear player counter (ZF3)
405 Clear player totals SR1-SR4
406 Read handicap points and store in SR23-SR24
407 Clear ball counter (ZF2)
408 Test print flag TR14; if set, go to 450
410 Reset frame counter SR21
411 Set strobe in port 2 (RAM ZG)
412 Clear registers TR7, 10, and 11
413 Increment frame count SR21
414 Test frame count; if not 1 through 9; go to 2000
415 Go to 500
450 P Print player initials/handicap points (mode 1)
451 P Reset 5 frame counters SR29; set printout buffer (MR97-MR128) to spaces
452 P Go to 410

CALCULATION PROGRAM FOR FRAME 1 THROUGH 9

500 Test ball switch (16A-E, 16RA-E)
501 If strike, go to 800
502 If unrolled, go to 505
503 Store ball points 1 and ball symbol 1 in TR10 and TR12
504 Clear superstition flag SR22
505 Increment ball counter (ZF2)
506 Test ball switch
507 If spare, go to 570
508 If unrolled, go to 720
509 Store ball point 2 and ball symbol 2 TR11 and TR13
510 Clear superstition flag SR22
511 Calculate frame score
514 Test print flag, if not set, go to 594
515 P Test for 1st pass through frame 1-5; if 2nd pass, go to 517
516 P Load printout buffer (MR97-MR112) with ball symbols, load printout buffer with frame score (MR113-MR128)
517 P Increment 5 frame counter SR29
518 P Test 5 frame counter SR29; if not equal to 0, go to 521
519 P Print ball points and symbols (mode 2)
519-2 P print frame scores (mode 2); line feed
520 Reset frame counter SR21 and ball counter (ZF2). Clear player total go to 410
521 Increment ball counter ZF2
522 Go to 411
570 Increment tens TR7 (set spare symbol TR13); clear ball points TR10/11
571 Increment ball counter (ZF2)
572 Test ball switch, if strike, go to 580
573 If unrolled, go to 590
574 Load bonus point in TR10
575 Clear superstition flag SR22
576 Decrement ball counter (ZF2)
577 Go to 511
580 Increment tens TR7
581 Go to 592
590 Clear tens TR7
591 Clear all ball points TR10/11
592 Decrement ball counter (ZF2)
593 Go to 510
594 D Load display with symbol 1
595 D Test superstition flag; if set, go to 597
596 D Load display totals with player totals
597 D Load display with symbol 2
598 D Go to 411
720 Load 2 space symbols TR12/13; clear ball points TR7/10/11
721 Go to 514
800 Set superstition flag SR22
801 Load strike symbol (X) in TR12/13
802 Increment tens TR7
803 Increment ball counter (ZF2)
804 Increment ball counter (ZF2)
805 Test ball switch (16LA-E, 16RA-E); if strike go to 850

-continued

PROGRAM INSTRUCTIONS

806 If unrolled, go to 808
807 Load ball bonus points in TR10; clear superstition flag SR22
808 Increment ball counter (ZF2)
809 Test ball switch (16LA-E, 16RA-E); if spare go to 888
810 If unrolled, go to 514
811 Load ball bonus in TR11; increment ball counter (ZF2)
812 Go to 891
850 Increment tens TR7
851 Increment ball counter (ZF2)
852 Test frame; if 1 through 8, go to 880
853 Test ball swtch (16LA-E, 16RA-E) if strike go to 888
854 Increment ball counter (ZF2)
855 In unrolled, go to 895
856 Load ball points TR10
857 Go to 891
880 Increment ball counter (ZF2)
881 Test ball swtich (16LA-E, 16RA-E); if strike, go to 890
882 Go to 855
888 Clear ball points TR10/11
889 Increment ball counter (ZF2)
890 Increment tens TR7
891 Decrement ball counter (ZF2)
892 Decrement ball counter (ZF2)
893 Decrement ball counter (ZP2)
894 Go to 511
895 Decrement ball counter (ZF2)
896 Decrement ball counter (ZF2)
897 Decrement ball counter (ZF2)
898 Go to 514
900 D Load display unit with player display total
901 D Add player total to team total
902 D Add handicap points to players display total
903 D Load display with player handicap total
904 D Add player handicap to team handicap points
905 D Load carriage return
906 Increment player counter (ZF3); increment player count SR27
907 Test player count; if not 1 through 5, go to 950
908 Go to 405
940 Add player total to team total
941 Add team handicap points to team total (i.e. make team handicap total)
942 Go to 906
950 Test print flag; if not set, go to 970
951 P Print team totals and team handicap total; line feed 10 times (mode 1)
952 P Go to 254
970 D Load display with team total and team handicap total
971 D Go to 254

FRAME 10

2000 Test ball switch (16LA-E, 16RA-E); if strike, go to 2060
2001 If unrolled, go to 2004
2002 Load ball point 1 TR10
2003 Load symbol 1 TR12
2004 Increment ball counter (ZF2)
2005 Test ball switch (16LA-E, 16RA-E); if spare, go to 2040
2006 If unrolled, go to 2030
2007 Load ball point 2 TR11
2008 Load ball symbol 2 TR13
2009 Load space symbol TR15
2011 Calculate frame score
2012 Test print flag; if not set, go to 2019
2013 P Load printer buffer (M97-M112) with ball symbols 1, 2 and 3
2014 P Load printer buffer (M-113-M128) with frame scores
2015 P Print ball points (mode 2)
2016 P Print frame scores (mode 2); line feed
2017 P Go to 940
2019 D Load display with symbols 1-3
2020 D Go to 900
2030 Load 3 space symbols TR12, 13, 15
2031 Clear ball points TR10, 11, 7
2032 Go to 2012
2040 Increment tens TR7
2041 Clear ball points TR11
2042 Set spare symbol TR13
2043 Increment ball counter (ZF2)
2044 Test ball switch (16LA-E, 16RA-3); if strike, go to 2051
2045 If unrolled, go to 2030
2046 Load ball point 1 TR10
2047 Load ball symbol 3 TR15
2048 Go to 2011
2051 Increment tens TR7
2052 Set strike symbol TR15
2053 Go to 2011
2060 Increment tens TR7
2061 Load strike symbols 1 and 2 in TR12/13
2062 Increment ball counter (ZF2)
2063 test ball switch (16LA-E, 16RA-E); if strike, go to 2102
2064 If unrolled, go to 2030

-continued

| | PROGRAM INSTRUCTIONS |
|---|---|
| 2065 | Load ball symbol 2 TR13 |
| 2066 | Load ball point 1 TR10 |
| 2068 | Increment ball counter (ZF2) TR8/9 |
| 2069 | Test ball swtich (16LA-E, 16RA-E); if spare, go to 2081 |
| 2070 | If unrolled, go to 2030 |
| 2071 | Load ball symbol 3 TR15 |
| 2072 | Load ball point 2 TR11 |
| 2073 | Go to 2011 |
| 2081 | Clear ball points TR10 |
| 2082 | Set spare symbol TR15 |
| 2083 | Increment tens TR7 |
| 2084 | Go to 2011 |
| 2102 | Set strike symbol 3 TR15 |
| 2103 | Increment gtens TR7 |
| 2104 | Increment ball counter (ZF2) TR8/9 |
| 2105 | Test ball switch (16LA-E, 16RA-E); if strike, go to 2200 |
| 2107 | If unrolled, go to 2030 |
| 2108 | Go to 2071 |
| 2200 | Increment tens TR7 |
| 2204 | Go to 2011 |
| | PRINTOUT MODE1 |
| 3000 | Set SW-In strobe code in Port 2 |
| 3001 | Set character counter TR2/3 to −40 |
| 3002 | Set print buffer address TR4/5 to MR97 |
| 3003 | Compae 8 bit characters in print buffer against character counter TR2/3 |
| 3004 | Scan printer buffer (MR97-MR128) for matches and shift matches (zeo bits) into I/O buffer TR10-TR13 |
| 3005 | Set TR7 with 1111 code; Set ZZ1 through ZZ5 with clear code of 1111; Set ZF to Load Word 1 strobe. |
| 3006 | if not first character position, go to 3009. |
| 3007 | Wait for printer reset pulse |
| 3008 | Wait for printer reset to leave |
| 3009 | Wait for character pulse |
| 3010 | Load printer ZZ1 through ZZ5; wait for next character pulse |
| 3011 | Clear priter ZZ1 through ZZ5 |
| 3012 | If not last character, go to 3002 |
| 3013 | Line feed twice |
| 3014 | Return to main program |
| | PRINTOUT MODE2 |
| 3025 | Set Print Buffer address TR0/1 to MR97; go to 3027 |
| 3026 | Set Print Buffer address TR0/1 to MR113 |
| 3027 | Set match code TR2/3 to spare (/) code |
| 3028 | Clear I/O registers TR7, TR10-TR13; set TR1=0 |
| 3029 | Read character in Print Buffer (MR97-112 or MR113 to 128) |
| 3030 | Compare character code with match code |
| 3031 | If codes match, go to 3034 |
| 3032 | Set I/O buffer bit to preclude print hammer (TR7, TR10-TR13) |
| 3033 | Go to 3035 |
| 3034 | Set I/O buffer bit (TR7, TR10-TR13) for print hammer |
| 3035 | Increment printer buffer address TR0/1; if not last character in printer buffer, go to 3030 |
| 3037 | Set SW-IN strobe in port 2 (RAM Z G) to 1111 and wait for reset pulse |
| 3038 | Wait for reset pulse to leave |
| 3039 | Load ZZ1-ZZ5 when character pulse arrives |
| 3040 | Clear ZZ1-ZZ5 when next character pulae arrives |
| 3041 | PASS 1 - Set match code TR2/3 to dash code |
| 3042 | PASS 2 - Set match code TR2/3 to strike code (X). |
| 3043 | PASS 3 to 12 - Set match code TR2/3 ten times starting at decimal 9 through 0 code |
| 3044 | PASS 13 - Line feed strobe |
| 3045 | Return to main program |

*D after step number means "display only"
P, LP or RP after step number means "Print only"
No letter after step number is common to both programs

APPENDIX I

The following is a list of components comprising the various commercially available integrated circuit packages of the present invention which are identified with exemplary commercial sources.

Any commerical part numbers with the prefix SN are standard designations in the industry except that the SN is a designation of Texas Instruments, the exemplary source associated with those part numbers.

The SN74195 4-bit Parallel-Access Shift Register and the SN74122 Retriggerable Monostable Multivibrator With Clear are further defined in the publication, "IC Circuits Catalog For Design Engineers, Texas Instruments, First Edition, CC401 10072-41-US," which is incorporated by reference herein.

The UD4181 Quadruple Power Driver of Sprague Electric is further defined by reference to that company's Bulletin 29035(4/69), which is incorporated by reference herein.

The N74157 Quadruple 2-Input Data Selector/Multiplexor of Signetics Digital is further defined by the commercially available data of that company identified as 54/74TTL Series, Page 141, which is incorporated by reference herein.

APPENDIX I (Continued)

The 4001 ROM, 4002 RAM and 4004 CPU of Intel Corporation are marketed under that company's trademark "MCS-4" and are fully described in the publication of Intel Corporation incorporated herein entitled: Intel "MCS-4" Micro Computer Set Users Manual, March 1972, Rev.2.

A suitable printer P for the print-out of this invention is described in (A) Sales Brochure, 2 pages, Alpha-Numeric Pringing Mechanism - POS 101 Series Model AN-101F; and (B) Specifications For Alpha-Numeric Printer AN-101F (Preliminary), August 1, 1971 - 10 pages - Shinshu Seiki Co., Ltd. - 80 Harashinden, Hirooka, Shiojiri-shi, Nagano-ken, Japan which comprises a technical operating manual of the manufacturer.

A suitable display unit DU for the visual readout of this invention is described in (A) Digivue Display/Memory Units, Datasheet Model 80-33, - 10 pages, Owens-Illonois, Inc., Toledo, Ohio 43651;

(B) Technical Bulletin DU-140, July 1, 1971, The Digivue Display/Memory Unit: A New Display System Technology, David E. Little, Owens-Illinois, Inc., Toledo, Ohio, 3 Pages; and (C) Technical Bulletin DU-130, April 7, 1972, A Quarter-Million-Element AC Plasma Display With Memory, W. E. Johnson and L. J. Schmersal, Owens-Illinois, Inc., Toledo, Ohio, 3 pages text, 11 pages illustrations which comprises a technical data sheet of the manufacturer.

| COMPONENT | COMMERCIAL PART NO. | DESCRIPTION | SOURCE |
|---|---|---|---|
| Z-A | 4004 CPU | 4-Bit Central Processor Unit (45 Instructions) | Intel Corporation Santa Clara, California (See attached Literature) |
| Z-B | 4001 ROM | 256x8-Bit Mask Programmable ROM and 4-Bit Input-Output Port | |
| Z-C | " | | |
| through | " | | |
| Z-C-6 | " | | |
| Z-D | 4002 RAM | 320-Bit RAM and | |

-continued

| COMPONENT | COMMERCIAL PART NO. | DESCRIPTION | SOURCE |
|---|---|---|---|
| Z-E | SN74195 | 4-Bit Output Port 4-Bit Parallel Access Shift Register | Texas Instruments |
| Z-F | SN74154 | 4-Line to 16-Line Decoder/Demultiplexor | |
| Z-F-2 | SN74193 | Synchronous 4-Bit Up/Down Counters | |
| Z-F-3 | SN7493 | | |
| Z-G | 4002 RAM | (Same as ZD) | |
| Z-H | N74157 | Quadruple 2-Input Data Selector/Multiplexor | Signetics Digital |
| Z-J-1 | SN7404 | Hex Inverter | Texas Instruments |
| Z-J-2 | " | | |
| Z-J-3 | " | | |
| Z-J-4 | " | | |
| Z-J-5 | " | | |
| Z-J-6 | " | | |
| Z-J-7 | " | | |
| Z-J-8 | " | | |
| Z-K-1 | " | | |
| Z-K-2 | " | | |
| Z-K-3 | " | | |
| Z-K-4 | " | | |
| Z-K-5 | " | | |
| Z-K-6 | " | | |
| Z-K-7 | " | | |
| Z-K-8 | " | | |
| Z-K-9 | SN7417 | Hex Buffer/Driver With Open Collector High Voltage Outfit | Texas Instruments |
| Z-K-10 | " | | |
| Z-K-11 | " | | |
| Z-K-12 | " | | |
| Z-K-13 | " | | |
| Z-K-14 | " | | |
| Z-K-15 | Sn7404 | Hex Inverter | |
| Z-K-16 | " | | |
| Z-K-17 | " | | |
| Z-K-18 | " | | |
| Z-K-19 | " | | |
| Z-L-1 | SN7408 | Quadruple 2-Input Positive AND Gate | |
| Z-L-2 | SN7408 | | |
| Z-M-1 | Sn7400 | Quadruple 2-Input Positive NAND Gate | |
| Z-M-2 | " | | |
| Z-M-3 | " | | |
| Z-M-4 | " | | |
| Z-M-5 | SN7410 | Triple 3-Input Positive NAND Gate | |
| Z-N-1 | SN7400 | Quadruple 2-Input Positive NAND Gate | |
| Z-N-2 | " | | |
| Z-N-3 | " | | |
| Z-N-4 | " | | |
| Z-P-1 | " | | |
| Z-P-2 | " | | |
| Z-P-3 | " | | |
| Z-P-4 | " | | |
| Z-Q-1 | " | | |
| Z-Q-2 | " | | |
| Z-Q-3 | " | | |
| Z-Q-4 | " | | |
| Z-Q-5 | " | | |
| Z-R-1 | SN7403 | Quadruple 2-Input Positive NAND Gate | |
| Z-R-2 | " | | |
| Z-R-3 | " | | |
| Z-R-4 | " | | |
| Z-R-5 | " | | |
| Z-R-6 | " | | |
| Z-R-7 | SN7404 | Hex Inverter | |
| Z-R-8 | " | | |
| Z-R-9 through Z-9-17 | " | | |
| Z-S-1 | SN7403 | Quadruple 2-Input Positive NAND Gate | |
| Z-S-2 | SN7403 | | |
| Z-S-3 | " | | |
| Z-S-4 | " | | |
| Z-T-1 | SN7430 | 8-Input NAND Gate | |
| Z-T-2 | " | | |
| Z-T-3 | " | | |
| Z-T-4 | SN7410 | Triple 3-Input Positive | |

-continued

| COMPONENT | COMMERCIAL PART NO. | DESCRIPTION | SOURCE |
|---|---|---|---|
| | | NAND Gate | |
| Z-T-5 | SN7430 | 8-Input NAND Gate | |
| Z-T-6 | " | | |
| Z-T-7 | " | | |
| Z-T-8 | SN7410 | Triple 3-Input Positive NAND Gate | |
| Z-V-1 | SN7417 | Hex Buffer/Driver With Open Collector High Voltage Output | |
| | " | | |
| Thru | " | | |
| | " | | |
| Z-V-111 | " | | |
| | " | | |
| Z-X-1 | UD4181 | Quadruple Power Drive | Sprague Electric Bulletin 29035 (4/69) |
| | " | | |
| | " | | |
| Thru | " | | |
| | " | | |
| | " | | |
| Z-X-20 | " | | |
| Z-X-22 | SN74122 | Retriggerable Monostable Multivibrator With Clear | Texas Instruments |
| Z-X-25 | SN7408 | Quadruple 2-Input Positive AND Gate | |
| Z-X-28 | SN7404 | Hex Inverter | |
| Z-X-29 | SN74156 | Dual 2-Line-to-4-Line Decoder/Multiplexor | Texas Instruments |
| Z-X-30 | " | | |
| Z-X-31 | " | | |
| Z-S-32 | " | | |
| Z-X-33 | SN7417 | Hex Buffer/Driver With Open Collector High Voltage Output | |
| Z-X-34 | " | | |
| Z-Y-1 | Sn74155 | Dual 2-Line-To-4-Line Decoder/Multiplexor | |
| Z-Y-2 | " | | |
| Z-Y-3 | " | | |
| Z-Y-4 | " | | |
| Z-Y-5 | SN74156 | Dual 2-Line-To-4-Line Decoder/Multiplexor | |
| | " | | |
| Thru | " | | |
| | " | | |
| Z-Y-19 | " | | |
| Z-Y-20 | " | | |
| | " | | |
| Thru | " | | |
| | " | | |
| Z-Y-34 | " | | |
| Z-Z-1 | SN74195 | 4-Bit Parallel Access Shift Register | |
| Z-Z-2 | " | | |
| Z-Z-3 | " | | |
| Z-Z-4 | " | | |
| Z-Z-5 | " | | |

What is claimed

1. Means for calculating and displaying bowling scores, comprising:

input means for recording ball by ball pinfall, strikes and spares for at least one bowler in the course of a bowling game;

computing means selectively energized to calculate a running score for a said bowler through the last bowling frame completed in said game;

actuating means selectively energizing said computing means; and display means controlled by said computing means for displaying the individual results of each ball rolled by a said bowler in the course of said game through the last completed frame, updated substantially concurrently with each selective energization of said computing means;

said computing means including means constraining said computing means to scan said input means and calculate and constrain said display means to display anew each and every factor of said bowlers score from the first ball rolled in said game for each and every selective energization of said computing meamns through the last frame completed by said bowler.

2. A semiautomatic scoring system for a plurality of bowlers on a pair of bowling lanes comprising a player console including:

input means having a discrete data position for each possible ball to be rolled by each bowler in the course of a bowling game for storing at corresponding ones of said data positions, ball-by-ball pinfall, strikes and spares for each said bowler, a display system comprising an electronically controlled video display device, a printer, and character generator means for defining the output of said video display device and said printer, a general-purpose mini-computer processor connected with said input means so that said input means serves as a main memory for said processor, and a read-only memory containing a computer program for controlling the operation of the processor in the computing and display of scores on said bowling lanes, said input means in each player console being connected to supply player and pinfall information in the form of digital signals to said generalpurpose processor in the player console, said character generator in each said player console display system being constructed to translate data stored in the input means into video signals and printer control signals to supply the video display device and the printer, respectively, said actuating means responsive to said input means for actuating said processor to process the data in said input means, whereby any change in the data stored in said input means is reflected in the outputs of both said video display device and said printer.

3. A system as claimed in claim 2 wherein said input means includes a random access memory which cooperates with said display system to provide signals indicating players' initials to said print means.

4. A system as claimed in claim 3 wherein said input means includes a random access memory portion for storing players' initials for the duration of said game, and for storing ball, frame and game score data for supply to said printer means.

5. A system as claimed in claim 4 in which said input means includes a plurality of discrete data positions assigned to left and right teams bowling on said pair of lanes, and including means for selecting the data stored for the left or the right team for printing, and means for transmitting synchronizing signals from said printer to said processor to synchronize the transfer of the left or right team data from the input means to the printer with the operation of the printer.

6. A system as claimed in claim 5 including means responsive to the data stored in the random access memory for generating a bit pattern for concurrently controlling a plurality of print heads included in said printr and located in parallel alignment across said paper tape and wherein said printer prints on a paper tape movable with respect to print heads, and including means for transmitting a signal from said printer to said processor to advance said paper tape.

7. Scorekeeping means for calculating and displaying bowling scores, comprising:

input means having a discrete data position for each possible ball to be rolled by at least one bowler in the course of a bowling game for receiving and recording, at corresponding ones of said data positions, ball by ball pinfall, strikes and spares for said bowler;

computing means selectively energized to calculate a running score for a said bowler through the last bowling frame completed in said game;

actuating means selectively energizing said computing means, display means controlled by said computing means for displaying the individual results of each ball rolled by a said bowler in the course of said game through the last completed frame, updated substantially concurrently with each selective energization of said computing means;

means responsive to said actuating means to scan said discrete data positions of said input means in sequence from the first ball rolled by said bowler to the last ball rolled thereby, and transmit said data from said input means to said computing means for calculaion of the frame scores of said bowler;

said computing means including calculating means receiving said data to calculate the frame score for each and every completed frame in said bowler's game and interconnected with said display means to transmit said encoded data and said frame scores to said display means and said display means displaying anew each and every factor of said bowler's score from the first ball rolled in said game through the last frame completed by said bowler for each and every selective energization of said computing means by said actuating means.

8. The invention defined in claim 7 wherein said input means further comprises a like plurality of said discrete data positions for each of a plurality of bowlers.

9. The invention defined in claim 8 including printing means controlled by said computing means upon the completion of a given bowling game to print out the ball-by-ball, mark, discrete frame score history and game total of said bowler.

10. The invention defined in claim 7 wherein said computing means further include superstition means responsive to the output of said scan means to detect a string of consecutive strikes rolled by a said bowler and preclude display by said display of a score including pinfall earned during said string and upon discontinuance of said string permitting display by said display means of said of each and every frame subtotal of said bowler's score through the last completed frame of said bowler upon the next occurring energization of said computing means by said actuating means; and printing means controlled by said computing means upon the completion of a given bowling game to print out the ball-by-ball, mark, discrete frame score history and game total of said bowler.

11. The invention defined in claim 10, wherein said input means further comprises a like plurality of said discrete data positions for each of a plurality of bowlers.

12. The invention defined in claim 7 wherein said input mans further includes means establishing a handicap value for said bowler and at least one discrete data position for same; and said computing means and display means further include, respectively, means calculating and indicating a running handicap score for said bowler through the last frame completed by said bowler.

13. The invention defined in claim 12 wherein said input means further comprises a like plurality of said discrete data positions for each of a plurality of bowlers.

14. The invention defined in claim 11, wherein said input means further includes means establishing a handicap value for each said bowler and at least one discrete data position for same; and said computing means and said display means further include, respectively, means calculating and indicating a running handicap score for each said bowler through the last frame completed by said bowler.

15. The invention defined in claim 8 wherein said computing means further includes superstition means responsive to the output of said scan means to detect a string of consecutive strikes rolled by one of said bowlers and precluding display by said display means of said running score including pinfall earned during said string and upon discontinuance of said string permitting calculation by said computing means of the individual score of said one bowler through the last completed frame of said bowler upon the next occurring selective energization of said computing means by said actuating means.

16. The invention defined in claim 15 wherein said input means further includes means establishing a handicap value and at least one discrete data position for same for each said player; and said computing means and said display means further include, respectively, means calculating and indicating running scratch and handicap scores for each said player and a said team through the last completed frame of each player on said team.

17. The invention defined in claim 12 wherein said input means further includes means establishing a handicap value and at least one discrete data position for same for each said bowler; and said computing means and said display means further include, respectively, means calculating and indicating running scratch and handicap scores for each said bowler and a team comprising a plurality of said bowlers through the last completed frame of each said bowler on said team.

18. The invention defined in claim 17 further comprising printing means controlled by said computing means upon the completion of a bowling game to print out the ball-by-ball, mark, discrete frame scoring history and game total of each said bowler on said team together with the total game score of said team.

* * * * *